US010349687B2

(12) United States Patent
Baschak et al.

(10) Patent No.: US 10,349,687 B2
(45) **Date of Patent: *Jul. 16, 2019**

(54) COLD-WEATHER APPAREL ITEM

(71) Applicant: NIKE, Inc., Beaverton, OR (US)

(72) Inventors: Kim D. Baschak, Portland, OR (US); Stewart D. Horner, Portland, OR (US); Iustinia Koshkaroff, Portland, OR (US); Phyllis Michele Lininger, St. Helens, OR (US); Matthew D. Nordstrom, Portland, OR (US); Luke A. Pezzimenti, Portland, OR (US); Stephanie J. Scott, Portland, OR (US)

(73) Assignee: Nike, Inc., Beaverton, OR (US)

( * ) Notice: Subject to any disclaimer, the term of this patent is extended or adjusted under 35 U.S.C. 154(b) by 546 days.

This patent is subject to a terminal disclaimer.

(21) Appl. No.: 15/047,146

(22) Filed: Feb. 18, 2016

(65) Prior Publication Data

US 2016/0242474 A1 Aug. 25, 2016

Related U.S. Application Data

(60) Provisional application No. 62/242,781, filed on Oct. 16, 2015, provisional application No. 62/242,778, (Continued)

(51) Int. Cl.
*A41D 1/02* (2006.01)
*A41D 13/00* (2006.01)
(Continued)

(52) U.S. Cl.
CPC ..... *A41D 13/0015* (2013.01); *A41D 27/28* (2013.01); *A41D 31/102* (2019.02); *A41D 31/14* (2019.02); *A41D 2200/20* (2013.01)

(58) Field of Classification Search
CPC .... A41D 13/0015; A41D 13/02; A41D 27/28; A41D 2400/20; A41D 2400/22;
(Continued)

(56) References Cited

U.S. PATENT DOCUMENTS 415,676 A 11/1889 Magee
948,142 A 2/1910 Karp
(Continued)

FOREIGN PATENT DOCUMENTS

DE 847733 C 8/1952
FR 2784868 B1 4/2000
(Continued)

OTHER PUBLICATIONS

International Preliminary Report on Patentability dated Aug. 31, 2017 in International Patent Application No. PCT/US2016/018708, 13 pages.

(Continued)

*Primary Examiner* — Katharine Gracz
(74) *Attorney, Agent, or Firm* — Shook, Hardy & Bacon LLP

(57) ABSTRACT

A cold-weather apparel item configured to promote breathability, provide warmth, and minimize distractions is provided herein. The cold-weather apparel item is formed from a composite fabric that is breathable and repels water. The cold-weather apparel item further comprises at least a hood lock cord system that maintains the hood of the apparel item in a secure position while not being used, inflow air ducts and outflow air ducts to provide ventilation, and a layered thumbhole assembly with overlapping panels that fits snugly around a wearer's thumbs when used.

16 Claims, 26 Drawing Sheets

Related U.S. Application Data filed on Oct. 16, 2015, provisional application No. 62/242,760, filed on Oct. 16, 2015, provisional application No. 62/242,742, filed on Oct. 16, 2015, provisional application No. 62/118,288, filed on Feb. 19, 2015.

(51) Int. Cl.
*A41D 27/28* (2006.01)
*A41D 31/14* (2019.01)
*A41D 31/102* (2019.01)

(58) Field of Classification Search
CPC ..... A41D 1/02; A41D 1/084; A41D 27/10; A41D 2200/20
USPC ..... 2/84, 93, 94, 95
See application file for complete search history.

(56) References Cited

U.S. PATENT DOCUMENTS 1,012,648 A 12/1911 Karp
1,338,098 A 4/1920 Schneider
1,525,322 A 2/1925 Post
1,784,158 A * 12/1930 Place ..... A41D 27/28 2/87
1,982,845 A * 12/1934 Wagman ..... A45C 3/06 383/33
2,057,713 A * 10/1936 Edelson ..... A41D 27/28 2/87
2,084,173 A * 6/1937 Wexler ..... A41D 27/28 2/87
2,150,171 A 3/1939 Kolly
2,160,682 A 5/1939 Silber
2,170,339 A 8/1939 Reeves
2,264,314 A 12/1941 Johns
2,686,913 A 8/1954 Brierley
2,715,226 A * 8/1955 Weiner ..... A41D 27/28 2/79
2,803,824 A 8/1957 Parish
3,045,243 A * 7/1962 Lash ..... A41D 27/28 2/1
3,086,215 A * 4/1963 Di Paola ..... A41D 27/28 2/87
3,153,793 A * 10/1964 Lepore ..... A41D 3/00 2/108
3,296,626 A * 1/1967 Ludwikowski ..... A41D 27/28 2/87
3,496,572 A 2/1970 Herzig
3,698,014 A 10/1972 Cebula
3,706,102 A * 12/1972 Grenier ..... A41D 27/28 2/272
4,170,793 A 10/1979 O'Brien
4,513,451 A * 4/1985 Brown ..... A41D 27/285 2/102
4,665,563 A * 5/1987 Harvey ..... A41D 3/04 2/108
4,722,099 A * 2/1988 Kratz ..... A41D 27/28 2/115
4,756,027 A 7/1988 Buenos et al.
4,810,559 A 3/1989 Fortier et al.
5,035,000 A 7/1991 Matthias
D319,113 S 8/1991 Adams
5,097,534 A 3/1992 Viemeister et al.
5,274,850 A 1/1994 Aldridge
5,388,270 A 2/1995 Hewitt
5,504,944 A 4/1996 Bromer et al.
5,642,526 A * 7/1997 Thompson ..... A41D 13/02 2/69
5,687,423 A * 11/1997 Ross ..... A41D 27/28 2/70
5,704,064 A * 1/1998 van der Sleesen .... A41D 27/28 2/108
5,727,256 A * 3/1998 Rudman ..... A41D 27/28 2/115
5,752,277 A * 5/1998 van der Sleesen .... A41D 27/28 2/108
5,794,265 A 8/1998 Reich
5,815,837 A 10/1998 Christman et al.
5,845,336 A * 12/1998 Golde ..... A41D 27/28 2/93
5,867,825 A 2/1999 Scheerer et al.
5,913,408 A 6/1999 Shanahan
5,953,758 A 9/1999 Foster
6,070,274 A * 6/2000 van der Sleesen ..... A41D 13/0156 2/456
6,076,189 A 6/2000 Christman et al.
6,085,353 A * 7/2000 van der Sleesen .... A41D 15/04 2/108
6,122,772 A 9/2000 De Guzman
6,163,883 A * 12/2000 Hong ..... A41D 27/28 2/69
6,263,511 B1 7/2001 Moretti
6,332,221 B1 12/2001 Gracey
6,339,845 B1 1/2002 Burns et al.
D457,709 S 5/2002 Davis
6,449,772 B1 9/2002 Donner
6,654,963 B2 12/2003 Fayle et al.
6,665,878 B1 12/2003 Way
6,766,565 B2 * 7/2004 Crye ..... A41D 27/28 24/104
6,874,162 B2 4/2005 Boezi
6,996,847 B2 * 2/2006 Anderson ..... A41D 3/02 2/158
7,043,766 B1 5/2006 Foreman et al.
7,168,098 B2 1/2007 West
7,310,825 B2 * 12/2007 St-Germain ..... A41D 27/10 2/123
7,380,286 B1 6/2008 Bryant, Sr.
7,418,740 B2 9/2008 Anderson et al.
7,428,772 B2 9/2008 Rock
7,540,037 B1 * 6/2009 Bittler ..... A41D 13/0543 2/69
7,568,238 B2 8/2009 Schossberger et al.
7,779,485 B2 8/2010 Gandy
8,133,824 B2 3/2012 Harber
D657,532 S 4/2012 Gaeir et al.
8,438,665 B2 5/2013 Roemer et al.
8,453,264 B2 6/2013 Mickle et al.
8,453,270 B2 6/2013 Blackford
8,601,612 B2 12/2013 Funk-Danielson
D707,974 S 7/2014 Blackford
8,850,615 B2 10/2014 Demarest et al.
D720,119 S 12/2014 Pankhurst et al.
8,910,313 B2 12/2014 Gordon et al.
9,009,865 B2 * 4/2015 Gilreath ..... A41B 7/02 2/123
9,060,551 B2 6/2015 Nordstrom et al.
9,062,913 B2 6/2015 Araujo et al.
2003/0104734 A1 * 6/2003 Polegato Moretti ... A41D 27/28 442/1
2003/0140404 A1 7/2003 Golde
2004/0064870 A1 4/2004 Gold
2004/0237168 A1 * 12/2004 Braun ..... A41D 27/28 2/93
2005/0172378 A1 8/2005 Messiou
2005/0172381 A1 8/2005 Bush et al.
2005/0273903 A1 12/2005 Rudman
2006/0101554 A1 * 5/2006 St-Germain ..... A41D 27/10 2/123
2006/0179539 A1 8/2006 Harber
2006/0277652 A1 12/2006 Okajima
2007/0118960 A1 5/2007 Goodwin
2008/0040832 A1 * 2/2008 Bay ..... A41D 27/28 2/93
2008/0263743 A1 * 10/2008 Maurer ..... A41D 27/24 2/69
2009/0077710 A1 * 3/2009 Bay ..... A41D 3/00 2/87
2009/0144844 A1 6/2009 Duncan

(56) References Cited

U.S. PATENT DOCUMENTS

| | | | | |
|---|---|---|---|---|
| 2010/0043116 | A1* | 2/2010 | Vereen | A41B 1/08 2/81 |
| 2011/0131704 | A1 | 6/2011 | Hughes | |
| 2011/0225699 | A1 | 9/2011 | Elhamsadat et al. | |
| 2011/0239350 | A1 | 10/2011 | Ho et al. | |
| 2011/0265242 | A1 | 11/2011 | Lambertz | |
| 2012/0114883 | A1* | 5/2012 | Kapur | B32B 38/04 428/34.1 |
| 2012/0174291 | A1 | 7/2012 | Fraze | |
| 2012/0210499 | A1* | 8/2012 | Habash | A41D 27/28 2/456 |
| 2012/0233738 | A1 | 9/2012 | Blauer et al. | |
| 2013/0230688 | A1* | 9/2013 | Wu | F16L 59/02 428/116 |
| 2013/0269082 | A1 | 10/2013 | Bramblet | |
| 2014/0007314 | A1 | 1/2014 | Davis et al. | |
| 2014/0059736 | A1 | 3/2014 | Mccuaig | |
| 2014/0090144 | A1 | 4/2014 | Gilreath | |
| 2014/0157482 | A1 | 6/2014 | Blauer et al. | |
| 2014/0189935 | A1 | 7/2014 | Tucker | |
| 2014/0250565 | A1 | 9/2014 | Willows et al. | |
| 2014/0259268 | A1 | 9/2014 | Fier | |
| 2014/0259276 | A1 | 9/2014 | Fier | |
| 2014/0373248 | A1 | 12/2014 | Demarest et al. | |
| 2015/0033451 | A1 | 2/2015 | Bradshaw | |
| 2015/0351458 | A1 | 12/2015 | Fisher et al. | |

FOREIGN PATENT DOCUMENTS

| | | | |
|---|---|---|---|
| FR | 2820000 | A | 8/2002 |
| JP | S61199517 | U | 12/1986 |
| JP | H02131515 | U | 11/1990 |
| JP | 2011117121 | A | 6/2011 |
| JP | 2012255242 | A | 12/2012 |
| JP | 2013122095 | A | 6/2013 |
| WO | 2005112677 | A2 | 12/2005 |
| WO | 2012085454 | A1 | 6/2012 |
| WO | 2013171477 | A1 | 11/2013 |
| WO | 2015034722 | A1 | 3/2015 |

OTHER PUBLICATIONS

International Preliminary Report on Patentability dated Aug. 31, 2017 in International Patent Application No. PCT/US2016/018493, 8 pages.

Notice of Allowance dated Mar. 7, 2018 in U.S. Appl. No. 15/231,206, 5 pages.

Non-Final Office Action dated Apr. 19, 2018 in U.S. Appl. No. 15/231,010, 17 pages.

Non-Final Office Action dated Apr. 20, 2018 in U.S. Appl. No. 15/045,370, 6 pages.

International Search Report and Written Opinion dated Nov. 16, 2016 in International Patent Application No. PCT/US2016/55100, 14 pages.

International Preliminary Report on Patentability dated Sep. 29, 2017 in International Patent Application No. PCT/US2016/55100, 19 pages.

"Men's Quantum Short-Sleeve T-Shirt," Eddie Bauer, eddiebauer.com, Accessed: Jul. 2015. http://www.eddiebauer.com/product/quantum-short-sleeve-t-shirt/12950204/_/A-ebSku_0290805100000060_12950204_catalog10002_en US?showProducts=111&backToCat=&previousPage=SRC&tab=&color=511.

"X-Bionic: Patriot Energy Accumulator Ski Shirt," Luisaviaroma, luisaviaroma.com, Accessed: Jul. 2015. http://www.luisaviaroma.com/index.aspx?#ItemSrv.ashx|SeasonId=60I&CollectionId=DM1&ItemId=1&VendorColorId=VDAxOA2&SeasonMemoCode=actual&GenderMemoCode=men&Language=&CountryId=&SubLineMemoCode=clothing&CategoryId=0&ItemResponse=&MenuResponse=&SizeChart=false&ItemTag=true&NoContext=false.

"C8 Jersey Specifications," Dye, creativesrg.com, Accessed: Jul. 2015. http://www.creativesrg.com/demos/dye/C8Jerseys/specs.html.

"Fuse Jersey," Bellwether Cyclewear®, bellwetherclothing.com, Accessed: Jul. 2015. http://www.bellwetherclothing.com/mens/jerseysandtops/fuse/.

"What I'm Riding: Rapha Winter Jersey," Cycle Boredom, cycleboredom.com, Apr. 26, 2012. http://www.cycleboredom.com/what-im-riding-rapha-winter-jersey/.

"Rondoy Down Jacket: K Series," PHD, phdesigns.co.uk, Accessed: Jul. 2015. http://www.phdesigns.co.uk/rondoy-down-jacket-k-series.

Allen, Dana, "Mountain Equipment Eclipse Hooded Zip Tee," blister, blistergearreview.com, Oct. 4, 2013. http://blistergearreview.com/gear-reviews/mountain-equipment-eclipse-hooded-zip-tee.

"Cyclic Zip Neck Women's," Arc'Teryx, arcteryx, ©2015, accessed: Aug. 2015. http://arcteryx.com/product.aspx?language=EN&gender=womens&category=shirts_and_tops&model=Cyclic-Zip-Neck-W.

JJ, "Ortovox Merino Fleece Hoody," YMMV Reviews, ymmvreviews.com, ©2015, accessed: Aug. 2015. http://ymmvreviews.com/clothing/ortovox-merino-fleece-hoody/.

"Trans4m™ Thermal Plus™ Run Glove," Amphipod, Inc., amphipod.com, ©2015, accessed: Aug. 2015. http://www.amphipod.com/products/trans4m-thermal-plus-run-glove.

Debra, Kitsilano, "Lululemon Pumpkin Orange Long Sleeve Turkey Trot Technical Running Shirt Top 205," goodoldlululemon.wordpress.com, Feb. 8, 2013. https://goodoldlululemon.wordpress.com/2013/02/08/lululemon-pumpkin-orange-long-sleeve-turkey-trot-technical-running-shirt-top-205/.

International Search Report and Written Opinion Dated May 19, 2016 for PCT Application No. PCT/US2016/018493, 11 pages.

Non-Final Office Action dated Aug. 26, 2016 in U.S. Appl. No. 15/045,465, 17 pages.

Notice of Allowance dated Mar. 10, 2017 in U.S. Appl. No. 15/045,465, 15 pages.

International Search Report and Written Opinion dated Aug. 3, 2016 for International Patent Application No. PCT/US2016/018708, 19 pages.

Notice of Allowance dated Aug. 16, 2018 in U.S. Appl. No. 15/231,010, 7 pages.

* cited by examiner

COLD-WEATHER APPAREL ITEM

CROSS-REFERENCE TO RELATED APPLICATIONS

This application Ser. No. 15/047,146 and entitled "Cold-Weather Apparel Item" claims the benefit of priority to U.S. Prov. App. No. 62/118,288, entitled "Adaptive Layer Garment System," filed Feb. 19, 2015; U.S. Prov. App. No. 62/242,760, entitled "Layered Thumbhole Structure," filed Oct. 16, 2015; U.S. Prov. App. No. 62/242,778, entitled "Cold-Weather Apparel Item," filed Oct. 16, 2015; U.S. Prov. App. No. 62/242,781, entitled "Air Duct Ventilation System for Apparel Items," filed Oct. 16, 2015; and U.S. Prov. App. No. 62/242,742, entitled "Hood Cord Lock System," filed Oct. 16, 2015. The entirety of the aforementioned applications is incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects described herein are directed to a cold-weather apparel item, such as a jacket or coat, configured to provide warmth and protection from the elements, reduce distractions associated with the apparel item, and promote breathability. The apparel item as described herein may be especially suitable for wear by athletes that participate in vigorous, outdoor cold-weather activities such as running, skiing, and the like. By providing an apparel item configured to achieve these benefits, the athlete may be better prepared to meet his or her performance goals. For instance, athletes often desire warmth and protection from the elements but produce large amounts of body heat and/or perspiration during athletic activities. The apparel item as described herein helps the athlete to dissipate the heat and/or moisture vapor associated with the perspiration while still providing warmth and adequate protection from the elements. Moreover, for those athletes that engage in focused training, having an apparel item configured to minimize distractions may help the athlete achieve his or her performance goals.

The cold-weather apparel item described herein utilizes a number of different features that work individually and in combination to achieve the benefits described above. For example, the exemplary apparel item described herein utilizes a number of different features to provide warmth and protection from the elements. As a first example, the apparel item described herein may be formed in whole or in part from a composite fabric comprising a knit or woven face fabric configured to be an outer-facing surface of the apparel item, a knit or woven backer fabric configured to be an inner-facing surface of the apparel item, and a nanofiber membrane sandwiched between the face fabric and the backer fabric. The face fabric, in exemplary aspects, may be treated with a durable water repellant (DWR) finish making the face fabric impervious or substantially impervious to water, thereby protecting the wearer from rain and/or snow. The nanofiber membrane may comprise a material that is substantially impervious to liquid water but permits water vapor and/or air to pass through. Use of the membrane further helps to protect the wearer from, for example, rain and/or snow while still providing breathability characteristics to the apparel item.

Another feature that contributes to the apparel item providing warmth and protection from the elements is the use of a close-fitting hood achieved through the use of a moldable bill and ruching or gathered stitching on the back portion of the hood. Providing a close-fitting hood helps to prevent air, rain, and/or snow from entering in the space between the sides of the hood and the wearer's head, this, in turn, helps to keep the wearer warm.

Yet another feature that contributes to the apparel item providing warmth and protection from the elements is a layered thumbhole assembly. At a high level, the layered thumbhole assembly is directed to a sleeve cuff having a thumbhole aperture formed between overlapping panels of material. Use of the overlapping panels helps to block undesirable air flow and/or precipitation from entering into the sleeve of the apparel item when the aperture is not in use. Moreover, use of the overlapping panels helps the layered thumbhole assembly to fit snugly around the wearer's thumb when used. A snug fit also helps to prevent undesirable air flow and/or precipitation from entering into the sleeve.

As mentioned, the exemplary apparel item described herein is further configured to reduce distractions. One way this is accomplished is through the material used to form the apparel item. In an exemplary aspect, the face fabric of the composite fabric described above may comprise a knit fabric. In general, knit fabrics tend to cause less noise upon movement as compared to, for example, woven fabric.

Another way that the apparel item described herein reduces distractions is through the use of a hood lock cord system that is configured to restrict the movement of the hood when the hood is not in use. The hood lock cord system is generally formed from a cord having a first end, a second end, and an intervening portion extending between the two ends. In exemplary aspects, the ends of the cord may be secured adjacent to a neckline of the apparel item. More specifically, the ends of the cord may be generally secured to an outer-facing surface of a back panel of the apparel item adjacent to the neckline of the apparel item such that the intervening portion of the cord extends across a midline of the back panel. When the hood is not being used, the hood may be secured underneath the cord thereby preventing the hood from moving during vigorous activities and distracting the wearer.

The layered thumbhole assembly and the hood as described above further help to reduce distractions associated with the apparel item. For example, the overlapping panels of the layered thumbhole assembly prevent air and/or precipitation from entering the sleeves of the apparel item when not in use and distracting the wearer. Further, the overlapping panels help to ensure a snug fit around the wearer's thumb when used. This further helps to prevent undesirable air flow and/or precipitation from entering the sleeves of the apparel item. In another example, the close-fitting hood due to at least the moldable bill and the ruching on the back portion of the hood further helps to prevent undesirable air flow and/or precipitation from entering the apparel item, which, in turn, helps to minimize distractions associated with the apparel item.

Distractions associated with the apparel item may be further reduced by providing pocket systems designed to secure and store items such as keys, phones, and/or credit cards within pockets of the apparel item. The pocket systems prevent the items from jostling during wearer activities and distracting the wearer.

Continuing, the exemplary apparel item described herein is further configured to provide breathability to the apparel item. For instance, the apparel item may be formed in whole or in part from the composite fabric described above, where the composite fabric comprises a nanofiber membrane that is permeable to air and/or moisture vapor. Thus, excess heat and/or moisture vapor produced by the wearer may be transported away from the wearer's body to the outer-facing surface of the apparel item via the nanofiber membrane where it is dissipated. In another example, a Jacquard knit pattern may be formed on some portions of the apparel item. The Jacquard pattern is knit to have a more open structure as compared to other portions of the apparel item thereby increasing breathability in the areas in which the pattern is located.

Moreover, the exemplary apparel item described herein promotes breathability through use of an integrated duct system that facilitates air exchange between the external environment and the interior of the apparel item. The air exchange helps to transport moisture vapor and/or excess heat produced by the athlete from the interior of the apparel item to outside of the apparel item where it can be dissipated.

In one exemplary aspect, the integrated duct system described herein may be formed by permanently and discontinuously affixing a portion of the panels used to form the apparel item along their edges. For instance, in one exemplary aspect, inflow air ducts may be formed on the front of the apparel item by permanently and discontinuously affixing together one or more front panels of the apparel item, where the inflow air ducts are created in the areas where the panels are discontinuously affixed. In yet another exemplary aspect, inflow air ducts may be formed on the front of the apparel item by forming a re-sealable pocket having a mesh-like lining, where the pocket may function as an inflow air duct when the pocket is in an open position. By having the pocket be re-sealable, the amount of ventilation associated with the apparel item may be adjusted to provide more or less ventilation. Inflow air ducts may be formed in other portions of the apparel item as well using the methods described above. For instance, air ducts may be formed on sleeve portions of the apparel item.

Continuing, one or more outflow air ducts may be formed on the back of the apparel item by discontinuously affixing, for instance, a lower edge of an upper back panel to an upper edge of a lower back panel. Moreover, when the back of the apparel item comprises multiple panels, outflow air ducts may be formed between some or all of the panels. In exemplary aspects, the outflow air duct located on the back of the apparel item is configured to be larger in size than the inflow air ducts located on the front of the apparel item and to have a horizontal orientation such that the outflow air duct extends across a midline of the back of the apparel item.

Further, for at least a portion of the air ducts, in the areas where the panel edges are discontinuously affixed, at least one of the panel edges may be reinforced along its entire length with a rigid or semi-rigid reinforcing strip having a predefined shape such as an arched shape. In exemplary aspects, the strip is affixed to the panel edge that forms the superior or upper margin of the duct. For example, for the outflow air duct located on the back of the apparel item, the strip may be affixed to the lower edge of the upper back panel as this edge forms the superior margin of the outflow air duct. Use of the strip maintains the air ducts in a permanently open position. By maintaining the inflow and/or the outflow air ducts in a permanently open position, an effective air flow pattern can be achieved and maintained despite different orientations and/or movements associated with the wearer of the apparel item.

Breathability of the apparel item may be further augmented by the use of perforated inserts located at the underarm portions of the apparel item. The perforated inserts are configured to allow air from the external environment to enter the apparel item, thereby helping to cool the wearer. In addition, the perforated inserts may also facilitate heated air and/or moisture vapor within the apparel item to exit further contributing to the breathability of the apparel item.

Besides individually contributing to the warmth, protection from the elements, breathability, and minimal-distraction characteristics noted above, the features described herein further work in concert with each other to achieve these effects. For instance, the composite material used to form the apparel item in combination with the layered thumbhole assembly and the close-fitting hood help to ensure that the apparel item protects the wearer from harsh environmental conditions (e.g., wind, rain, and/or snow).

In another example, the close-fitting hood, the layered thumbhole assembly, and the integrated duct system work together to establish an effective air flow pattern that provides breathability to the apparel item. For instance, the close-fitting hood in combination with the layered thumbhole assembly work together to restrict air from flowing into the apparel item at unwanted locations (e.g., the face and neck of the wearer and the wrists and arms of the wearer). Instead, air is directed into the apparel item at the inflow air ducts located, for instance, on the front of the apparel item, and air leaves the apparel item at the outflow air duct located on the back of the apparel item. By having defined ingress and egress points for air to enter and leave the apparel item, an effective air flow pattern may be achieved that circulates air around the high heat-producing areas of the wearer, such as the chest and back regions, where it can cool the wearer, pick up moisture vapor produced by the wearer, and transport the excess heat and/or moisture vapor away from the wearer's body.

In yet another example, the hood, including the hood lock cord system, the integrated duct system, the materials used to form the apparel item, the pocket systems, and the layered thumbhole assembly work together to reduce distractions associated with the apparel item. As previously described, the close-fitting hood and the layered thumbhole assembly are configured to prevent air flow from entering the apparel item at undesirable locations and potentially distracting the wearer. As well, the hood lock cord system prevents the hood from inadvertently moving when not being used which further helps to reduce distractions associated with the apparel item. The pocket systems help to secure loose items such as keys, phones, and/or credit cards within pockets of the apparel item. And the material used to the form the apparel item is configured to be pliable and to exhibit "low-noise" characteristics which again helps to minimize distractions associated with the apparel item especially during wearer movements. Continuing, use of an integrated duct system in which some or all of the air flow ducts are maintained in a permanently open position eliminates the need for the wearer to continually adjust the apparel item during athletic activities to provide more or less ventilation via, for example, zipping and unzipping the apparel item, donning and doffing the hood, donning and doffing the layered thumbhole assembly, and the like. This further helps to reduce wearer distractions.

BRIEF DESCRIPTION OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects described herein are directed to a cold-weather apparel item, such as a jacket or coat, configured to provide warmth and protection from the elements, reduce distractions, and promote breathability. The apparel item as described herein may be especially suitable for wear by athletes that participate in vigorous outdoor activities such as running, skiing, and the like. By providing an apparel item configured to achieve these benefits, the athlete may be better prepared to meet his or her performance goals. For instance, athletes often desire warmth and protection from the elements but produce large amounts of body heat and/or perspiration during athletic activities. The apparel item as described herein helps the athlete to dissipate the heat and/or moisture vapor associated with the perspiration while still providing warmth and adequate protection from the elements. Moreover, for those athletes that engage in focused training, having an apparel item configured to minimize distractions may help the athlete achieve his or her performance goals.

Figure 1:
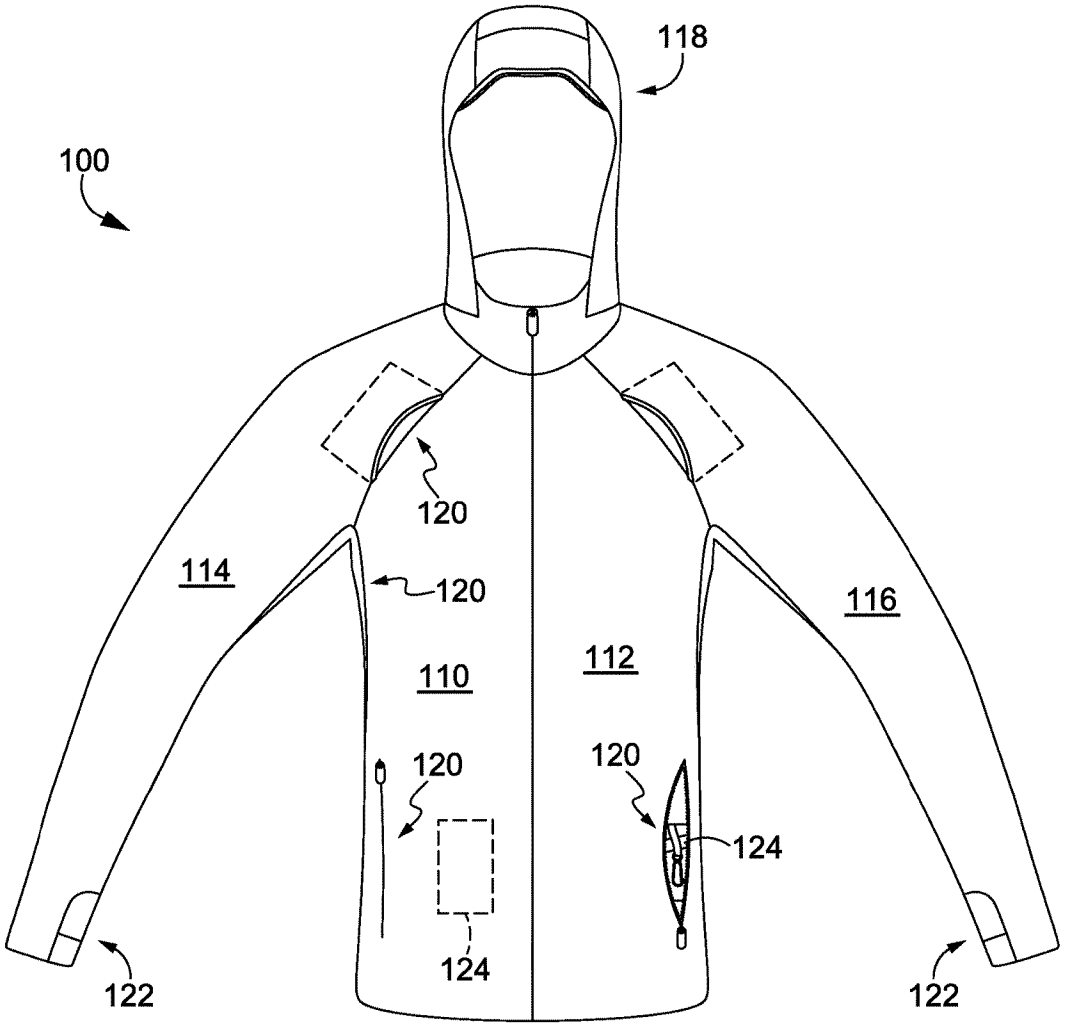
FIG. 1 depicts a front view of an exemplary apparel item in accordance with aspects herein.
Figure 3:
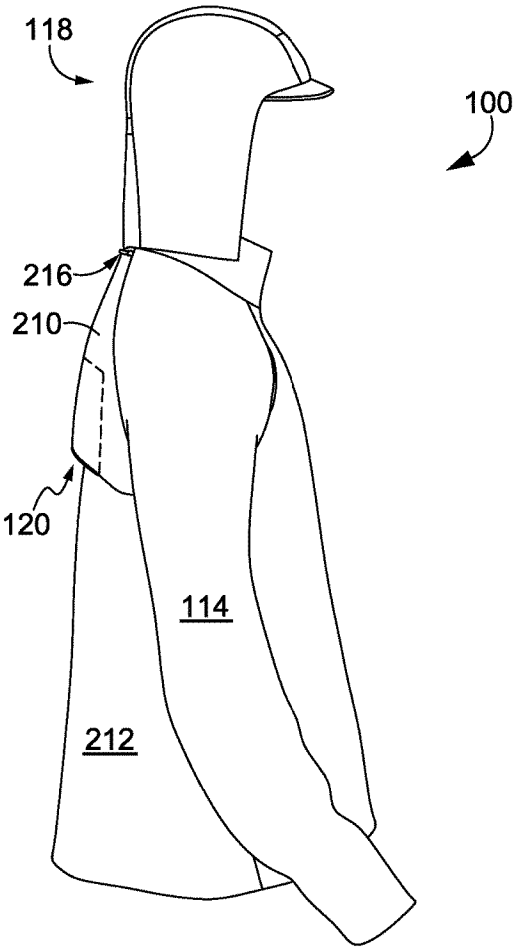
FIG. 3 depicts a right side view of the exemplary apparel item of FIG. 1 in accordance with aspects herein.
Figure 2:
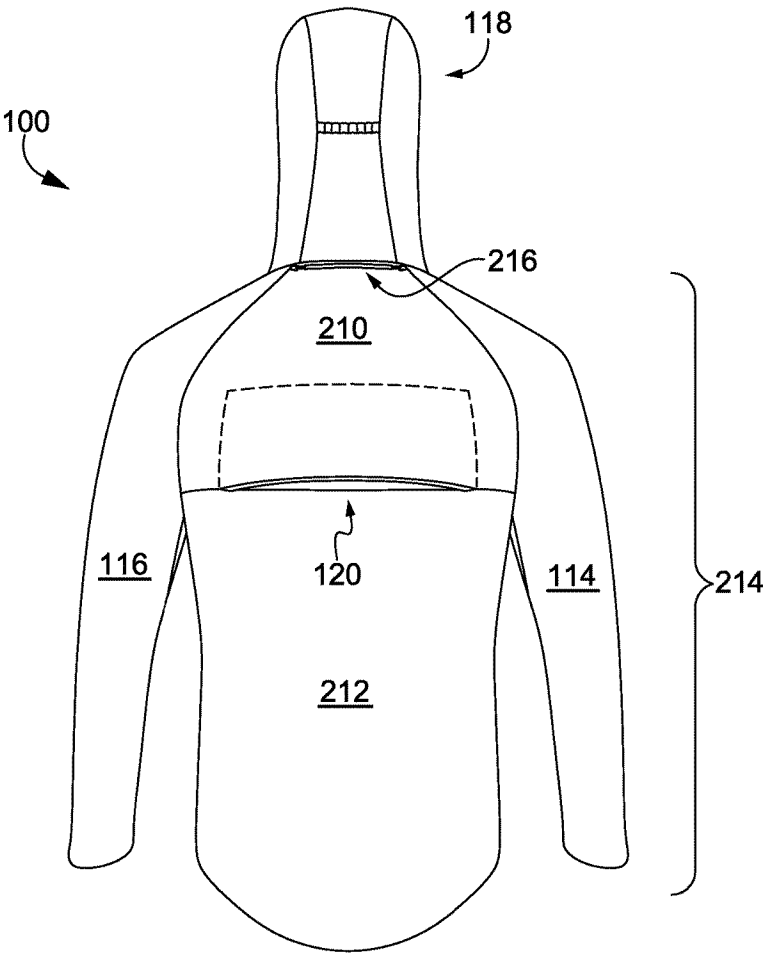
FIG. 2 depicts a back view of the exemplary apparel item of FIG. 1 in accordance with aspects herein.

Turning now to FIGS. 1-3, these figures depict front and back views of an exemplary apparel item 100 configured to provide warmth and protection from the elements, minimize distractions, and promote breathability in accordance with aspects herein. FIGS. 1-3 provide an overview of the apparel item features that contribute to these functional benefits. A more detailed description of each of the features will be provided below.

With respect to FIG. 1, FIG. 1 is a front view of the exemplary apparel item 100 in an un-worn configuration. In general, the apparel item 100 is configured for an upper torso of a wearer when worn. Further, although shown as a jacket, it is contemplated herein that the apparel item 100 may be in the form of a coat, a shirt or top, a pullover, and the like. In exemplary aspects, and as shown in FIG. 1, the apparel item 100 comprises at least a front right panel 110 adapted to cover a right front torso area of a wearer when the apparel item 100 is worn and a front left panel 112 adapted to cover a left front torso area of the wearer when the apparel item 100 is worn. The front right panel 110 and the front left panel 112 may, in exemplary aspects, be releasably secured to one another via, for example, a zipper-type mechanism. Continuing, the apparel item 100 further comprises a right sleeve panel 114 adapted to cover a right arm of the wearer when the apparel item 100 is worn, and a left sleeve panel 116 adapted to cover a left arm of the wearer when the apparel item 100 is worn. Additional front panels and/or sleeve panels besides those shown in FIG. 1 are contemplated herein. The apparel item 100 may further comprise a hood 118 configured to be donned and doffed by a wearer. When worn, the hood 118 is adapted to cover a head portion of the wearer.

As shown in FIGS. 2 and 3, which depict a back view and a right side view respectively of the apparel item 100, the apparel item 100 further comprises an upper back panel 210 and a lower back panel 212 that together form a full back panel 214 for the apparel item 100, where the back panel 214 is adapted to cover a back torso area of the wearer when the apparel item 100 is worn. More specifically, the upper back panel 210 may be configured to cover a shoulder and upper back area of the wearer, and the lower back panel 212 may be configured to cover a lower back area of the wearer when the apparel item 100 is worn.

As shown in FIGS. 1-3, the apparel item 100 comprises an integrated duct system 120 configured to at least promote breathability of the apparel item 100 and to minimize distractions associated with the apparel item 100. As shown and explained more fully below, the integrated duct system 120 may comprise one or more inflow air ducts located on the front of the apparel item 100 and/or on the sleeve portions of the apparel item 100, one or more outflow air ducts located on the back of the apparel item 100, and perforated inserts located at the underarm portions of the apparel item 100. The inflow and outflow air ducts of the integrated duct system 120 may be formed by permanently and discontinuously affixing one or more panel edges together. As well, the inflow air ducts may also comprise one or more re-sealable pockets having perforated or mesh linings. In general, air from the external environment flows into the inflow air ducts, circulates in the space formed between the inner-facing surface of the apparel item 100 and the wearer's body where it can not only cool the wearer but also pick up excess heat and/or moisture vapor produced by the wearer, and exit the apparel item 100 via the outflow air duct(s) located on the back of the apparel item 100.

Continuing, as shown in FIGS. 1-3, the apparel item 100 also comprises a layered thumbhole assembly 122 configured to provide warmth and protection from the elements, to minimize distractions, and to promote breathability. As shown and explained more fully below, the layered thumbhole assembly 122 comprises a thumbhole aperture formed between overlapping panels of material. In one instance, use of the overlapping panels helps to block undesirable air flow from entering into the sleeves of the apparel item 100 when the thumbhole aperture is not in use. Moreover, use of the overlapping panels helps the layered thumbhole assembly 122 to fit snugly around the wearer's thumb when used.

As further shown in FIGS. 1-3, the apparel item 100 comprises the hood 118 as well as a hood lock cord system 216 located on the back of the apparel item 100 adjacent to the neckline of the apparel item 100. The hood 118 is configured at least to provide warmth and protection from the elements, to minimize distractions, and to promote breathability. As shown and explained more fully below, the hood 118 comprises features such as a moldable bill and ruching on the back portion of the hood 118 that help the hood 118 conform closely to the wearer's head when worn. This helps to prevent undesirable air flow from entering the space between the hood side panels and the wearer's head.

As shown and explained more fully below, the hood lock cord system 216 is configured to secure the hood 118 when the hood 118 is not being used and thereby to minimize distractions caused by the hood 118 inadvertently moving during wearer activities. For instance, use of the hood lock cord system 216 prevents the hood 118 from swaying back-and-forth and/or bumping against the back of the wearer when the wearer is participating in outdoor activities.

As shown in FIG. 1, the apparel item 100 further comprises a pocket system 124. In one aspect, the pocket system 124 comprises at least a key lock and a layered pocket insert configured to store, for example, credit cards, keys, and/or phones. The key lock and the layered pocket insert may be located in one of the re-sealable pockets that form, in part, the integrated duct system 120. The pocket system 124 may also comprise a pocket located on an inner-facing surface of the apparel item 100 (indicated by the dashed line), where the pocket is sized to hold a mobile phone. Use of the pocket system 124 helps to secure items during wearer activities and reduces distractions typically associated with these items when stored unsecured in a pocket.

As shown and explained more fully below, the apparel item 100 may be formed in whole or in part from a composite fabric that is configured to provide warmth and protection from the elements, promote breathability, and to minimize distractions. For instance, the composite fabric may comprise an outer-facing face fabric treated with a DWR finish making the composite fabric substantially impervious to water. As well, the composite fabric may comprise a nanofiber membrane sandwiched between the outer-facing face fabric and an inner-facing backer fabric, where the nanofiber membrane is configured to be generally permeable to air and/or moisture vapor but substantially impervious to water. Thus, the nanofiber membrane may provide protection from the elements and promote breathability by enabling excess heat and/or moisture vapor produced by the wearer to escape the apparel item 100 but prevent precipitation from contacting the wearer's skin. Moreover, in exemplary aspects, the outer-facing face fabric may comprise a knit fabric structure that generates minimal noise during wearer activities.

Further, portions of the apparel item 100 may be formed of a knit panel having a Jacquard knit pattern. The pattern is knitted such that the panel has a more open knit structure as compared to other portions of the apparel item. The open knit structure may provide more breathability to the apparel item 100 in the areas where the pattern is located.

The apparel item features noted above such as the integrated duct system 120, the hood 118, the layered thumbhole assembly 122, the composite fabric, the knit pattern, the hood lock cord system 216, and the pocket systems 124 will now be described in greater depth.

Integrated Duct System

Figure 4A:
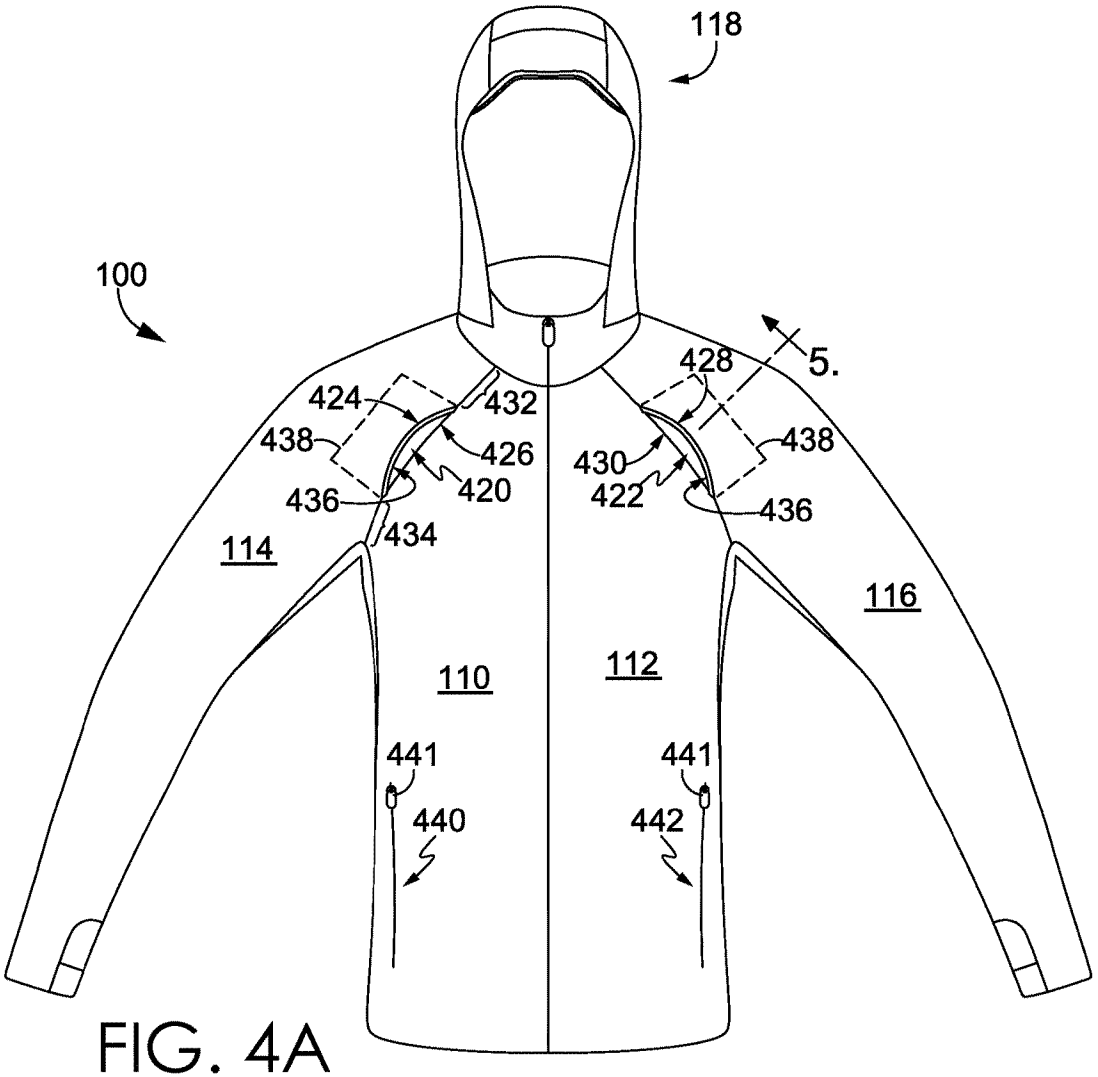
FIGS. 4A-4B depict front views of an exemplary integrated duct system for the apparel item described herein in accordance with aspects herein.
Figure 4B:
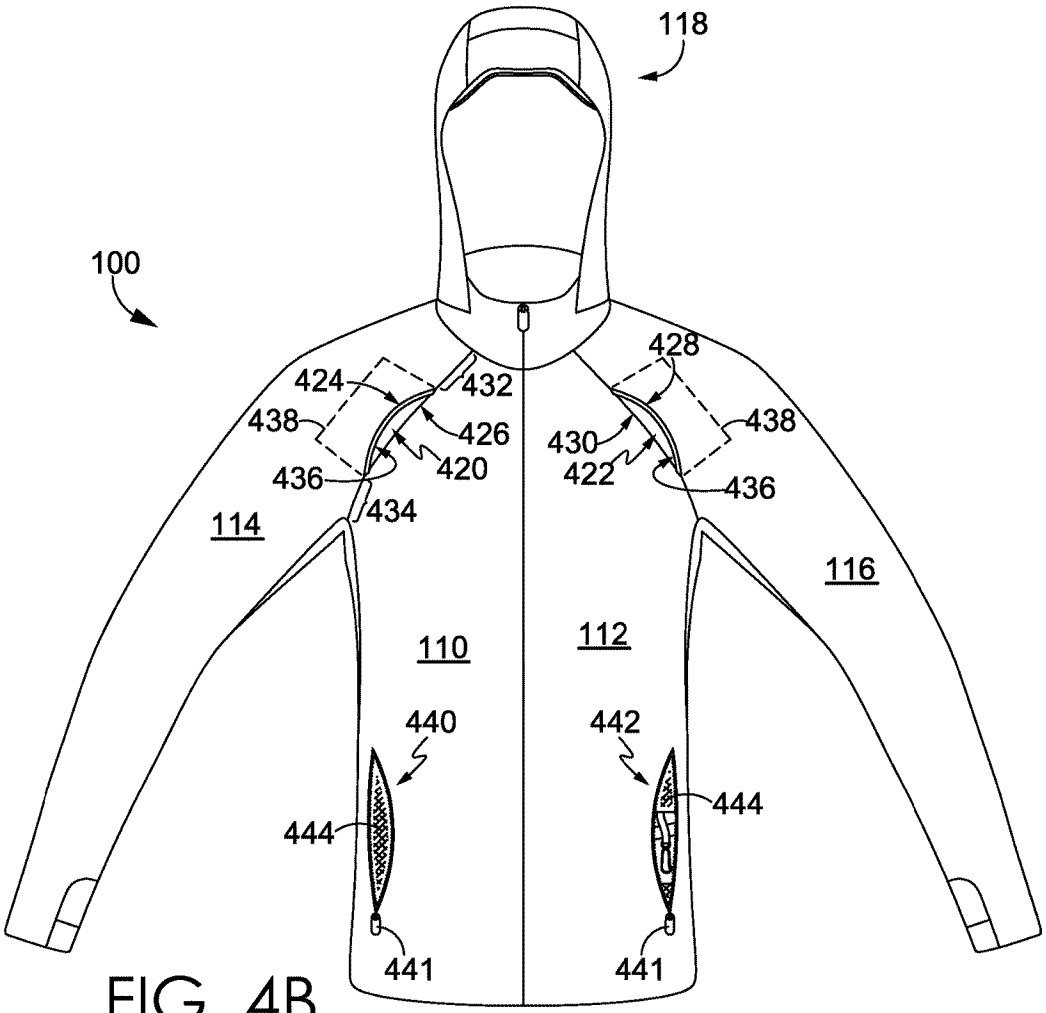

Turning now to FIGS. 4A-4B, these figures depict a front view the exemplary apparel item 100 in accordance with aspects herein. In one exemplary aspect, the apparel item 100 may comprise at least two inflow air ducts, a first inflow air duct 420 and a second inflow air duct 422. The first inflow air duct 420 may be formed by permanently and discontinuously affixing a front edge 424 of the right sleeve panel 114 to an upper edge 426 of the front right panel 110, and the second inflow air duct 422 may be formed by permanently and discontinuously affixing a front edge 428 of the left sleeve panel 116 to an upper edge 430 of the front left panel 112.

As used throughout this disclosure, the terms "permanently" and "affixing" are generally meant to encompass affixing technologies known in the art such as stitching, bonding, welding, using adhesives, and the like that may be used to permanently or non-removably attach materials together. Further, the term "discontinuously affixing" as used throughout this disclosure means that a first panel edge may be joined to a second panel edge at discrete portions, but maintained separate from each other at other segments between the joined portions in order to form a duct or opening between the panel edges. This is in contrast to a typical seam in which two panel edges are continuously joined by sewing or other bonding techniques along the length of the seam so that there are no lapses, voids, or spaces.

Thus, with respect to FIG. 4A, the front edge 424 of the right sleeve panel 114 is permanently joined to the upper edge 426 of the front right panel 110 at the areas indicated by reference numerals 432 and 434 but is maintained separate from the upper edge 426 at the first inflow air duct 420. The same configuration would hold true for the left sleeve panel 116 and the front left panel 112.

In exemplary aspects, each of the first inflow air duct 420 and the second inflow air duct 422 may have an opening length between 5 cm and 20 cm, 7 cm and 15 cm, and/or between 10 cm and 13 cm, although lengths above and below these ranges are contemplated herein. Further, the first inflow air duct 420 may be skewed in a positive direction from a vertical axis bisecting the first inflow air duct 420, and the second inflow air duct 422 may be skewed in a negative direction from a vertical axis bisecting the second inflow air duct 422. For example, the first inflow air duct 420 may be skewed in the range of +10 degrees, +20, degrees, +30 degrees, +40 degrees, +50 degrees, and/or +60 degrees, and/or any value in between, although degrees of skewing above and below these values are contemplated herein. Similarly, the second inflow air duct 422 may be skewed in the range of −10 degrees, −20, degrees, −30 degrees, −40 degrees, −50 degrees, and/or −60 degrees, and/or any value in between, although degrees of skewing above and below these values are contemplated herein. The depiction of the orientation of the first and second inflow air ducts 420 and 422 is exemplary only, and it is contemplated that other orientations are within the scope contemplated herein.

Figure 5:
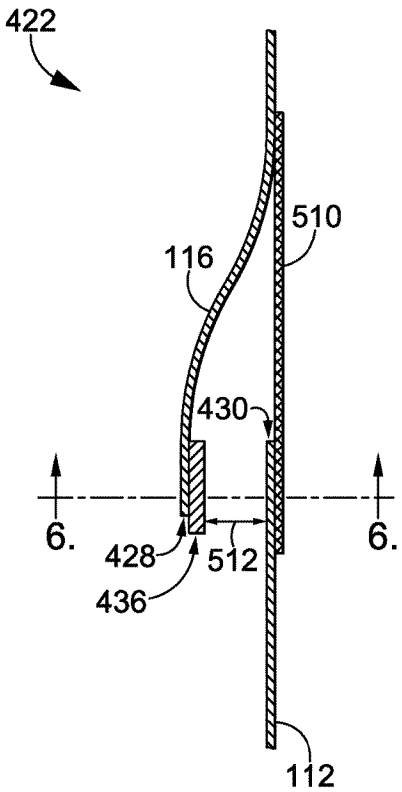
FIG. 5 depicts a cross-sectional view taken along cut line 5 of FIG. 4A illustrating an inflow air duct of the integrated duct system in accordance with aspects herein.

As will be shown and discussed in more detail with respect to FIG. 5, in an optional aspect, the front edge 424 of the right sleeve panel 114 and the front edge 428 of the left sleeve panel 116 may be reinforced with a rigid or semi-rigid reinforcement strip 436 in the areas where the front edges 424 and 428 are not joined to the upper edges 426 and 430 of the front right panel 110 and the front left panel 112 respectively (i.e., at the first inflow air duct 420 and at the second inflow air duct 422). As mentioned, use of the reinforcement strip 436 is optional, and it is contemplated herein that the first and second inflow air ducts 420 and 422 may be formed without use of the reinforcement strip 436. Any and all aspects, and any variation thereof, are contemplated as being within the scope herein.

Figure 14A:
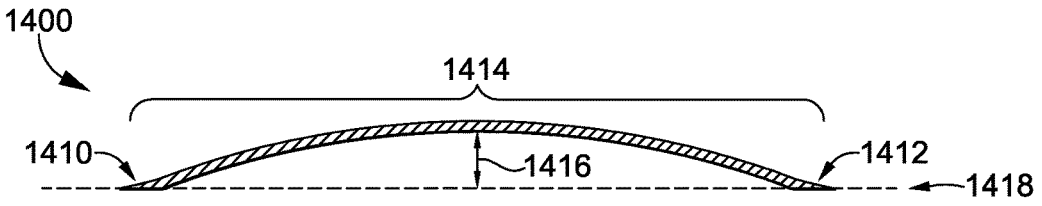
FIGS. 14A-14C depict face views of exemplary reinforcement strips used to reinforce a panel edge of an inflow or outflow air duct of the exemplary integrated duct system in accordance with aspects herein.
Figure 14B:
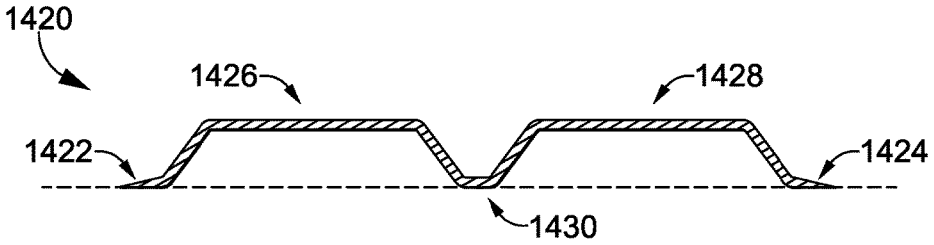
Figure 14C:
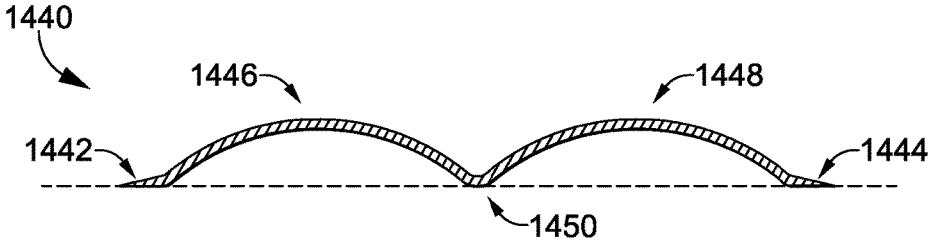

FIGS. 14A-14C depict face views of exemplary reinforcement strips in accordance with aspects herein. The reinforcement strips shown in FIGS. 14A-14C may optionally be used in association with, for example, the first and second inflow air ducts 420 and 422, other inflow air ducts as described herein, and/or outflow air duct(s) located on the back of the apparel item 100 as will be discussed below. In exemplary aspects, the reinforcement strips depicted in FIGS. 14A-14C may be formed of a nylon material, a polyurethane material, and/or a thermoplastic polyurethane material that has a degree of rigidity or stiffness that enables the strips to maintain a defined shape in their resting state. However, it is contemplated herein, that the reinforcement strips depicted in FIGS. 14A-14C may also exhibit some degree of flexibility such that they deform upon application of an external force exceeding a predetermined minimum threshold. Other materials are contemplated herein for forming the reinforcement strips shown in FIGS. 14A-14C such as, for example, plastic materials, rubber materials, stiff fabrics, metal materials, and the like. Moreover, it is contemplated herein that the reinforcement strips shown in FIGS. 14A-14C may comprise any number of different colors. Any and all aspects, and any variation thereof, are contemplated as being within the scope herein.

With respect to FIG. 14A, in exemplary aspects, the reinforcement strip 1400 is pre-formed into an arched shape having a first end 1410, a second end 1412, and an intervening portion 1414 extending between the first end 1410 and the second end 1412. Because of its arched shape, the first and second ends 1410 and 1412 are configured to be flush with, for example, a surface 1418 (indicated by the dashed line in FIG. 14A) such as an outer-facing surface of an apparel item (e.g., the apparel item 100), and the intervening portion 1414 is configured to extend away from the surface 1418. In exemplary aspects, a midpoint of the strip 1400 is configured to extend a predetermined distance 1416 away from the surface 1418. The predetermined distance 1416 may vary depending on whether the reinforcement strip 1400 is being used in association with an inflow air duct such as the first and second inflow air ducts 420 and 422 or an outflow air duct as will be explained in greater depth below.

In exemplary aspects, the intervening portion 1414 of the reinforcement strip 1400 may have a thickness in the range of 2 mm to 5 mm, and/or between 3 mm to 4 mm although thicknesses above and below these ranges are contemplated herein. Further, in exemplary aspects, the first and second ends 1410 and 1412 may be formed to taper or have a reduced thickness as compared to remaining portions of the strip 1400. The reduced thickness may be useful in enabling the ends 1410 and 1412 to lie flush with the surface 1418. In exemplary aspects, the reinforcement strip 1400 may have a width between 0.3 cm and 1.5 cm, 0.6 cm and 1.2 cm, and/or between 0.8 cm and 1.1 cm, although widths above and below these ranges are contemplated herein.

FIG. 14B depicts an alternative shape configuration for a reinforcement strip 1420. The reinforcement strip 1420 comprises a first end 1422 and a second end 1424. Instead of having an arched shape like the reinforcement strip 1400, the reinforcement strip 1420 comprises more of a half-square or half-rectangle shape with two plateau areas 1426 and 1428 separated by a trough region 1430. The plateau areas 1426 and 1428 may extend a predetermined distance away from a surface similar to the reinforcement strip 1400, while, in exemplary aspects, the trough region 1430 may touch or be adjacent to the surface. Although depicted as having two plateau areas, it is contemplated herein that the reinforcement strip 1420 may comprise multiple plateau areas separated by trough regions. Any and all aspects, and any variation thereof, are contemplated as being within the scope herein.

FIG. 14C depicts yet another alternative shape configuration for a reinforcement strip 1440. The reinforcement strip 1440 comprises a first end 1442 and a second end 1444. In this exemplary aspect, the reinforcement strip 1440 comprises two curved peaks 1446 and 1448 separated by a trough region 1450. The peaks 1446 and 1448 may extend a predetermined distance away from a surface similar to the reinforcement strip 1400, while the trough region 1450 may touch or be adjacent to the surface. Moreover, although depicted as having two peaks, it is contemplated herein that the reinforcement strip 1440 may comprise multiple peaks separated by trough regions. Any and all aspects, and any variation thereof, are contemplated as being within the scope herein. Besides the shape configurations shown in FIGS. 14A-14C, other shape configurations for the reinforcement strip are contemplated herein such as half-circle shapes, half-diamond shapes, and the like.

Returning now to FIG. 4A, because of the arched shape of the reinforcement strip 436, the midpoint of the first and second inflow air ducts 420 and 422 may extend a distance away from the outer-facing surface of the apparel item 100. In exemplary aspects, the midpoint of the first and second inflow air ducts 420 and 422 may extend away from the fabric surface of the apparel item 100 in the range of 0.5 cm to 2.5 cm, 1.0 cm to 2.0 cm, and/or between 1.3 cm to 1.8 cm, although values above and below these ranges are contemplated herein.

A cross-sectional view of the second inflow air duct 422 taken along cut line 5 is shown in FIG. 5 in accordance with aspects herein. The first inflow air duct 420 would have a similar cross-sectional view and the discussion of FIG. 5 is equally applicable to the first inflow air duct 420. As shown, the reinforcement strip 436 is affixed to the front edge 428 of the left sleeve panel 116. In exemplary aspects, the reinforcement strip 436 may be affixed via stitching, bonding, adhesives, welding, and the like. As shown in FIG. 5, the edge of the reinforcement strip 436 may extend beyond the front edge 428 such that it is visible when viewing the apparel item 100 from the front as seen in FIGS. 4A-4B. In other exemplary aspects, the edge of the reinforcement strip 436 may generally lie flush with the front edge 428. Or the front edge 428 of the left sleeve panel 116 may extend beyond the edge of the reinforcement strip 436 and may wrap around the edge of the reinforcement strip 436. With respect to this exemplary aspect, the reinforcement strip 436 may not be visible when viewing the apparel item 100 from the front. Any and all aspects, and any variation thereof, are contemplated as being within the scope herein.

Because the cross-section shown in FIG. 5 is taken at the approximate midpoint of the strip 436, the front edge 428 of the left sleeve panel 116 is offset or extends away from the front left panel 112 by a distance 512. As explained above, the distance 512 may be in the range of 0.5 cm to 2.5 cm, 1.0 cm to 2.0 cm, and/or between 1.3 cm to 1.8 cm, although values above and below these ranges are contemplated herein.

In an exemplary aspect, a perforated backing 510 may be affixed to front left panel 112 and the left sleeve panel 116 in the area of the second inflow air duct 422. This is indicated by the dashed line 438 in FIG. 4. The perforated backing 510 is configured to have sufficient permeability to enable air entering the second inflow air duct 422 to flow into the interior of the apparel item 100 but also is useful in preventing particles or debris from the external environment from entering. In exemplary aspects, the perforated backing 510 may comprise a mesh material, a perforated fabric, and the like.

Figure 6A:
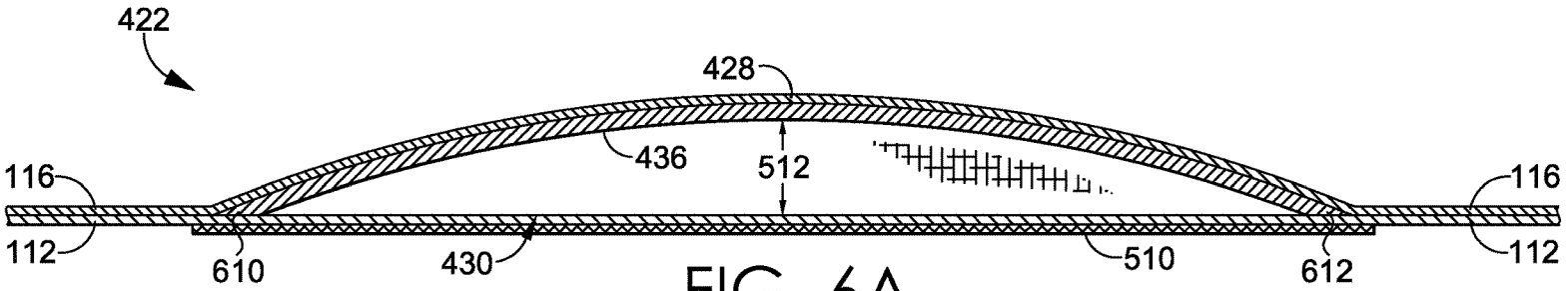
FIG. 6A depicts a face view of an exemplary air duct in accordance with aspects herein.
Figure 6B:
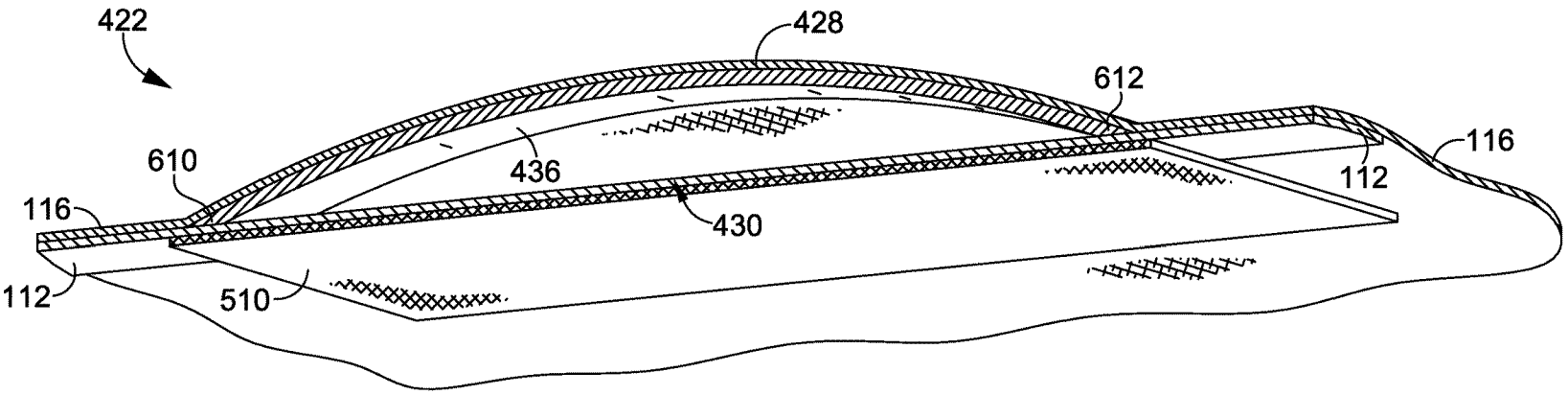
FIG. 6B depicts a perspective view of the exemplary air duct of FIG. 6A in accordance with aspects herein.

FIGS. 6A and 6B depict another view of the second inflow air duct 422 taken along cut line 6-6 of FIG. 5 in accordance with aspects herein. FIG. 6A is a face view while FIG. 6B is a perspective view. The discussion of FIGS. 6A and 6B would be equally applicable to the first inflow air duct 420 or other inflow air ducts described herein. As shown in FIGS. 6A and 6B, the second inflow air duct 422 has an arched shaped due to the configuration of the reinforcement strip 436 affixed along the length of the front edge 428 of the left sleeve panel 116 causing the approximate midpoint of the front edge 428 to extend away from the front left panel 112 by the distance 512. The first and second ends 610 and 612 of the strip 436 are shown as being tapered similar to the tapering of the ends 1410 and 1412 in FIG. 14A. In exemplary aspects, the first and second ends 610 and 612 of the reinforcement strip 436 may be affixed to both the front edge 428 of the left sleeve panel 116 and the upper edge 430 of the front left panel 112. This may help to further secure the reinforcement strip 436 to the apparel item 100. Moreover, the tapering of the first and second ends 610 and 612 may help to create a smoother transition between the strip 436 and the panels 116 and 112.

As shown in FIG. 6A, the perforated backing 510 is affixed to an inner-facing surface of the front left panel 112. And as shown in FIG. 5 and in FIG. 6B, the perforated backing 510 is also affixed to an inner-facing surface of the left sleeve panel 116. The perforated backing 510 has a generally rectangular shape such that it forms the floor of the second inflow air duct 422 as shown in FIG. 6B, although other shape configurations are contemplated herein. A similar configuration would hold true for the first inflow air duct 420.

Figure 7B:
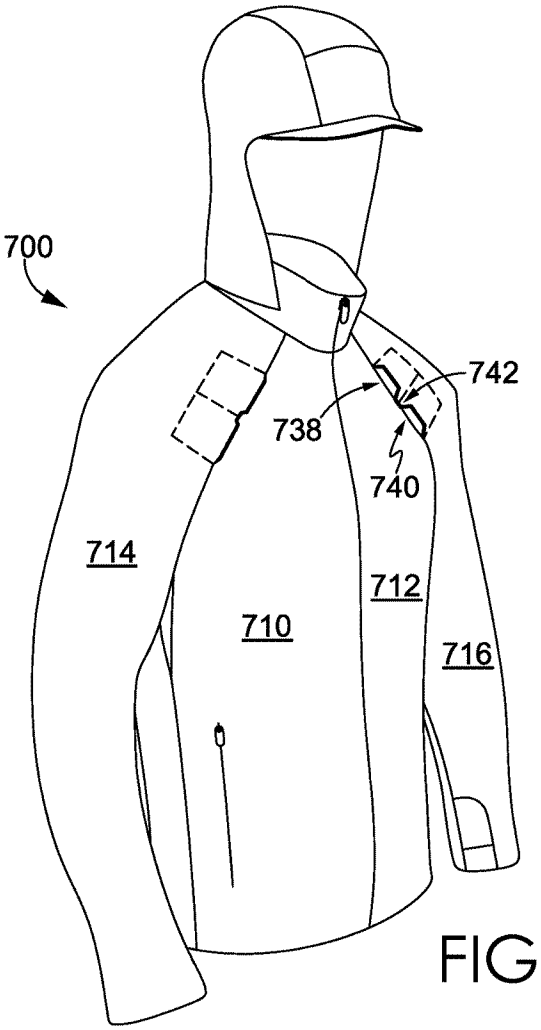
FIG. 7A-7B depict front perspective views of the exemplary apparel item illustrating alternative configurations for the inflow air ducts in accordance with aspects herein.
Figure 7A:
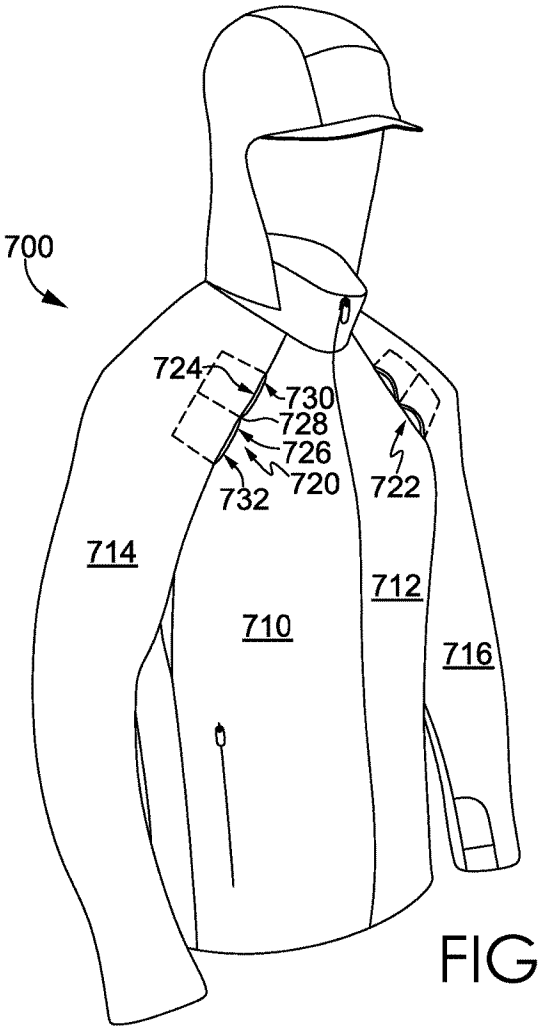

Turning now to FIG. 7A, FIG. 7 depicts a first alternative configuration for the inflow air ducts 420 and 422 in accordance with aspects herein. FIG. 7A depicts a front perspective view of an apparel item 700 having a front right panel 710, a front left panel 712, a right sleeve panel 714, and a left sleeve panel 716. The apparel item 700 further comprises a first inflow air duct 720 and a second inflow air duct 722. Similar to the first and second inflow air ducts 420 and 422, the first inflow air duct 720, in exemplary aspects, is formed by permanently and discontinuously affixing a front edge 724 of the right sleeve panel 714 to an upper edge 726 of the front right panel 710. As shown in FIG. 7A, instead of a single opening being formed as with the first inflow air duct 420 of the apparel item 100, the first inflow air duct 720 comprises two separate air ducts 730 and 732 separated by an affixed area as indicated by the reference numeral 728. The affixed area 728 may represent an area where the front edge 724 of the right sleeve panel 714 is affixed to the upper edge 726 of the front right panel 710. A similar configuration is shown for the second inflow air duct 722. Thus, a single inflow air duct may be sub-divided into one or more additional "sub-air ducts" such as the air duct 730 and the air duct 732, by affixing the panels together at one or more points along the opening of the inflow air duct. In exemplary aspects, each of the sub-air ducts 730 and 732 may optionally comprise a reinforcement strip such as the reinforcement strip 1400 of FIG. 14A. The configuration described for FIG. 7A may also be applicable for other inflow air ducts as described herein.

FIG. 7B depicts how the configuration of the reinforcement strip may be used to create sub-air ducts. For instance, use of a reinforcement strip having a shape configuration similar to that shown in FIG. 14B creates a first sub-air duct 738 (corresponding to the first plateau 1426 in FIG. 14B) and a second sub-air duct 740 (corresponding to the second plateau 1428 in FIG. 14B) separated by a trough region 742 (corresponding to the trough region 1430 in FIG. 14B). In exemplary aspects, the trough region 742 may remain unaffixed from the upper edge of the front right panel 710. In other exemplary aspects, the trough region 742 may be affixed to the upper edge of the front right panel 710. A similar configuration having curved peaks instead of plateaus could be created by use of a reinforcement strip having the shape configuration shown in FIG. 14C. Any and all aspects, and any variation thereof, are contemplated as being within the scope herein.

Returning now to FIGS. 4A and 4B, the integrated duct system 120 of the exemplary apparel item 100 described herein may also comprise re-sealable pockets 440 and 442 formed by, for instance, incising the front right panel 110 and the front left panel 112 respectively and affixing a releasable closure mechanism 441 to the incised opening. The releasable closure mechanism 441 may comprise, for instance, a zipper, hook-and-loop fasteners, buttons, snaps, a releasable adhesive, and the like. The pockets 440 and 442 may, in exemplary aspects, be lined with a perforated liner 444 (i.e., a mesh material or a perforated fabric) such that when the pockets 440 and 442 are in an open state, as shown in FIG. 4B, the perforated liner 444 is visible and in communication with the external environment. The perforated liner 444 is configured so that the openings/perforations of the liner 444 are freely permeable to air and/or moisture vapor but prevent particulate matter from entering the apparel item 100. Thus, when the re-sealable pockets 440 and 442 are in an open state, a communication path is established between the exterior of the apparel item 100 and the interior of the apparel item 100 allowing excess heat and/or moisture vapor to leave the apparel item 100 and/or allowing air from the external environment to enter the apparel item 100 and potentially cool the wearer. Moreover, by using a releasable closure mechanism, such as the releasable closure mechanism 441, the re-sealable pockets 440 and 442 may be opened and/or closed to variable degrees to provide more or less ventilation.

Figure 8:
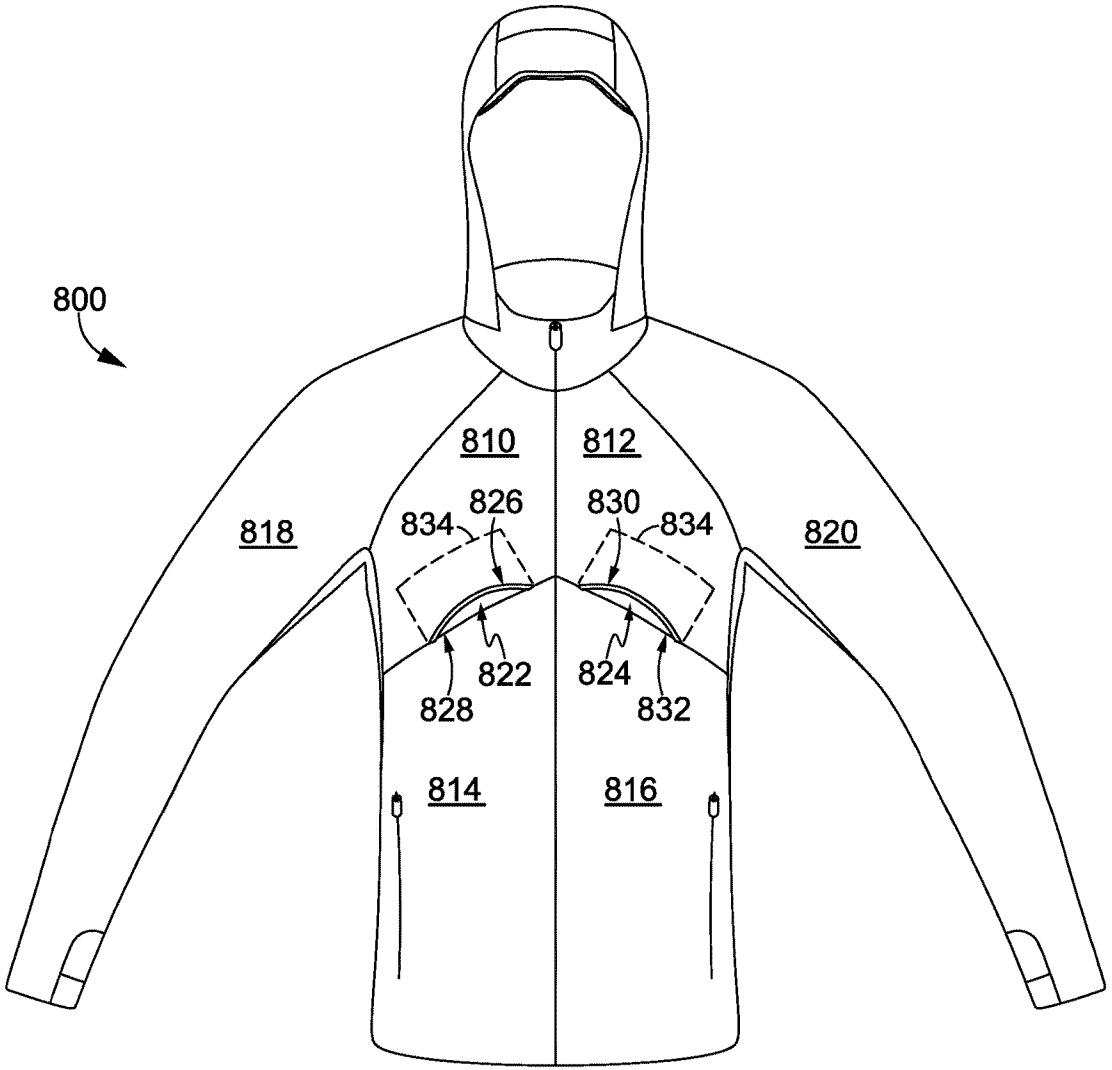
FIG. 8 depicts a front view of an alternative location for an inflow air duct system for the exemplary apparel item described herein in accordance with aspects herein.

FIG. 8 depicts an alternative location for inflow air ducts for exemplary apparel items in accordance with aspects herein. With respect to FIG. 8, a front view of an exemplary apparel item 800 is shown having an upper right front panel 810, an upper left front panel 812, a lower right front panel 814, a lower left front panel 816, a right sleeve panel 818, and a left sleeve panel 820.

In exemplary aspects, a lower edge 826 of the upper right front panel 810 may be permanently and discontinuously affixed to an upper edge 828 of the lower right front panel 814 to form a first inflow air duct 822. Similarly, a lower edge 830 of the upper left front panel 812 may be permanently and discontinuously affixed to an upper edge 832 of the lower left front panel 816 to form a second inflow air duct 824.

As shown in FIG. 8, the first and second inflow air ducts 822 and 824 may be skewed from a vertical axis. For instance, in exemplary aspects, the first inflow air duct 822 may be skewed in a positive direction from a vertical axis bisecting the first inflow air duct 822 by, for example, +40 degrees, +50 degrees, +60 degrees, +70 degrees, and/or +80 degrees, although values above and below these are contemplated herein. For example, the upper right front panel 810 and the lower right front panel 814 may be configured such that the first inflow air duct 822 may be substantially horizontal. With respect to the second inflow air duct 824, the second inflow air duct 824 may be skewed in a negative direction from a vertical axis bisecting the second inflow air duct 824 by, for example, −40 degrees, −50 degrees, −60 degrees, −70 degrees, and/or −80 degrees, although values above and below these are contemplated herein. For example, the upper left front panel 812 and the lower left front panel 816 may be configured such that the second inflow air duct 824 may be substantially horizontal. The opening length of the first and second inflow air ducts 822 and 824 may be similar to the dimensions provided for the first and second inflow air ducts 420 and 422 of the apparel item 100.

In exemplary aspects, each of the first and second inflow air ducts 822 and 824 may have a reinforcement strip, such as the reinforcement strip 436 of FIG. 4, or the reinforcement strips depicted in FIGS. 14A-14C, affixed to its superior margin. For instance, a reinforcement strip may optionally be affixed to the lower edge 826 of the upper right front panel 810 and to the lower edge 830 of the upper left front panel 812 as shown in FIG. 8. As described above, the reinforcement strip may be useful for maintaining the first and second inflow air ducts 822 and 824 in a permanently open position. Moreover, each of the first and second inflow air ducts 822 and 824 may further comprise a perforated backing, as indicated by the reference numeral 834, similar to the perforated backing 510 shown in, for example, FIG. 5.

Besides the front panels 810, 812, 814, and 816 shown in FIG. 8, it is contemplated herein that the apparel item 800 may comprise additional front panels. Moreover, it is contemplated herein that multiple inflow air ducts may be formed between the edges of one or more of the front panels. For instance, an upper set of inflow air ducts may be formed between the front edges of the rights and left sleeve panels 818 and 820 and the upper edges of the upper right front panel 810 and the upper left front panel 812 respectively, and a lower set of inflow air ducts may be formed corresponding to the first and second inflow air ducts 822 and 824. Moreover, the first and second inflow air ducts 822 and 824 may have alternative shape configurations such as those depicted in FIGS. 7A and 7B. Any and all aspects, and any variation thereof, are contemplated as being within the scope herein.

Further, although not shown, it is contemplated herein, that inflow air ducts may be formed on the sleeve panels of the exemplary apparel item 100. For example, the sleeve panels 114 and 116 may comprise multiple panels (e.g., and upper sleeve panel and a lower sleeve panel), and inflow air ducts may be formed by permanently and discontinuously affixing a lower edge of the upper sleeve panel to an upper edge of the lower sleeve panel. Moreover, a reinforcement strip may optionally be used in association with the sleeve inflow air ducts as described herein.

Figure 9A:
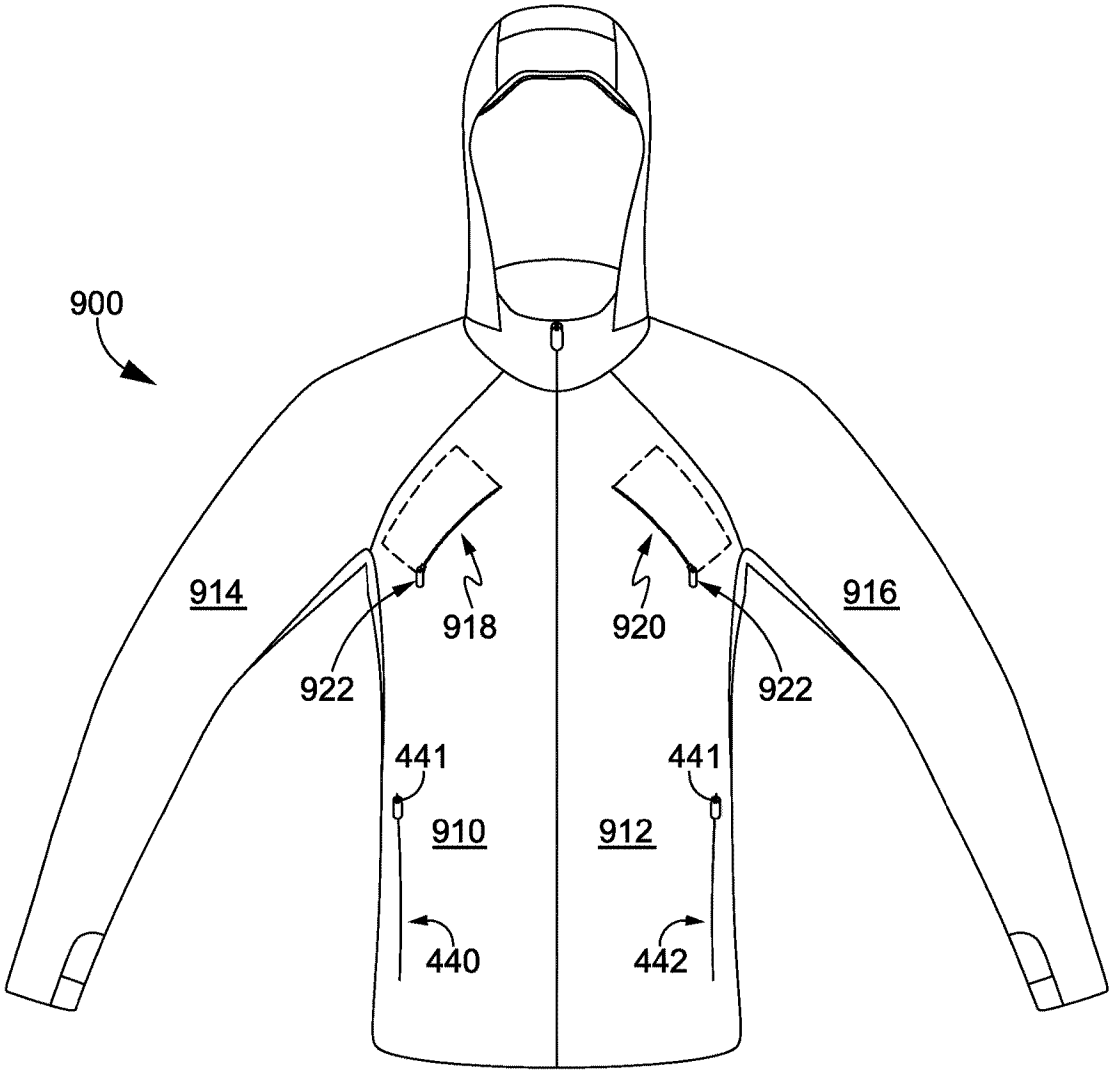
FIGS. 9A and 9B depict a front view of an alternative configuration for an inflow air duct system for the exemplary apparel item described herein in accordance with aspects herein.
Figure 9B:
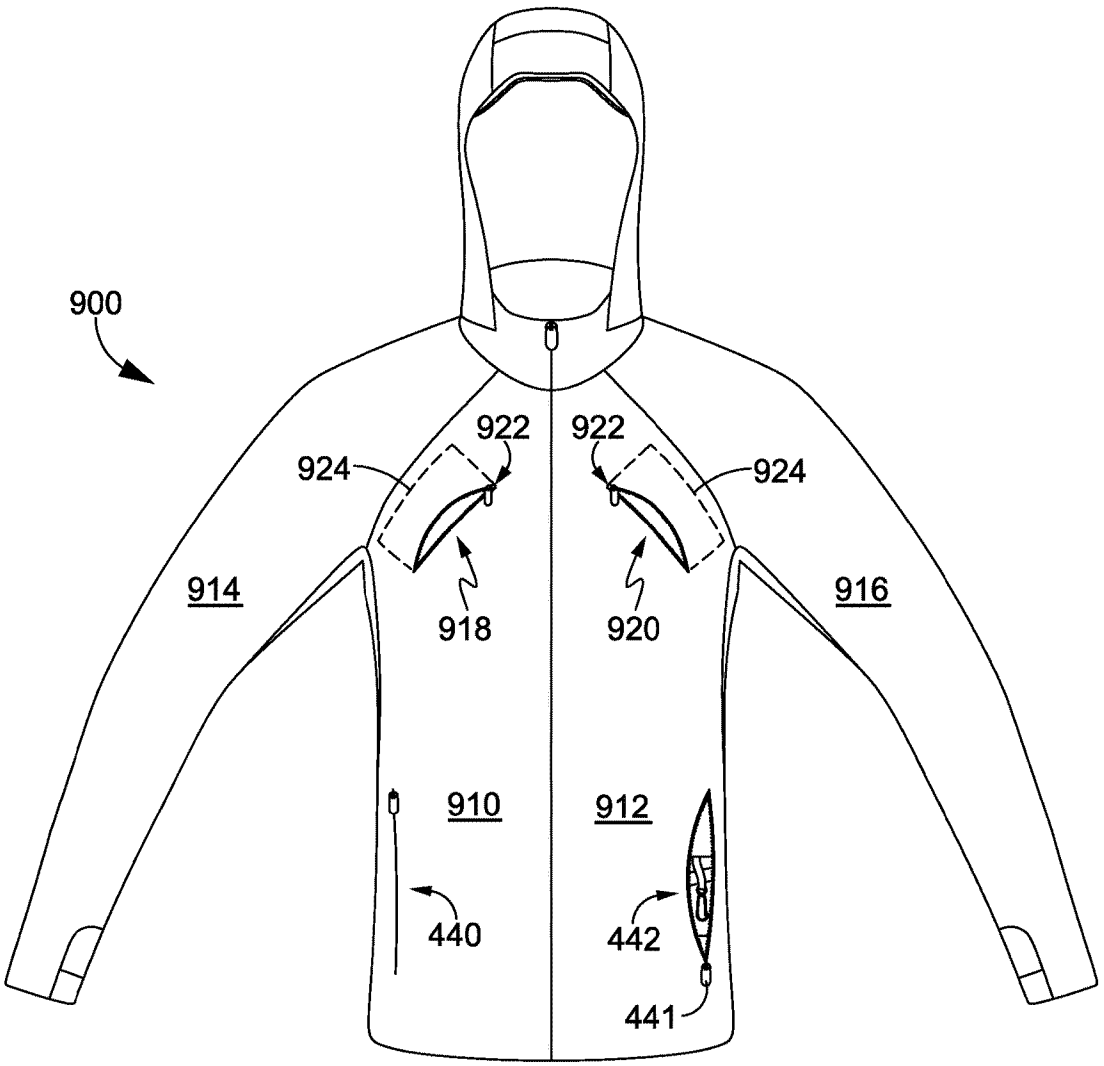

FIGS. 9A and 9B depict an alternative way of forming inflow air ducts for an exemplary apparel item in accordance with aspects herein. With respect to FIG. 9A, FIG. 9A depicts a front view of an exemplary apparel item 900 having, for example, a right front panel 910, a left front panel 912, a right sleeve panel 914, and a left sleeve panel 916.

The apparel item 900 comprises a first inflow air duct 918 and a second inflow air duct 920 in a closed state in accordance with aspects herein. In one exemplary aspect, the first inflow air duct 918 and the second inflow air duct 920 may be formed by incising the right front panel 910 and the left front panel 912 respectively to form an opening, and using some type of releasable fastener 922 to maintain the first and second inflow air ducts 918 and 920 in an open state, a closed state, or an intermediate state. In another exemplary aspect, the first inflow air duct 918 and the second inflow air duct 920 may be formed in a manner similar to the inflow air ducts for the apparel item 100 and/or the apparel item 800. For example, the first and second inflow air ducts 918 and 920 may be formed by permanently and discontinuously affixing panel edges together to form the ducts 918 and 920 and employing the releasable fastener 922 to maintain the ducts 918 and 920 in an open state, a closed state, or an intermediate state.

Continuing, in exemplary aspects, the releasable fastener 922 may comprise a zipper, buttons, hook-and-eyes, snaps, hook-and-loop fasteners, a releasable adhesive, and the like. The location of the first and second inflow air ducts 918 and 920 on the front of the apparel item 900 is exemplary only, and it is contemplated herein that the ducts 918 and 920 may be located in other areas of the right front panel 910 and the left front panel 912 and/or may have different orientations than those shown.

FIG. 9B illustrates the first inflow air duct 918 and the second inflow air duct 920 in an open state in accordance with aspects herein. For instance, the first and second inflow air ducts 918 and 920 may be opened via the releasable fastener 922. As shown in FIG. 9B, a perforated backing 924 similar to the perforated backing 510 of FIG. 5 may line the first and second inflow air ducts 918 and 920, where the backing 924 may have sufficient permeability to let air flow through but prevent particulate matter from entering the ducts 918 and 920.

In exemplary aspects, the first and second inflow air ducts 918 and 920 may be selectively opened or closed via the releasable fastener 922 to provide varying levels of ventilation. For instance, only one of the inflow air ducts 918 or 920 may be opened, or both may be partially opened to provide a lower level of ventilation to the apparel item 900. This may be useful when the wearer is resting or is not in an active state. However, both the first and second inflow air ducts 918 and 920 may be completely opened to provide a greater degree of ventilation in response to, for example, the wearer engaging in athletic activities. Any and all aspects, and any variation thereof, are contemplated as being within the scope herein.

Moreover, the first and second inflow air ducts 918 and 920 may work in combination with the re-sealable pockets 440 and 442 described with respect to FIGS. 4A and 4B to further provide variable levels of venting to the apparel item 900. For instance, the first and second inflow air ducts 918 and 920 and the re-sealable pockets 440 and 442 may be completely opened to provide a maximum level of ventilation to the apparel item 900. Or the first and second inflow air ducts 918 and 920 and the re-sealable pockets 440 and 442 may be maintained in a closed state to provide maximum warmth to the apparel item 900. Combinations between the completely open state and the closed state are also contemplated herein where one or more of the first and second inflow air ducts 918 and 920 may be opened or partially opened while the re-sealable pockets 440 and 442 are closed, or vice versa. Any and all aspects, and any variation thereof, are contemplated as being within the scope herein.

Figure 10:
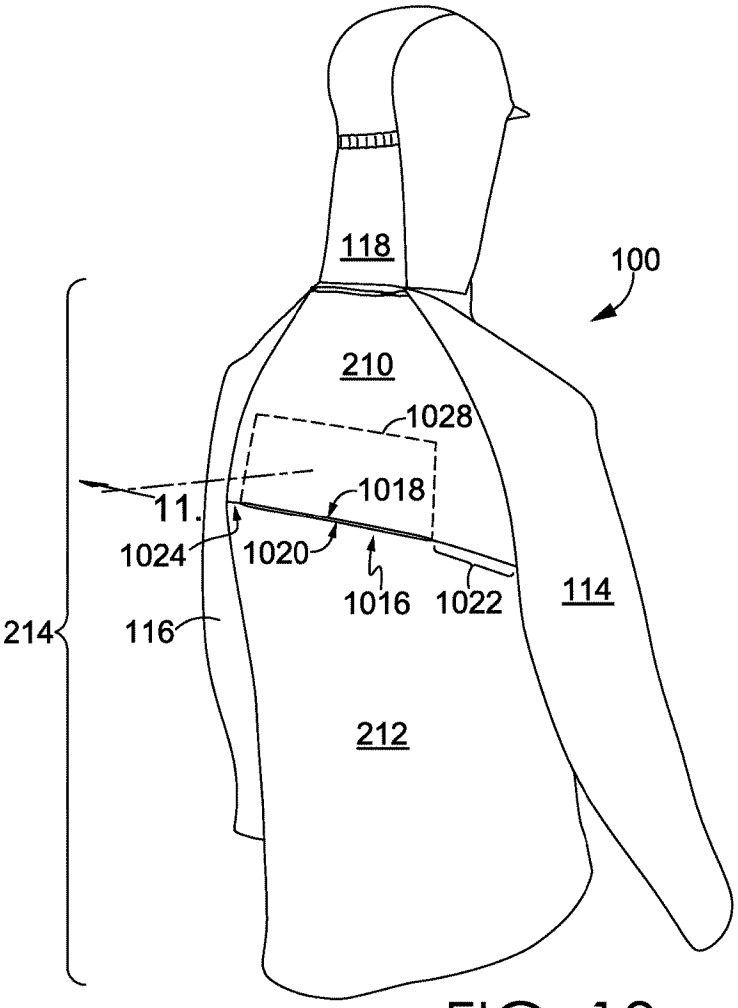
FIG. 10 depicts a back perspective view of an exemplary integrated duct system for the apparel item described herein in accordance with aspects herein.

Turning now to FIG. 10, the back of the apparel item 100 comprises an outflow air duct 1016 that is formed by permanently and discontinuously affixing a lower edge 1018 of the upper back panel 210 to an upper edge 1020 of the lower back panel 212. More specifically, the lower edge 1018 of the upper back panel 210 is permanently joined to the upper edge 1020 of the lower back panel 212 at the areas indicated by reference numerals 1022 and 1024 but is maintained separate from the upper edge 1020 at the outflow air duct 1016.

In exemplary aspects, the outflow air duct 1016 is oriented in a generally horizontal direction and extends across the midline of the back panel 214. When the apparel item 100 is in the as-worn configuration, the outflow air duct 1016 is adapted to generally lie along a mid-thoracic area of the wearer. For example, the outflow air duct 1016 may be configured to lie approximately 20 to 30 cm below the neckline of the apparel item 100. In exemplary aspects, the outflow air duct 1016 may have an opening length in the range of 20 cm to 40 cm, 25 cm to 35 cm, and/or between 28 cm and 32 cm, although lengths above and below these ranges are contemplated herein. The location and the length of the outflow air duct 1016 is exemplary only, and it is contemplated herein that the outflow air duct 1016 may be positioned above and/or below the location shown in FIG. 10, and that the outflow air duct 1016 may have a length greater or less than that shown. Any and all aspects, and any variation thereof, are contemplated as being within the scope herein.

Although not clearly shown in FIG. 10, the lower edge 1018 of the upper back panel 210 may optionally be reinforced with a rigid or semi-rigid reinforcement strip having an arched shape. The arched shape of the reinforcement strip causes the upper back panel 210 to extend out and away from the lower back panel 212 in the area of the outflow air duct 1016. This is shown more clearly in FIG. 3 which is a right side view of the apparel item 100. As shown in FIG. 3, the lower edge of the upper back panel 210 extends away from the upper edge of the lower back panel 212 a predetermined distance. In exemplary aspects, the predetermined distance may be in the range of 3 cm to 7 cm, 4 cm to 6 cm, and/or between 4.5 cm and 5.5 cm although distances above and below these values are contemplated as being within the scope herein. The horizontal orientation of the outflow air duct 1016 combined with the use of the reinforcement strip effectively creates a downward-facing scoop having an aerofoil-type shape. The benefits of this shape will be detailed below. The aerofoil-type shape shown in FIG. 3 may be augmented by air flowing out of the outflow air duct 1016. Passage of this air may cause the outflow air duct 1016 to expand or insufflate to further create the downward-facing scoop shape.

Figure 11:
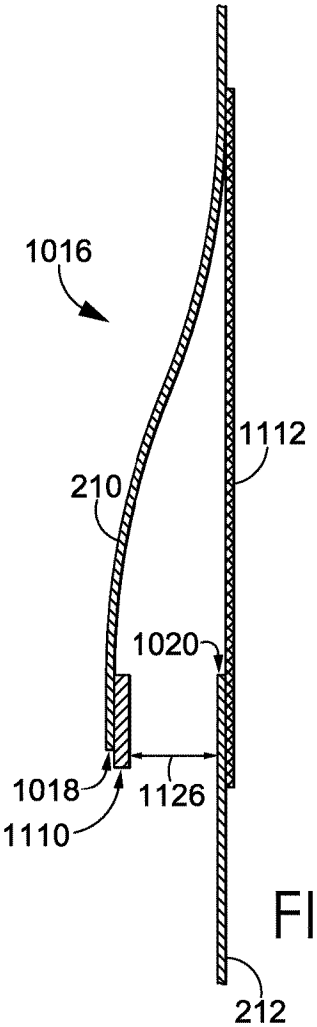
FIG. 11 depicts a cross-sectional view taken along cut line 11 of FIG. 10 illustrating an outflow air duct of the integrated duct system in accordance with aspects herein.

FIG. 11 depicts a cross-sectional view of the outflow air duct 1016 along cut line 11 in accordance with aspects herein. A reinforcement strip 1110 is affixed to the lower edge 1018 of the upper back panel 210. As shown in FIG. 11, the edge of the reinforcement strip 1110 may extend beyond the lower edge 1018 such that it is visible when viewing the back of the apparel item 100. In other exemplary aspects, the edge of the reinforcement strip 1110 may lie flush with the lower edge 1018. Or the lower edge 1018 of the upper back panel 210 may extend beyond the edge of the reinforcement strip 1110 and may wrap around the edge such that the reinforcement strip 1110 is not visible when viewing the back of the apparel item 100. Any and all aspects, and any variation thereof, are contemplated as being within the scope herein.

The reinforcement strip 1110 may, for instance, be any of the exemplary reinforcement strips 1400, 1420, or 1440 depicted in FIG. 14A, 14B, or 14C, and the discussion regarding the strips 1400, 1420, and 1440 is equally applicable to the reinforcement strip 1110. In exemplary aspects, the reinforcement strip 1110 may be affixed along the length of the lower edge 1018 via stitching, bonding, adhesives, welding, and the like. Because the cross-section is taken at the approximate midpoint of the strip 1110, the lower edge 1018 of the upper back panel 210 is offset or extends away from the lower back panel 212 by a distance 1126. As explained above, the distance 1126 may be in the range of 3 cm to 7 cm, 4 cm to 6 cm, and/or between 4.5 cm and 5.5 cm although distances above and below these values are contemplated as being within the scope herein.

In an exemplary aspect, a perforated backing 1112 may be affixed to the lower back panel 212 and the upper back panel 210 in the area of the outflow air duct 1016. More specifically, the perforated backing 1112 may be affixed to an inner-facing surface of the lower back panel 212 at an opening side of the outflow air duct 1016 and to an inner-facing surface of the upper back panel 210 at the back edge of the outflow air duct 1016. Like the perforated backing 510, the perforated backing 1112 may have a generally rectangular shape and forms the floor of the outflow air duct 1016, although other shape configurations are contemplated herein. This is similar to the configuration shown in FIG. 6B and is indicated by the dashed line 1028 in FIG. 10. The perforated backing 1112 has sufficient permeability to enable air within the apparel item 100 to exit the apparel item 100 via the outflow air duct 1016 but also is useful in preventing particles and debris from the external environment from entering the apparel item 100. In exemplary aspects, the perforated backing 1112 may comprise a mesh material, a perforated fabric, and the like.

Although only one outflow air duct is depicted in FIG. 10, it is contemplated herein that there may be multiple outflow air ducts on the apparel item 100. For instance, the back of the apparel item 100 may comprise multiple panels and an outflow air duct may be formed between the edges of each of the panels. Any and all aspects, and any variation thereof, are contemplated as being within the scope herein.

Figure 12:
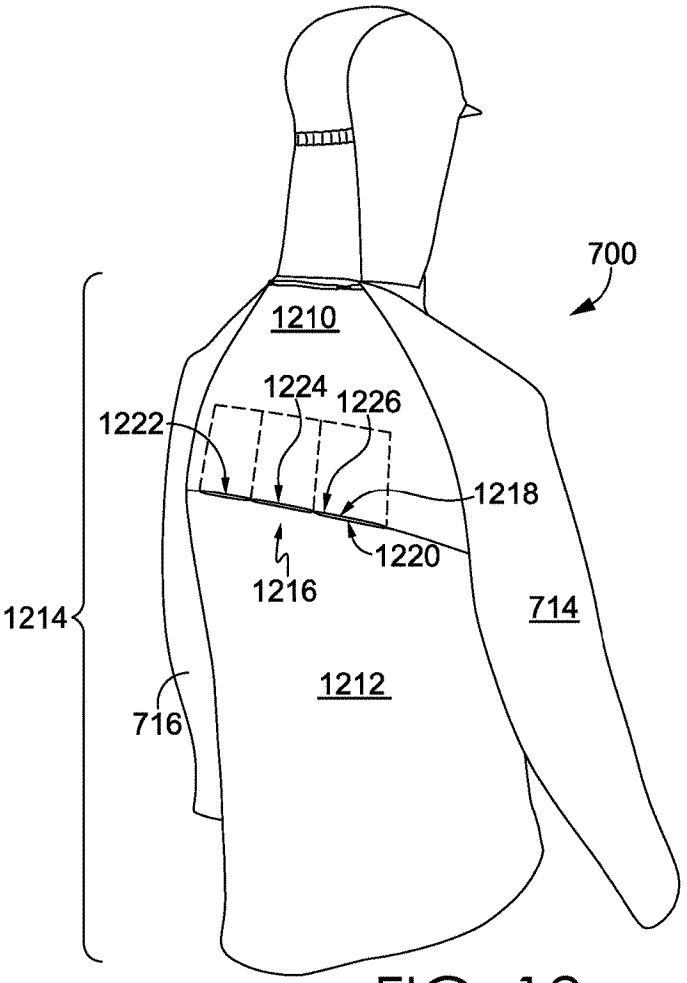
FIG. 12 depicts a back perspective view of the exemplary apparel item of FIG. 10 illustrating an alternative configuration for the outflow air duct in accordance with aspects herein.

Turning now to FIG. 12, a back perspective view of the apparel item 700 of FIG. 7 is shown in accordance with aspects herein and is used to illustrate different configurations for the outflow air duct. Similar to the apparel item 100, the apparel item 700 comprises an upper back panel 1210 and a lower back panel 1212 that together form the back panel 1214. In one exemplary aspect, an outflow air duct 1216 is formed by permanently and discontinuously affixing a lower edge 1218 of the upper back panel 1210 to an upper edge 1220 of a lower back panel 1212 at one or more points along the outflow air duct 1216. In this depiction, the outflow air duct 1216 has been subdivided into three sub-air ducts 1222, 1224, and 1226. The creation of sub-air ducts may also be achieved by using a reinforcement strip having a configuration similar to that shown for the reinforcement strip 1420 of FIG. 14B and/or the reinforcement strip 1440 of FIG. 14C. In this aspect, the trough region of the reinforcement strip may or may not be affixed to the upper edge 1220 of the lower back panel 1212. Any and all aspects, and any variation thereof, are contemplated as being within the scope herein.

The configurations shown in FIGS. 7 and 12 are exemplary only and it is contemplated herein that the inflow and outflow air ducts 720, 722, and 1216 may be sub-divided into more or less sub-air ducts. Additionally it is contemplated herein, that the inflow air ducts 720 and 722 may not be sub-divided while the outflow air duct 1216 is sub-divided or vice versa. Further, it is contemplated herein that each of the sub-air ducts may have its own perforated backing as shown by the dashed lines in FIGS. 7 and 12, or a single perforated backing may be used that spans all the sub-air ducts. Any and all aspects, and any variation thereof, are contemplated as being within the scope herein.

Figure 13:
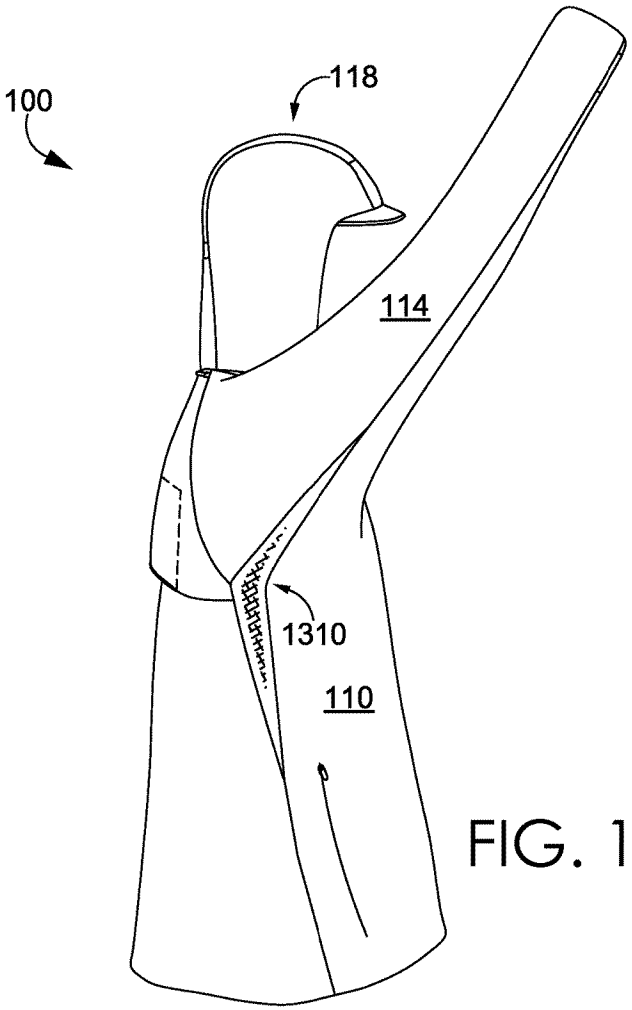
FIG. 13 depicts a right side view of the exemplary apparel item described herein having perforated inserts in the underarm portions in accordance with aspects herein.

FIG. 13 depicts a right side view of the exemplary apparel item 100 to illustrate an additional aspect of the integrated duct system 120 comprising perforated inserts in the underarm portions of the apparel item 100 in accordance with aspects herein. More specifically, a perforated insert 1310 is shown for the right underarm portion of the apparel item 100. A perforated insert for the left underarm portion of the apparel item 100 would have a similar configuration. The perforated insert 1310 may be formed from, for example, a mesh material or a perforated fabric and may have a generally diamond shape as shown although other shape configurations are contemplated herein. Because this portion of the apparel item 100 overlies a generally high heat-producing area of the wearer, use of the perforated insert 1310 provides an additional egress point for heated air and/or moisture vapor to leave the apparel item 100, and/or an additional ingress point for air from the external environment to enter the apparel item 100 and potentially cool the wearer.

The configuration of the first and second inflow air ducts, such as the ducts 420 and 422, the ducts 720 and 722, the ducts 822 and 824, and/or the ducts 918 and 920, combined with the orientation of the inflow air ducts may help to create a configuration that maximizes the opportunity to capture and funnel air traveling over and up the front of the apparel item, such as the apparel item 100, the apparel item 700, the apparel item 800, and/or the apparel item 900. The funneling effect may be augmented by use of the reinforcement strip attached to the upper or superior margin of the inflow air ducts, where use of the reinforcement strip creates a scoop-like configuration for the inflow air ducts.

Using the apparel item 100 as a representative example, as described earlier, running or jogging motions in a forward direction often produce an air flow pattern where the air travels over and up the front of the apparel item 100. The air may be effectively captured and funneled into the interior of the apparel item 100 by, for example, the inflow air ducts 420 and 422 and/or the re-sealable pockets 440 and 442 when in an open or partially-open state. Any air flow that is not captured by the first and second inflow air ducts 420 and 422 or the pockets 440 and 442 may continue to travel over the shoulders of the wearer and potentially over the back of the apparel item 100.

Continuing, the arched-shape configuration of the outflow air duct 1016 along with its opening length and its horizontal orientation further helps to create at least two effective air flow patterns that help to draw air out of the apparel item 100, thereby helping to cool the wearer and to remove moisture vapor that builds up within the apparel item 100. For example, the outflow air duct 1016 is configured to have a longer length and a wider opening than the first and second inflow air ducts 420 and 422, thus providing a substantially larger egress or exit point for air to leave the apparel item 100 as compared to the ingress or entrance point for air entering the apparel item 100. Because of the relatively small openings associated with the first and second inflow air ducts 420 and 422 (and potentially the pockets 440 and 442) and because air is being forced into the ducts 420 and 422 by the forward movement of the wearer, a positive pressure is generated at the first and second inflow air ducts 420 and 422. By contrast, because of the larger opening of the outflow air duct 1016 and because air is not being forced into the duct 1016 due to the wearer's forward motion, a negative pressure is generated at the outflow air duct 1016. A pressure differential is thus created between the first and second inflow air ducts 420 and 422 and the outflow air duct 1016 causing air within the apparel item 100 to move through the apparel item 100 and flow out of the apparel item 100 at the outflow air duct 1016.

Another exemplary air flow pattern may also be created due to the downward-facing scoop configuration of the outflow air duct 1016. As mentioned, this configuration causes the outflow air duct 1016 to assume an aerofoil-type shape similar to an airplane wing. Air that is not captured by the first and second inflow air ducts 420 and 422 (and/or the pockets 440 and 442) may continue to travel up and over the shoulders of the wearer. At least some of this air may travel over and down the back torso of the wearer. The air then travels over the outwardly-projecting outflow air duct 1016. Because of the aerofoil-type shape to the duct 1016, according to Bernoulli's principle air will generally flow faster over the outer-facing surface of the outflow air duct 1016 while air exiting the outflow air duct 1016 from the interior of the apparel item 100 will likely move slower. The faster moving air causes a lower air pressure while the slower moving air causes a higher air pressure. The slower moving air will attempt to speed up in order to equalize the pressure differential thereby further helping to draw or channel the air out of the apparel item 100 and helping to remove moisture vapor build-up within the apparel item 100.

As shown and described, the integrated duct system 120 promotes breathability of the apparel item 100 by locating inflow air ducts and/or re-sealable pockets on the front of the apparel item 100 to effectively capture and funnel air into the space between the apparel item 100 and the wearer's body. One funneled into this space, the air circulates around the wearer's body where it can not only cool the wearer but pick up excess heat and/or moisture vapor. Due to the configuration of the outflow air duct, air is directed to leave the apparel item 100 at the back of the apparel item 100. Moreover, use of the perforated inserts, such as the perforated insert 1310, in the underarm portions of the apparel item 100 provides an additional level of ventilation and/or breathability in high heat-producing areas of the wearer's body.

Layered Thumbhole Assembly

Figure 15A:
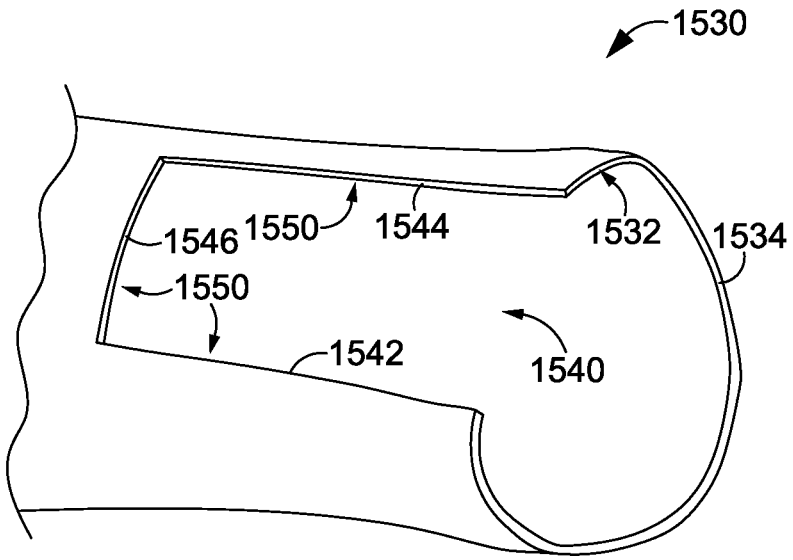
FIG. 15A depicts a detail view of a distal sleeve end of the exemplary apparel item described herein where the distal sleeve end is depicted without a sleeve cuff affixed thereto in accordance with aspects herein.
Figure 15B:
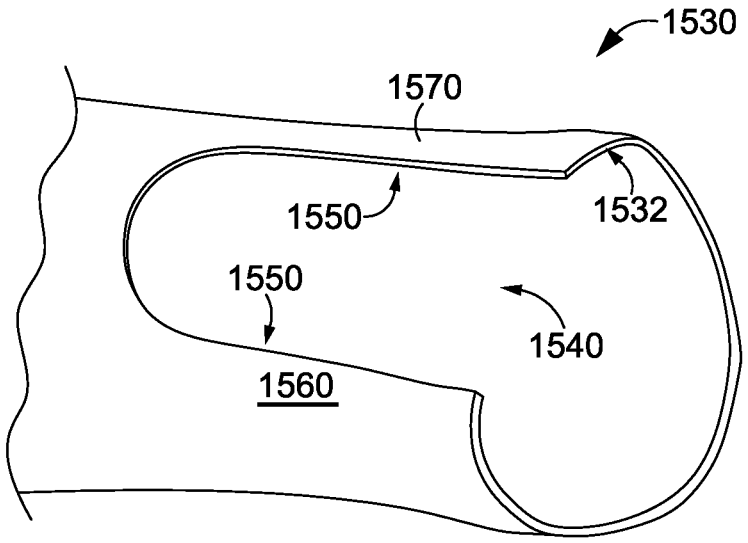
FIG. 15B depicts a detail view of an alternative distal sleeve end without a sleeve cuff affixed thereto in accordance with aspects herein.

Beginning now with FIGS. 15A and 15B, a description of the layered thumbhole assembly 122 of the apparel item 100 will be provided in accordance with aspects herein. The terms of location used with respect to the layered thumbhole assembly 122 shall have their traditional meanings. A point on the sleeve is proximal to a second point if it is farther up the sleeve (e.g., closer to the torso portion) in the axial direction of sleeve extension. A point on the sleeve is distal to a second point if it is farther down the sleeve (e.g., farther from the torso portion) in the axial direction of sleeve extension. The location term "lateral" as used in connection with the sleeve may include a planar direction normal to the axial direction of sleeve extension.

The terms "overlap," "overlaps," or "overlapping" (etc.) when used in this disclosure (e.g., "the distal strap overlaps the anterior patch") include both overlapping "on top of" and "beneath." In terms of the example, the distal strap may overlap the anterior patch such that the distal strap overlaps on top of the anterior patch or the distal strap may overlap the anterior patch such that the distal strap overlaps beneath the anterior patch.

FIGS. 15A and 15B depict a distal sleeve end 1530 of the left sleeve panel 116. The left sleeve panel 116 is depicted without a sleeve cuff affixed thereto. The discussion of the layered thumbhole assembly 122 for the left sleeve panel 116 is equally applicable to the layered thumbhole assembly 122 for the right sleeve panel 114 of the apparel item 100.

The distal sleeve end 1530 comprises a sleeve wall 1532 extending proximally up the left sleeve panel 116 from a distal edge 1534. The sleeve wall 1532 includes a cutout 1540 formed therein. The cutout 1540 may extend from the distal edge 1534 proximally up the left sleeve panel 116. The cutout 1540 further comprises at least one cutout edge 1550. The at least one cutout edge 1550 may comprise a first cutout edge 1542, a second cutout edge 1544, and a rear cutout edge 1546 as depicted in FIG. 15A. The distal sleeve end 1530 further comprises a first outer surface 1560 and a second outer surface 1570 (as illustrated in FIG. 15B), each outer surface being located adjacent to the cutout 1540. In some aspects, the first cutout edge 1542, the second cutout edge 1544, and the rear cutout edge 1546 may be a single edge comprising the at least one cutout edge 1550.

In another aspect, the cutout 1540 may be formed proximally up the left sleeve panel 116 from the distal edge 1534. In this aspect, the cutout 1540 comprises a hole formed in the sleeve wall 1532 and the cutout 1540 is bounded by the sleeve wall 1532 on all sides. In this aspect, the at least one cutout edge 1550 may further comprise a front cutout edge. The front cutout edge and the distal edge 1534 form a margin at the distal sleeve end 1530.

In another aspect illustrated in FIG. 15B, the distal sleeve end 1530 includes a cutout 1540 formed in a sleeve wall 1532. The cutout 1540 extends proximally up the left sleeve panel 116 and includes the at least one cutout edge 1550. Spaced apart by the cutout 1540 are the first outer surface 1560 and the second outer surface 1570.

Figure 16:
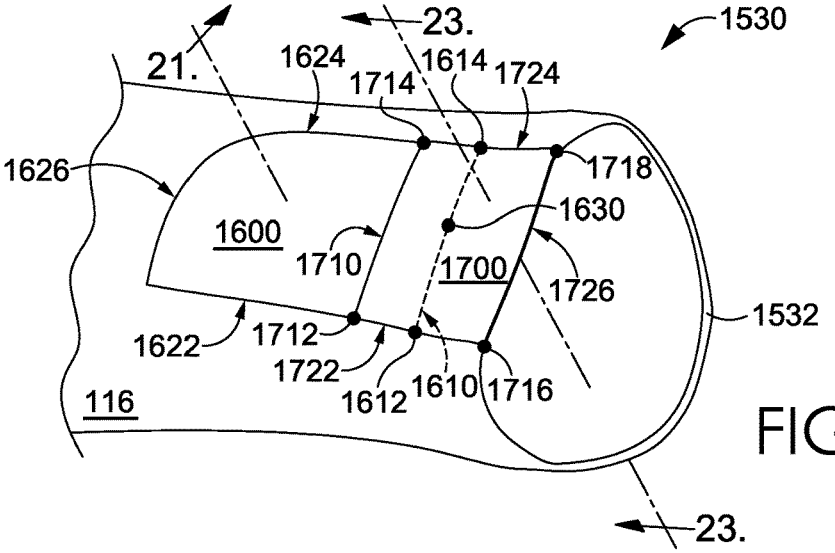
FIG. 16 depicts a detail view of a sleeve cuff in a closed configuration in accordance with aspects herein.
Figure 17:
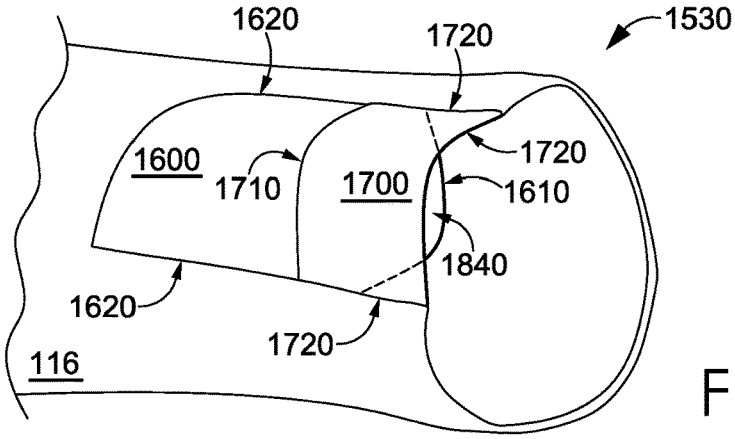
FIG. 17 depicts a detail view of a sleeve cuff with a distal strap and an anterior patch separated while in the closed configuration in accordance with aspects herein.
Figure 18:
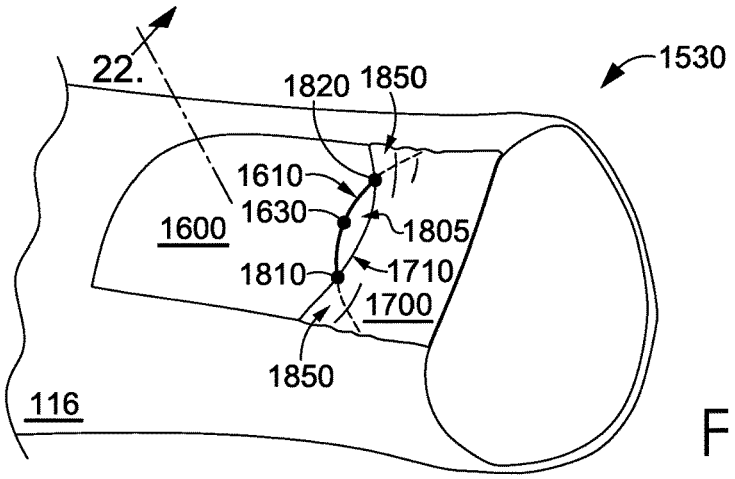
FIG. 18 depicts a detail view of a sleeve cuff in an open configuration in accordance with aspects herein.

Referring now to FIGS. 16-18, the left sleeve panel 116 further comprises an anterior patch 1600 affixed to the left sleeve panel 116. The anterior patch 1600 is shown having a leading edge 1610 and a plurality of trailing edges 1620 (shown in FIG. 17). In another aspect, the anterior patch 1600 may have a leading edge 1610 and a single trailing edge extending from one side to the other side of the leading edge 1610, the anterior patch 1600 extending there-between. The leading edge 1610 extends laterally across the cutout 1540 from a first anchor point 1612 associated with the first outer surface 1560 to a second anchor point 1614 associated with the second outer surface 1570. In another aspect, the leading edge 1610 may extend between the first anchor point 1612 associated with the first cutout edge 1542 to the second anchor point 1614 associated with the second cutout edge 1544. The plurality of trailing edges 1620 are located proximally up the left sleeve panel 116 from the leading edge 1610, and the anterior patch 1600 extends there-between. In the aspect illustrated by FIG. 16, the plurality of trailing edges includes a first side edge 1622, a second side edge 1624, and a rearward edge 1626.

The anterior patch 1600 may be affixed to the left sleeve panel 116 atop or below the sleeve wall 1532, within the cutout 1540 to the at least one cutout edge 1550 or in combination thereof. In another aspect, at least one first seam may affix the anterior patch 1600 to the left sleeve panel 116. In one aspect, the anterior patch 1600 is affixed to the left sleeve panel 116 from the first anchor point 1612 around the cutout 1540 located proximally to the leading edge 1610 at each of the plurality of trailing edges 1620 and to the second anchor point 1614. In the aspect illustrated by FIGS. 15B and 16, the anterior patch 1600 is affixed adjacent to the rear cutout edge 1546 at the rearward edge 1626. As further illustrated in FIG. 16, the anterior patch 1600 extends distally down the left sleeve panel 116 from the rearward edge 1626 to the leading edge 1610 and the first and second side edges 1622 and 1624 are affixed adjacent to the first and second cutout edges 1542 and 1544, respectively, from the rearward edge 1626 to the first and second anchor points 1612 and 1614, respectively. In one aspect, the anterior patch 1600 may cover at least a portion of the cutout 1540. The term "cover" is not meant to imply a limitation that the anterior patch 1600 must be atop the left sleeve panel 116; to the contrary, the anterior patch 1600 may be atop or below the left sleeve panel 116 or within the cutout 1540 and prevent communication through the portion of the cutout 1540 that is "covered."

The left sleeve panel 116 further comprises a distal strap 1700. In one aspect, the distal strap 1700 includes a trailing edge 1710 and a plurality of leading edges 1720 (shown in FIG. 17) and extends there-between. In another aspect, the distal strap 1700 may include a trailing edge 1710 and a single leading edge. In the aspect illustrated in FIGS. 16-17, the plurality of leading edges 1720 include a first side edge 1722, a second side edge 1724, and a front edge 1726. In one aspect, the trailing edge 1710 extends across the cutout 1540 from a first anchor point 1712 to a second anchor point 1714. In the aspect depicted in FIGS. 16-17, the front edge 1726 extends laterally across the cutout 1540 from a third anchor point 1716 to a fourth anchor point 1718. In any aspect depicted in FIGS. 16-17, the distal strap 1700 spans the cutout 1540 and is affixed to the left sleeve panel 116 such that the first side edge 1722 is affixed to the first outer surface 1560 and the second side edge 1724 is affixed to the second outer surface 1570. The distal strap 1700 may be oriented to have a long length dimension extending laterally around the left sleeve panel 116 and a short width dimension extending axially up the left sleeve panel 116. In the aspect illustrated in FIGS. 16-17, the front edge 1726 is not affixed to the left sleeve panel 116. In this aspect, the front edge 1726 may be laterally aligned with the distal edge 1534. In another aspect, where the cutout 1540 may be spaced proximally up the left sleeve panel 116 from the distal edge 1534, the front edge 1726 may be affixed to the left sleeve panel 116 adjacent to the forward cutout edge.

The exemplary distal strap 1700 illustrated in FIGS. 16-17 extends laterally across the cutout 1540 between the first side edge 1722 and the second side edge 1724 and proximally up the left sleeve panel 116 from the front edge 1726 to the trailing edge 1710. In the illustrated aspect, the layered thumbhole assembly 122 is in a closed configuration and the distal strap trailing edge 1710 is proximally located up the left sleeve panel 116 from the anterior patch leading edge 1610; stated another way, the distal strap 1700 overlaps the anterior patch 1600.

The distal strap 1700 may be affixed atop the left sleeve panel 116, below the left sleeve panel 116, within the cutout 1540, or in some combination thereof. In one aspect, the distal strap 1700 is affixed to the distal sleeve end 1530 at the first outer surface 1560 and the second outer surface 1570. In another aspect, the at least one first seam may affix the distal strap 1700 to the left sleeve panel 116. In yet another aspect, a second seam may affix the distal strap 1700 to the left sleeve panel 116. In one aspect, the distal strap 1700 is affixed to the left sleeve panel 116 along the first side edge 1722 from the first anchor point 1712 to the third anchor point 1716 and along the second side edge 1724 from the second anchor point 1714 to the fourth anchor point 1718.

When the apparel item 100 is in the as-worn position, the layered thumbhole assembly 122 presents a plurality of configurations. In one aspect, the plurality of configurations includes at least the closed configuration and an open configuration. The closed configuration is best seen in FIG. 16. The open configuration may be seen best in FIGS. 19-21. In one aspect, the closed configuration is defined by the distal strap 1700 overlapping the anterior patch 1600 such that the distal strap trailing edge 1710 is located proximally up the left sleeve panel 116 from the anterior patch leading edge 1610. The closed configuration is typically presented when a thumb is not received through an aperture 1805 (seen in FIG. 18 for example).

One aspect of the open configuration illustrated in FIG. 18 includes the aperture 1805 presented between a first point of intersection 1810 and a second point of intersection 1820. The points of intersection 1810 and 1820 are defined by the points where the distal strap trailing edge 1710 intersects the anterior patch leading edge 1610.

In the aspect illustrated in FIG. 18, when the layered thumbhole assembly 122 is in the open configuration, the layered thumbhole assembly 122 may include an overlapping portion 1850 where the distal strap 1700 overlaps the anterior patch 1600 between the first cutout edge 1542 and the first point of intersection 1810. The layered thumbhole assembly 122 in the open configuration further includes the aperture 1805 between the first point of intersection 1810 and the second point of intersection 1820. In one aspect, a perimeter of the aperture 1805 is comprised of a portion of the distal strap trailing edge 1710 and a portion of the anterior patch leading edge 1610. The layered thumbhole assembly 122 in the open configuration may further include a second overlapping portion 1850 where the distal strap 1700 overlaps the anterior patch 1600 between the second point of intersection 1820 and the second cutout edge 1544.

FIG. 17 depicts the exemplary layered thumbhole assembly 122 of FIG. 16 with the distal strap 1700 and the anterior patch 1600 separated while still in the closed configuration in accordance with an aspect hereof. As can be understood, the separation of the anterior patch 1600 and distal strap 1700 in the manner depicted in FIG. 17 does not provide a hole through which a user's thumb may extend as a thumb will extend along the inner surface of the anterior patch 1600 past the trailing edge 1710 of the distal strap 1700 which prevents, based on traditional human anatomy, the thumb from accidentally extending through the aperture 1805, in an exemplary aspect. Therefore, a gap 1840 may be formed between the distal strap 1700 and the anterior patch 1600 without eliminating an overlap near the midpoint of the leading edge 1610.

FIG. 18 depicts the layered thumbhole assembly 122 in an open configuration at the aperture 1805 in accordance with aspects described herein. In this example, a center point 1630 is not overlapped by the distal strap 1700. The leading edge 1610 is overlapped by the distal strap 1700 trailing edge 1710 near the first and second side edges 1622 and 1624. However, the leading edge 1610 intersects the trailing edge 1710, at the first and second points of intersection 1810 and 1820, causing the center point 1630 to be spaced apart from the distal strap 1700 and to form the aperture 1805. Stated differently, it is contemplated that the aperture 1805 is defined by the leading edge 1610 and the trailing edge 1710 between a first point of intersection 1810 and a second point of intersection 1820 of the same edges. The perimeter of the aperture 1805 may include at least a portion of the leading edge 1610 and at least a portion of the trailing edge 1710.

Figure 19:
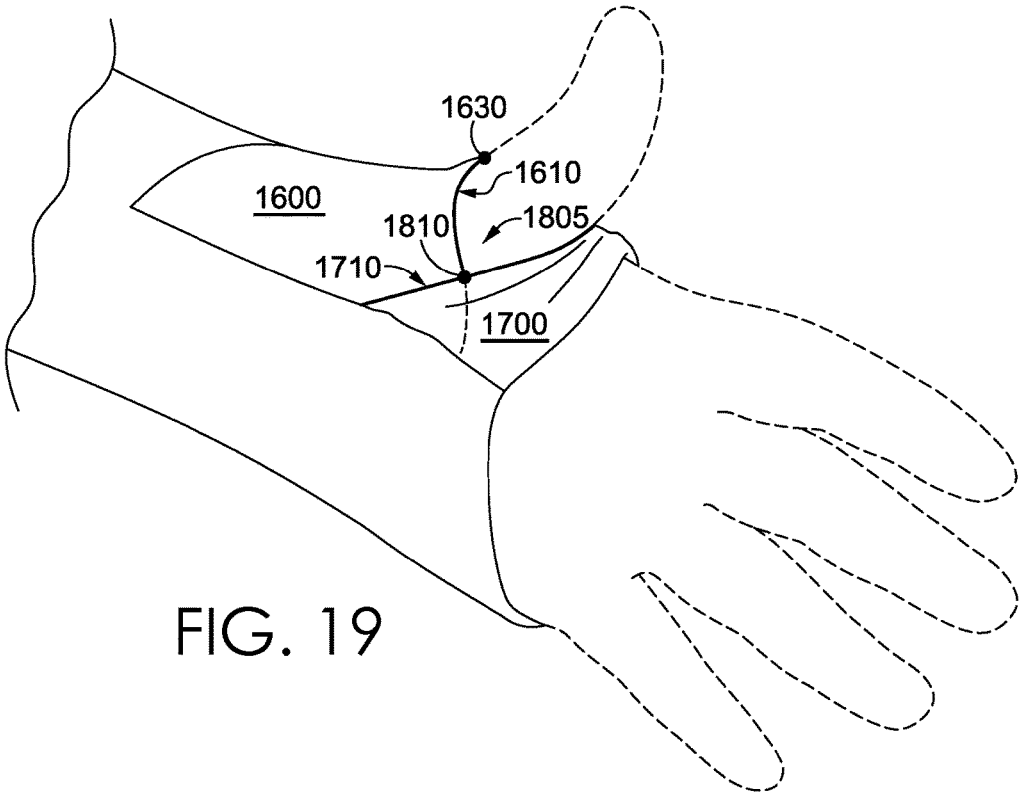
FIG. 19 depicts a detail view of a sleeve cuff having a thumb extending through an aperture in accordance with aspects herein.
Figure 20:
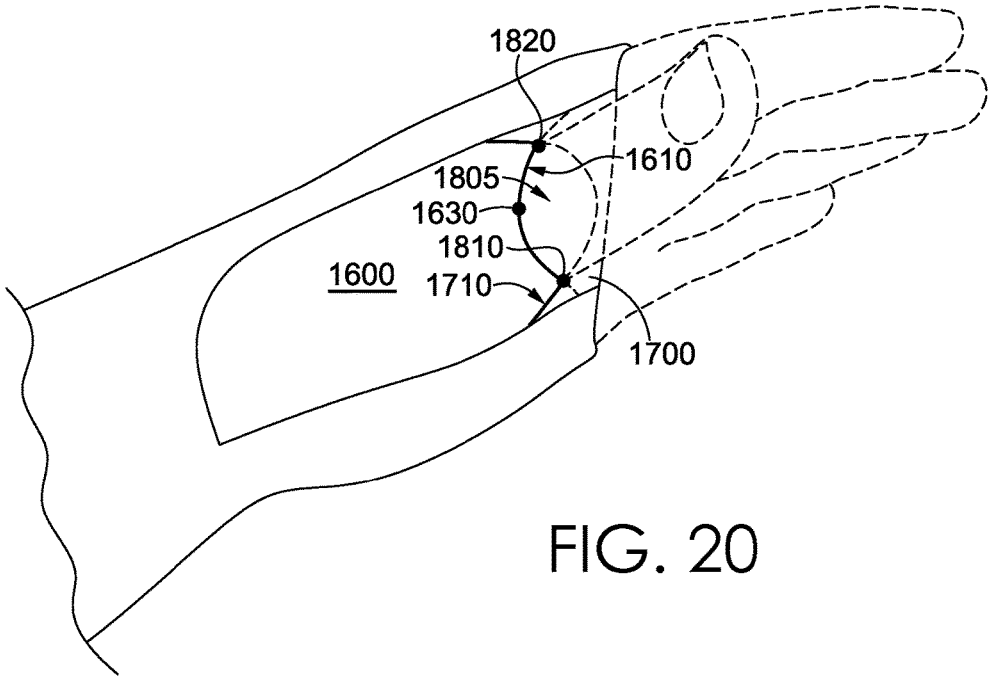
FIG. 20 depicts a detail view of a sleeve cuff having a thumb extending through an aperture in accordance with aspects herein.

FIG. 19 and FIG. 20 depict the layered thumbhole assembly 122 in the open configuration and having a thumb received through the aperture 1805 in accordance with aspects described herein. As can be illustrated with a thumb extending therethrough, the aperture 1805 is formed, in an exemplary aspect, by the leading edge 1610 extending radially outward from an axial centerline of the left sleeve panel 116 when in the open configuration. To facilitate transitioning from a closed to an open configuration, and to allow for freedom of movement of the thumb, it is contemplated that the distal strap 1700 and/or the anterior patch 1600 are formed from an elastic material that allows for the manipulation of the trailing edge 1710 and the leading edge 1610 to open and move about a thumb.

Varying the materials used to form the distal strap 1700 and/or the anterior patch 1600 may provide for additional control of the elasticity provided at the distal sleeve end 1530. In one aspect, the distal strap 1700 and/or the anterior patch 1600 may be comprised of a woven material. In another aspect, the distal strap 1700 and/or the anterior patch 1600 may be comprised of an engineered knit material. In some aspects, the left sleeve panel 116 can be comprised of materials having lower elasticity than the materials in the layered thumbhole assembly 122. In those aspects, including the layered thumbhole assembly 122 in the left sleeve panel 116 allows the wearer to pull the left sleeve panel 116 up their arm such that the distal sleeve end 1530 is positioned proximally up the wearer's arm. Further, the net elasticity of the distal sleeve end 1530 and the layered thumbhole assembly 122 may be operable to hold the distal sleeve end 1530 at the proximally-located position of the wearer's arm.

Figure 21:
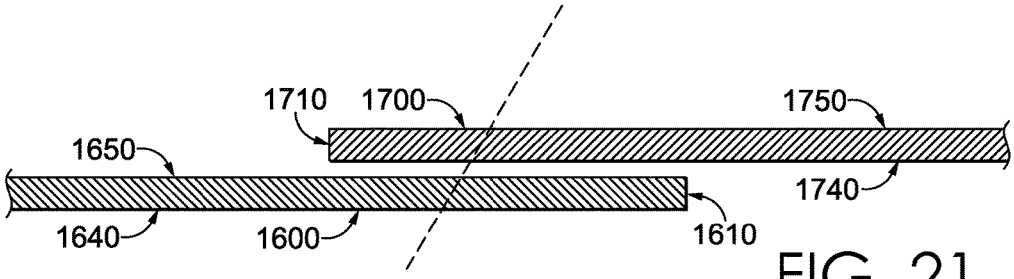
FIG. 21 depicts a cross-section taken along 21-21 of FIG. 16 and illustrates a sleeve cuff in a closed configuration in accordance with aspects herein.

FIG. 21 depicts a cross-section of the layered thumbhole assembly 122 in a closed configuration, in accordance with aspects described herein. The distal strap 1700 is comprised of an inner surface 1740 and an outer surface 1750. The anterior patch 1600 is comprised of an inner surface 1640 and an outer surface 1650. As depicted, the distal strap 1700 trailing edge 1710 overlaps the anterior patch 1600. A dash line is provided to depict an exemplary angle of thumb insertion to open the thumbhole by changing the relative placement of the trailing edge 1710 relative to the leading edge 1610 as depicted in FIG. 22.

Figure 22:
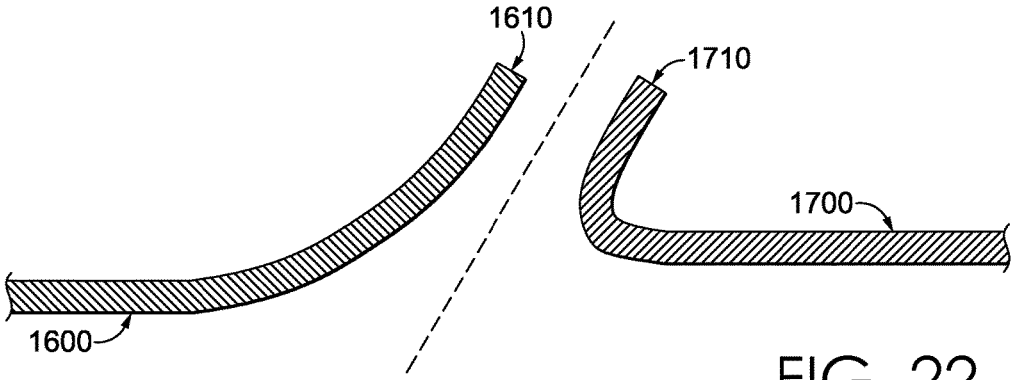
FIG. 22 depicts a cross-section taken along 22-22 of FIG. 18 and illustrates a sleeve cuff in an open configuration in accordance with aspects herein.

FIG. 22 depicts a cross-section of the layered thumbhole assembly 122 in the opened configuration, in accordance with aspects described herein. The open configuration allows a thumb having an angle of entry depicted by the dash line to exit an internal volume of the left sleeve panel 116.

The layered thumbhole assembly 122 has hereinabove been disclosed as having the distal strap 1700 overlapping the anterior patch 1600. It is contemplated, however, that in one exemplary aspect the anterior patch 1600 overlaps the distal strap 1700. In this aspect, the anterior patch leading edge 1610 overlaps the distal strap 1700 and is distally located down the left sleeve panel 116 from the distal strap trailing edge 1710. This aspect further comprises the aperture 1805 formed between the overlapping anterior patch 1600 and distal strap 1700 and having a perimeter including at least a portion of each of the leading edge 1610 and the trailing edge 1710.

Figure 23:
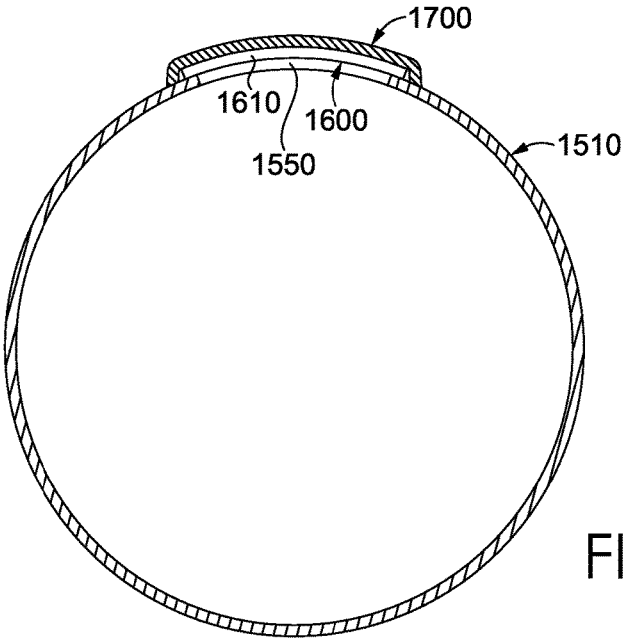
FIG. 23 depicts a cross-section taken along 23-23 of FIG. 16 and illustrates a sleeve cuff affixed to sleeve surfaces on opposite sides of a cutout and in a closed configuration in accordance with aspects herein.

FIG. 23 depicts a lateral cross-section of the layered thumbhole assembly 122 across line 23-23 in FIG. 16, the line 23-23 being coplanar with the anterior patch leading edge 1610. The distal strap 1700 is shown overlapping the anterior patch 1600 and the layered thumbhole assembly 122 is in the closed configuration. It is understood that the anterior patch 1600 is affixed at the inner surface 1640 to the sleeve wall 1532 at the first and second outer surfaces 1560, 1570. Further, it is understood that the distal strap 1700 is similarly affixed at the distal strap inner surface 1740 to the sleeve wall 1532 at the first and second outer surfaces 1560, 1570.

Figure 24:
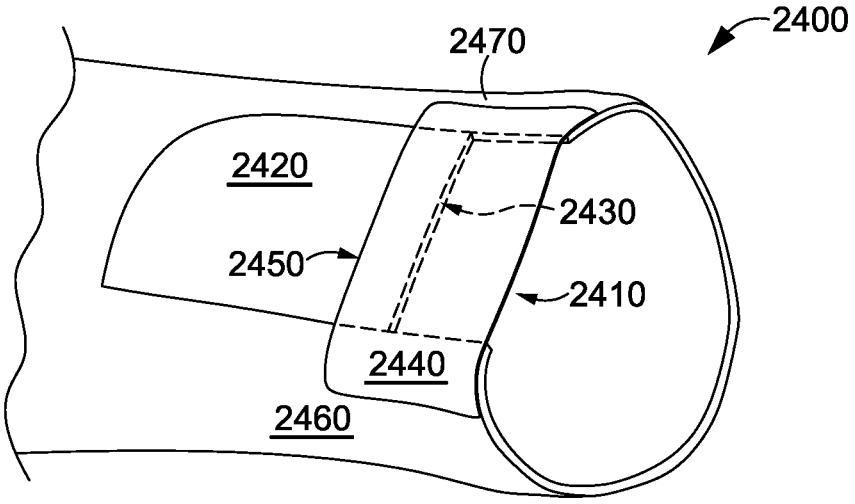
FIG. 24 depicts a detail view of a sleeve cuff with a distal strap affixed to sleeve surfaces on opposite sides of a cutout and an anterior patch affixed within the cutout to opposing cutout edges and in a closed configuration in accordance with aspects herein.

FIG. 24 depicts another aspect of a distal sleeve end 2400 in a closed configuration in accordance with an aspect hereof. Depicted is the distal sleeve end 2400 having a cutout 2410. The cutout 2410 includes an anterior patch 2420 affixed around and adjacent to the cutout 2410 at the points proximally located up the left sleeve panel 116 from a leading edge 2430. The distal sleeve end 2400 further includes a distal strap 2440 having a trailing edge 2450, the distal strap 2440 being affixed at a first sleeve surface 2460 and a second sleeve surface 2470. The trailing edge 2450 is located proximally up the left sleeve panel 116 from the anterior patch leading edge 2430. As depicted, the distal strap 2440 is wider than the cutout 2410 and is also wider than the anterior patch 2420. In one aspect, the distal strap 2440 is affixed to the left sleeve panel 116 on both sides of the cutout 2410 but not at points adjacent to the cutout 2410. In another aspect, the left sleeve panel 116 integrates the anterior patch 2420 therein such that the leading edge 2430 forms a rear wall of the cutout 2410. In this aspect, the distal strap trailing edge 2450 is proximally located up the left sleeve panel 116 from the integral leading edge 2430. In yet another aspect, the distal strap 2440 may be similarly integrated into the distal sleeve end 2400 and the anterior patch 2420 is affixed to the left sleeve panel 116 such that the integral trailing edge 2450 overlaps the anterior patch leading edge 2430.

Figure 25:
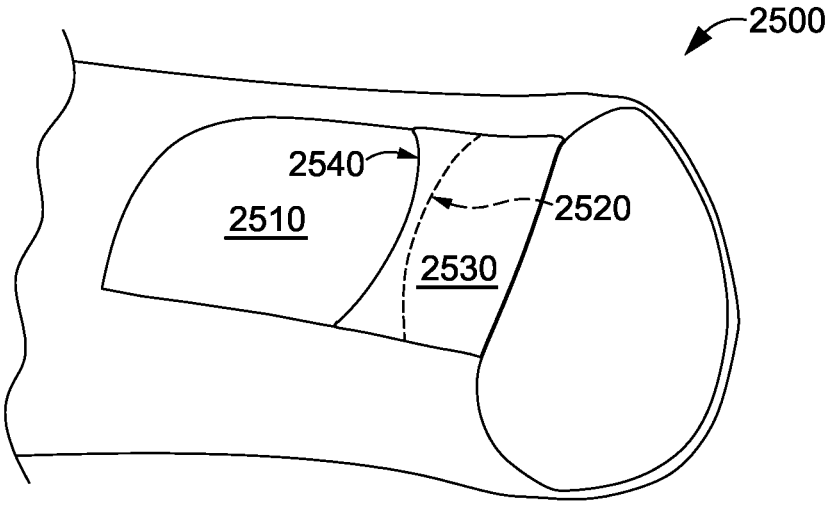
FIG. 25 depicts a detail view of a sleeve cuff with an angular distal strap trailing edge and an angular anterior patch leading edge in accordance with aspects herein.

FIG. 25 depicts a distal sleeve end 2500 in a closed configuration having an anterior patch 2510 and a distal strap 2530 affixed over a cutout. In one aspect, the distal strap 2530 includes a trailing edge 2540 having an arcuate shape. In this aspect, the anterior patch 2510 has a leading edge 2520 having an arcuate shape. The distal strap 2530 may be positioned such that the distal strap 2530 overlaps the anterior patch 2510 and the arcuate trailing edge 2540 is positioned proximally up the left sleeve panel 116 from the arcuate leading edge 2520 and there are no points of intersection between the arcuate trailing edge 2540 and the arcuate anterior leading edge 2520.

As shown and described, the layered thumbhole assembly 122 of the apparel item 100 is configured to remain in a closed state when not being used by a wearer, thereby preventing undesirable air flow and/or precipitation from entering the sleeves of the apparel item 100. Moreover, when being used, the overlapping panels of the layered thumbhole assembly 122 fit snugly around the wearer's thumb which further limits undesirable air flow and/or precipitation from entering the sleeves of the apparel item 100.

Hood and Hood Lock Cord System

Figure 26:
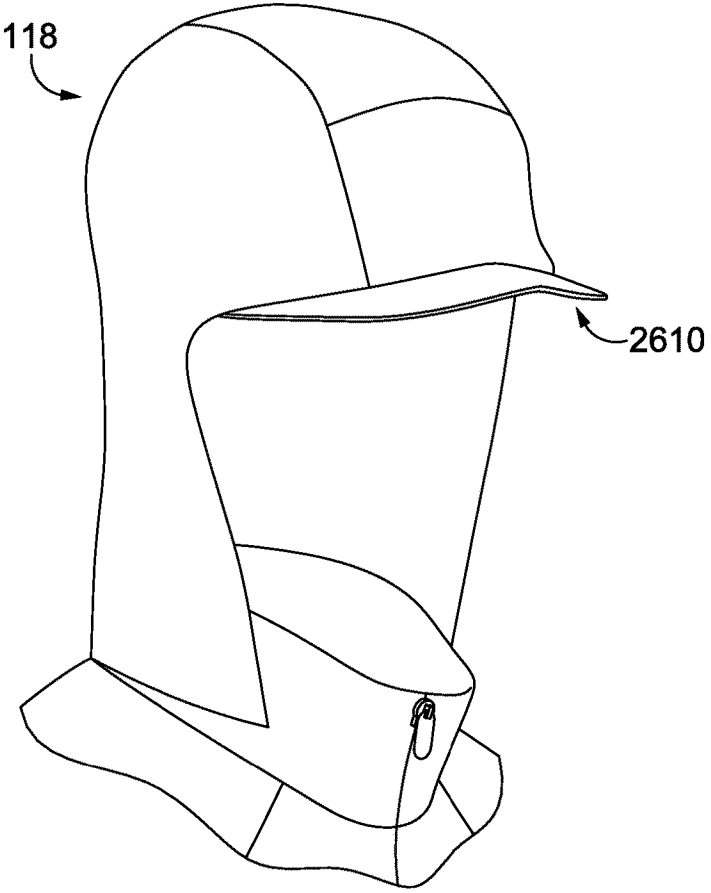
FIG. 26 depicts a front perspective view of an exemplary hood of the exemplary apparel item as described herein in accordance with aspects herein.

Beginning with FIG. 26, a description of the apparel item's hood 118 and hood lock cord system 216 will be provided in accordance with aspects herein. FIG. 26 depicts a front perspective view of the hood 118 having a moldable bill 2610, where the moldable bill 2610 is affixed to a front upper edge of the hood 118. In exemplary aspects, the moldable bill 2610 may be formed of a material that can be molded into different configurations thus allowing the hood 118 to more closely conform to the unique shape of the wearer's head. Exemplary materials used to form the moldable bill 2610 may comprise ethylene vinyl acetate, polyethylene materials, polyurethane materials, and the like.

Figure 27:
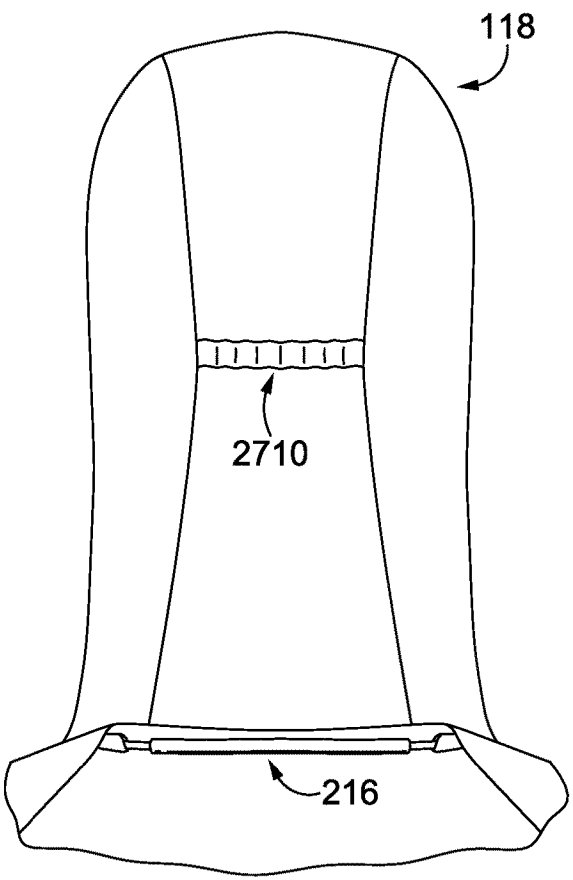
FIG. 27 depicts a back view of the exemplary hood of FIG. 26 in accordance with aspects herein.

FIG. 27 depicts a back view of the hood 118 and is provided to illustrate ruching 2710 on the back portion of the hood 118. More specifically, the ruching 2710 may be located at an approximate mid-point on the back portion of the hood 118. In exemplary aspects, the ruching 2710 may comprise an elastic band to which the material forming the hood 118 is affixed at one or more locations such that the elastic band causes the material to be gathered in a series of pleats. As such, use of the ruching 2710 causes the hood 118 to more closely conform to the back portion of the wearer's head when the hood 118 is worn by the wearer. Moreover, in exemplary aspects, the hood 118 may be formed from multiple panels where the panels may be formed or cut to define a close-fitting shape when assembled into the hood 118.

Figure 28:
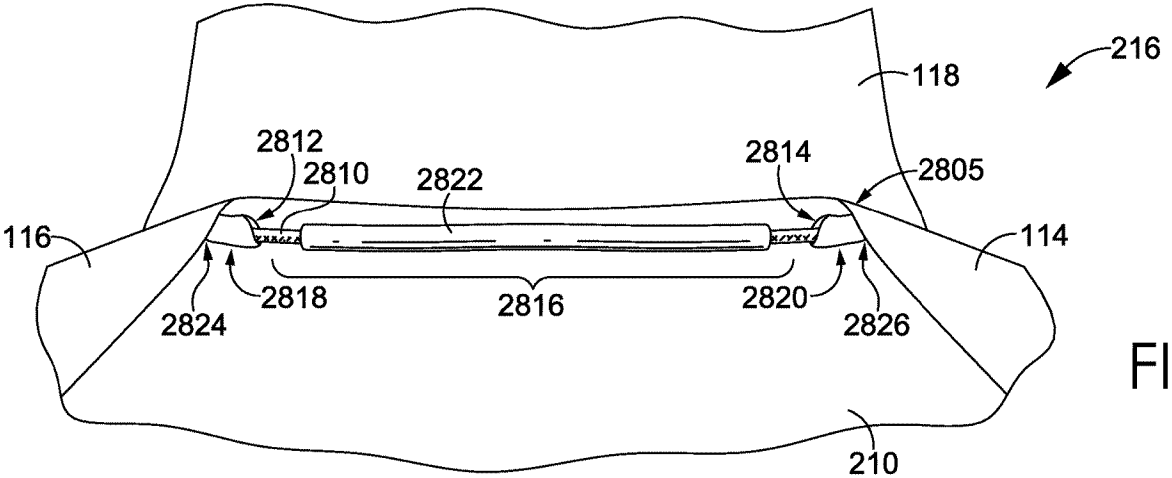
FIG. 28 depicts a close-up view of an exemplary hood lock cord system of the exemplary apparel item as described herein in accordance with aspects herein.

With respect to the hood lock cord system 216 of the exemplary apparel item 100, FIG. 28 shows a close-up view of the hood lock cord system 216 comprising a cord 2810, where the cord 2810 comprises a first end 2812 secured in the first anchoring portion 2818, a second end 2814 secured in a second anchoring portion 2820, and an intervening portion 2816 extending between the first end 2812 and the second end 2814. As shown in FIG. 28, the intervening portion 2816 of the cord 2810 extends across a midline of the upper back panel 210. In accordance with aspects herein, the first end 2812 of the cord 2810 may be affixed or secured within the first anchoring portion 2818, and the second end 2814 of the cord 2810 may affixed or secured within the second anchoring portion 2820 through the use of mechanical pressure, stitching, adhesives, bonding, and the like.

The cord 2810 may, in exemplary aspects, be formed from materials having some degree of elasticity such as rubber. According to aspects herein, the length of the cord 2810 may be variable between 5 cm and 20 cm dependent on the size of the apparel item 100 and/or the size of the hood 118, although lengths greater than or less than these values are contemplated herein. Additionally, the cord 2810 may be positioned between 0.5 to 10 cm below the seam 2805 joining the hood 118 to the upper back panel 210 of the apparel item 100, although distances above and below these values are contemplated herein. In exemplary aspects, the cross-sectional shape of the cord 2810 may comprise at least one of a circular, triangular, square, or a non-symmetrical shape. Further, the cross-sectional shape of the cord 2810 and/or the cord's diameter may vary from the first anchoring portion 2818 to the second anchoring portion 2820.

In accordance with aspects hereof, the cord 2810 may further comprise a sheath 2822. In exemplary aspects, the sheath 2822 encases the cord 2810 substantially along the length of the cord 2810 and is configured to rotate freely around the cord 2810. The sheath 2822 may be made of a material such as rubber, plastic, polyurethane, thermoplastic polyurethane, silicone, and the like. The materials used to form the sheath 2822 are generally selected to have a lower coefficient of friction than the cord 2810. And because of its lower coefficient of friction, the sheath 2822 provides decreased friction between the hood 118 of the apparel item 100 and the cord 2810 when adjusting the hood 118 to the downward or secured position and/or when removing the hood 118 from the hood lock cord system 216 and positioning the hood 118 in a worn position. Moreover, because the sheath 2822 is able to rotate freely around the cord 2810, the hood 118 may be more easily inserted and drawn down under the cord 2810 or withdrawn from under the cord 2810.

In exemplary aspects, and as shown in FIG. 28, the first anchoring portion 2818 may be secured at a seam 2824 between the upper back panel 210 and the left sleeve panel 116, and the second anchoring portion 2820 may be secured at a seam 2826 formed between the upper back panel 210 and the right sleeve panel 114 of the apparel item 100. In exemplary aspects, the first and second anchoring portions 2818 and 2820 may be formed of a pliable material such that when the first and second anchoring portions 2818 and 2820 are secured in the seams 2824 and 2826, the first and second anchoring portions 2818 and 2820 do not cause significant displacement or disruption of the seams 2824 and 2826 as opposed to, for instance, directly securing the less-deformable first and second ends 2812 and 2814 of the cord 2810 in the seams 2824 and 2826. In one exemplary aspect, the first and second anchoring portions 2818 and 2820 may be formed of a fabric material, a rubber material, a polyurethane or thermoplastic polyurethane material, and the like.

Figure 29:
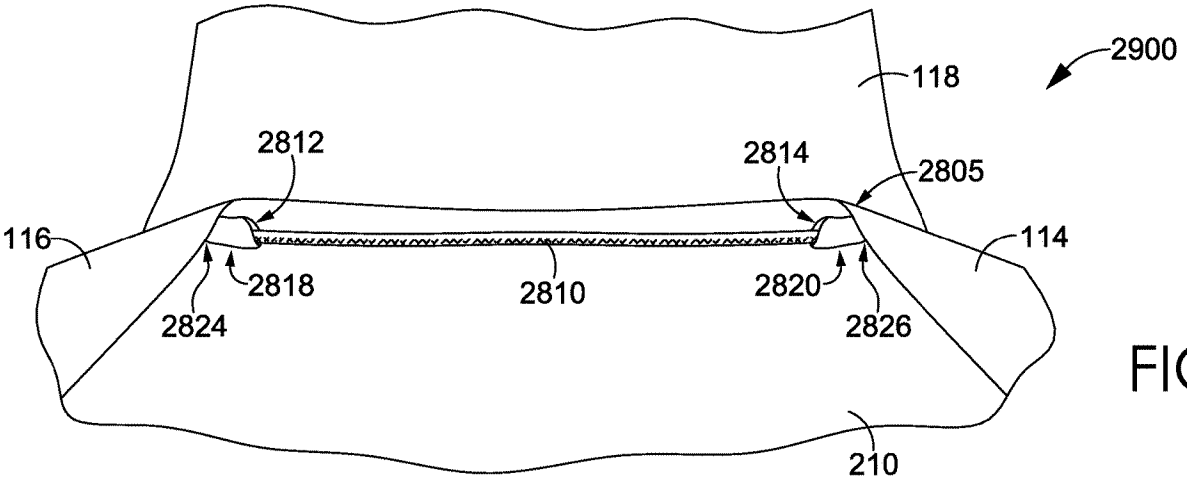
FIG. 29 depicts an alternative configuration for the exemplary hood lock cord system in accordance with aspects herein.

FIG. 29 illustrates an alternative configuration, referenced generally by the numeral 2900, where the hood lock cord system 216 does not include the sheath 2822 covering or encasing the intervening portion 2816 of the cord 2810. Any and all aspects, and any variation thereof, are contemplated as being within the scope herein.

Figure 30:
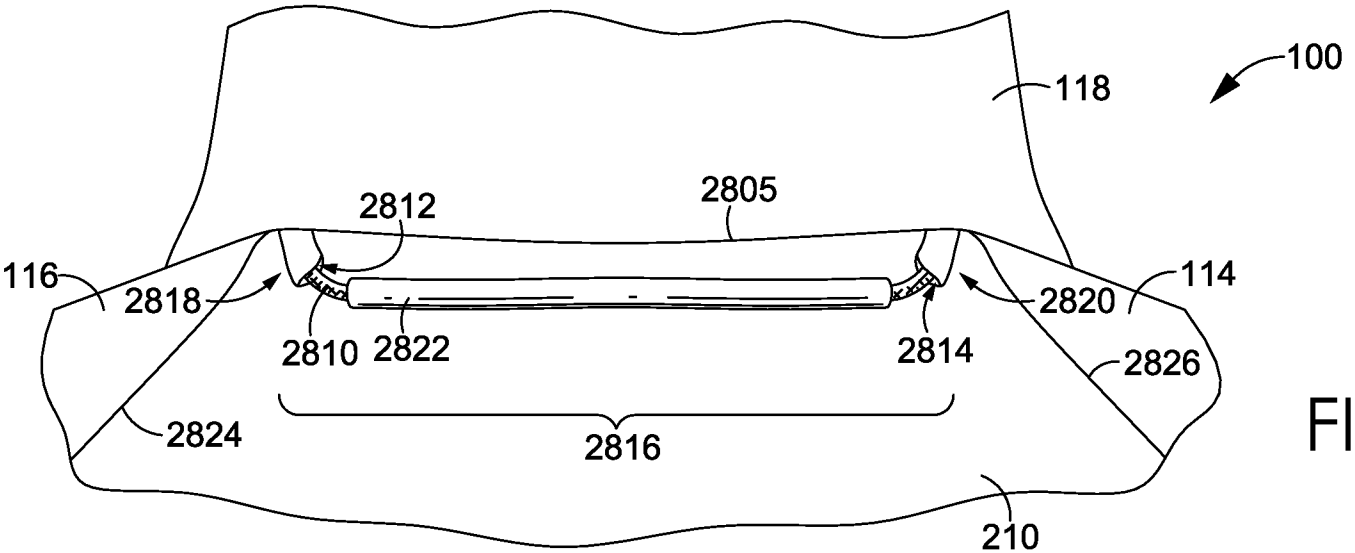
FIG. 30 depicts an alternative configuration for the exemplary hood lock cord system in accordance with aspects herein.

FIG. 30 illustrates another way of affixing the exemplary hood lock cord system 216 to the apparel item 100 in accordance with aspects herein. In exemplary aspects, the first end 2812 of the cord 2810 is received into and secured to the first anchoring portion 2818, and the second end 2814 of the cord 2810 is received into and secured to the second anchoring portion 2820. In this exemplary aspect, both the first anchoring portion 2818 and the second anchoring portion 2820 are secured at the seam 2805 formed between the upper back panel 210 and the hood 118 of the apparel item 100.

Other ways of affixing the hood lock cord system 216 to the outer-facing surface of the upper back panel 210 are contemplated herein. For instance, instead of using the first and second anchoring portions 2818 and 2820 to secure the hood lock cord system 216 to the apparel item 100 at the seams 2824 and 2826, the first end 2812 and the second end 2814 may be directly secured to the apparel item 100 at the seams 2824 and 2826. Or, with respect to FIG. 30, the first and second ends 2812 and 2814 of the cord 2810 may be directed secured to the apparel item 100 at the seam 2805 without use of the first and second anchoring portions 2818 and 2820. In another aspect, the first and second anchoring portions 2818 and 2820, or the first and second ends 2812 and 2814 of the cord 2810, may be secured directly to the outer-facing surface of the upper back panel 210 via stitching, bonding, grommets, adhesives, and the like.

Figure 31:
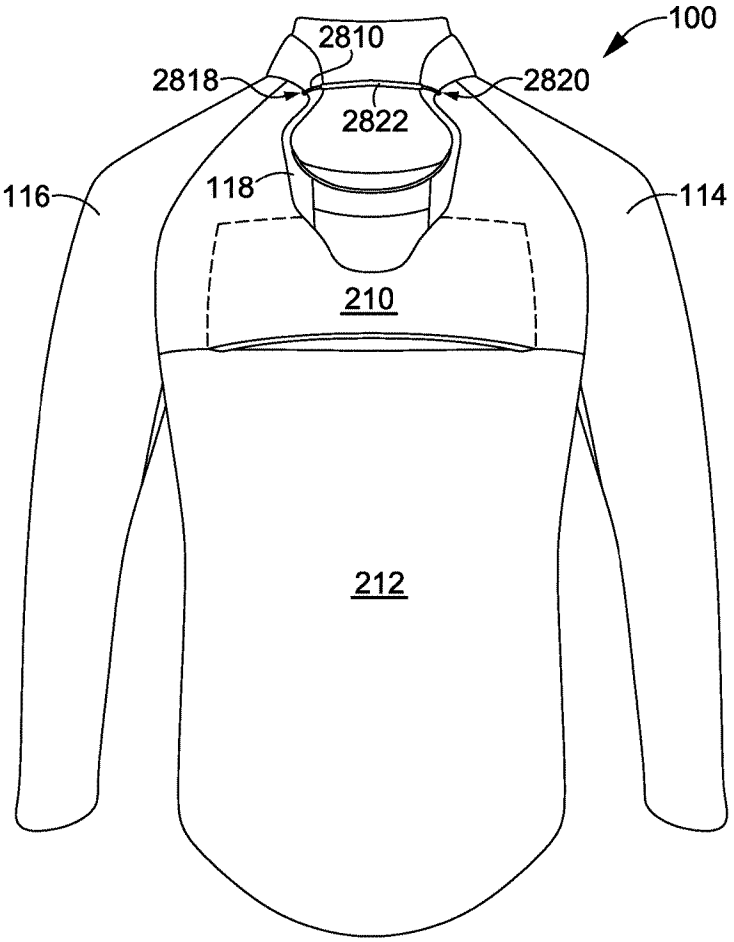
FIG. 31 depicts a back view of the exemplary apparel item described herein where the hood is in a downward position in accordance with aspects herein.

FIG. 31 illustrates a back view of the exemplary apparel item 100 having the hood lock cord system 216 where the hood 118 is in a downward or un-worn configuration in accordance with an aspect herein. As shown in FIG. 31, the hood 118 has been secured to the apparel item 100 by inserting the hood 118 under the cord 2810 of the hood lock cord system 216 such that at least a portion of the hood 118 is situated between the upper back panel 210 and the cord 2810. The hood 118 shown in FIG. 31 has not been folded or bunched. In this manner, the hood 118 retains its full length, yet is more restricted than if the apparel item 100 did not comprise the hood lock cord system 216. FIG. 31 also illustrates the first anchoring portion 2818, the second anchoring portion 2820, and the sheath 2822. As shown, use of the sheath 2822 helps to prevent the cord 2810 from coming into direct contact with the hood 118. This not only helps to protect the structural integrity of the cord 2810 and the hood 118 but also may facilitate the insertion of the hood 118 under the cord 2810 as explained above.

Figure 32:
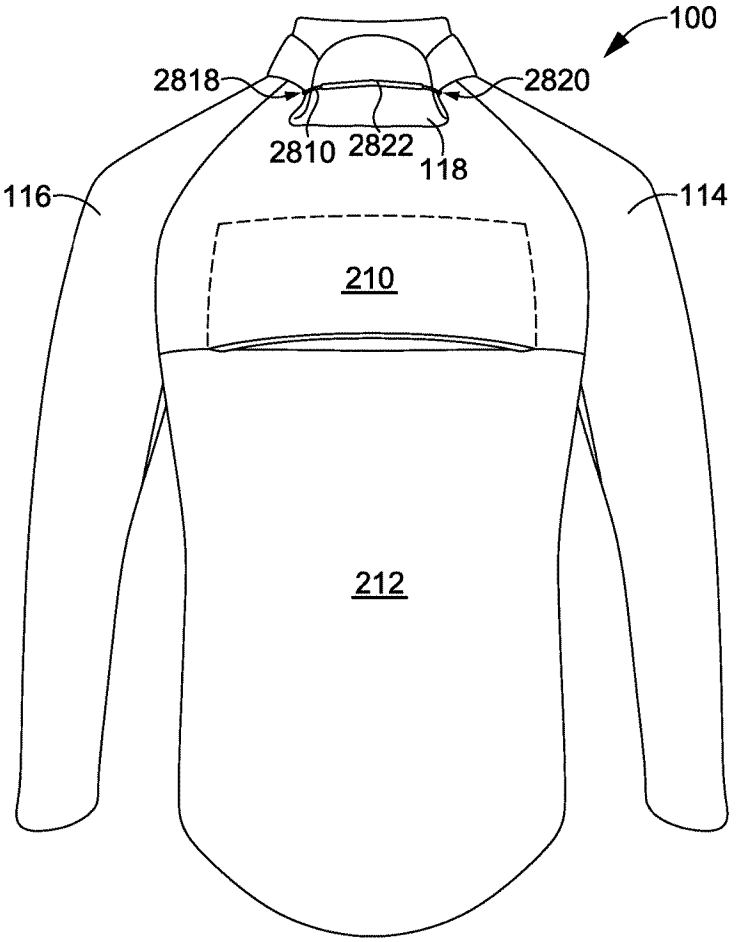
FIG. 32 depicts a back view of the exemplary apparel item described herein where the hood is in a downward position in accordance with aspects herein.

FIG. 32 illustrates an additional way to utilize the hood lock cord system 216 in accordance with aspects herein. This figure illustrates a back view of the exemplary apparel item 100 having the hood 118 in a secured position. With respect to FIG. 32, the hood 118 has been folded or bunched prior to being secured under the cord 2810 of the hood lock cord system 216. By folding or bunching the hood 118 prior to securing the hood 118, the hood 118 is further restricted from exhibiting movement during the wearer's activities. This may be advantageous during especially vigorous activities. It is contemplated herein that the hood 118 may be secured via the hood lock cord system 216 in additional ways other than those shown in, for example, FIGS. 31 and 32.

As shown and described, the hood 118 of the exemplary apparel item 100 is configured to conform closely to the wearer's head when worn, thereby preventing undesirable air flow from entering the apparel item at locations between the hood 118 and the wearer's face. Moreover, the hood lock cord system 216 as shown and described, helps to secure the hood 118 of the apparel item 100 when not in use, thereby minimizing distractions associated with the hood 118.

Materials

Figure 33:
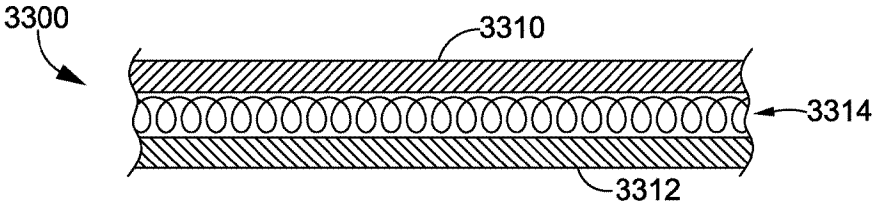
FIG. 33 depicts a cross-sectional view of a composite fabric that is used to form the exemplary apparel item as described herein in accordance with aspects herein.

As previously described, the apparel item 100 described herein may be formed in whole or in part of a composite fabric. A cross-sectional view of an exemplary composite fabric 3300 is illustrated in FIG. 33 in accordance with aspects herein. In exemplary aspects, the composite fabric 3300 may comprise a face fabric 3310, a backer fabric 3312, and an air-permeable membrane 3314 sandwiched between or interposed between the face fabric 3310 and the backer fabric 3312. In exemplary aspects, the face fabric 3310 may be affixed to the backer fabric via, for example, an adhesive. For example, the face fabric 3310 may be affixed to the membrane 3314 via the adhesive, and the backer fabric 3312 may be affixed to the membrane 3314 via the adhesive to form the composite fabric 3300. Moreover, in exemplary aspects the adhesive may be applied as a dot matrix or other type of discontinuous pattern at discrete locations on the face fabric 3310 and/or backer fabric 3312. By selectively applying the adhesive at discrete locations, as opposed to coating the entire surface of the face fabric 3310 and/or backer fabric 3312 with a film of adhesive, permeability characteristics of the composite fabric 3300 may be increased. Further, by selectively applying the adhesive at discrete locations as compared to applying the adhesive as a continuous film, the composite fabric 3300 may exhibit greater pliability or flexibility.

The composite fabric 3300 may have an overall weight sufficient to withstand environmental conditions such as wind and to provide a degree of warmth to the wearer while still being light enough and having sufficient pliability to allow the wearer to engage in athletic activities. Exemplary weights for the composite fabric 3300, measured in grams/$m^2$ (grams per square meter (gsm)), may comprise between 80-220 gsm, 80-200 gsm, 80-180 gsm, or 80-160 gsm although weights above and below these ranges are contemplated herein.

In exemplary aspects, the face fabric 3310 is configured to be an outer-facing surface the apparel item 100 when the composite fabric 3300 is incorporated into the apparel item 100. In exemplary aspects, the face fabric 3310 may be treated with a durable water repellent (DWR) finish making the face fabric 3310 impermeable or substantially impermeable to water. In some exemplary aspects, the face fabric 3310 may comprise a woven fabric. In other exemplary aspects, the face fabric 3310 may comprise a knit fabric. Use of a knit fabric as the face fabric 3310 may cause the apparel item 100 to generate less noise upon movement and/or to have increased permeability or breathability characteristics.

Figure 34A:
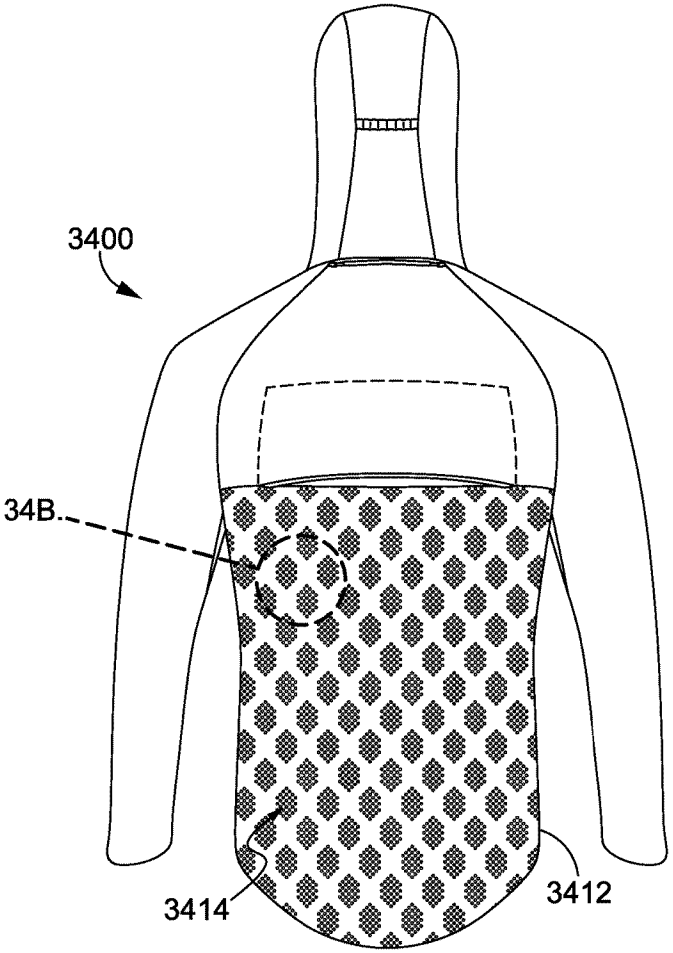
FIG. 34A depicts a back view of the exemplary apparel item described herein illustrating a knit panel on the back portion of the apparel item in accordance with aspects herein.

In additional exemplary aspects, the face fabric 3310 may comprise a Jacquard knit pattern on certain portions of the apparel item 100. For example, a Jacquard knit pattern may be used on the back panel 214 of the apparel item 100. This is illustrated in FIG. 34A, which depicts a back view of an exemplary apparel item 3400 having a Jacquard knit pattern 3414 on the lower back panel 3412. In general, the Jacquard pattern 3414 may be knit to have a more open knit structure as compared to portions of the face fabric 3310 not having the Jacquard pattern 3414. For instance, the Jacquard pattern 3414 may comprise apertures or perforations integrally formed in the knit structure. The open knit structure may cause the apparel item 3400 to be more breathable in the areas where the Jacquard pattern 3414 is located. For example, the lower back panel 3412 of the apparel item 3400 is generally configured to overlie a back torso area of the wearer when the apparel item 3400 is worn. This area typically produces a lot of heat during athletic activities. By having the Jacquard knit pattern 3414 in this area, the heat and/or moisture vapor may be dissipated more quickly.

Further, in exemplary aspects, the size of the apertures or perforations of the Jacquard pattern 3414 may be based on heat or sweat map data such that larger-sized perforations or apertures may be positioned in regions corresponding to high-heat or high-sweat generating regions of the wearer while smaller-sized perforations may be positioned in regions corresponding to relatively low-heat or low-sweat generating regions of the wearer. Additionally, a gradient in apertures size may be utilized when transitioning from the larger-sized apertures to the smaller-sized apertures. Any and all aspects, and any variation thereof, are contemplated as being within the scope herein.

Although the Jacquard knit pattern 3414 is shown as being located on the lower back panel 3412 of the apparel item 3400, it is contemplated herein that the Jacquard knit pattern may be used at other locations of the apparel item 3400 where increased breathability characteristics are needed. In exemplary aspects, an air-permeable membrane, such as the membrane 3314, and a backer fabric, such as the backer fabric 3312 may underlay the Jacquard knit pattern 3414.

Figure 34B:
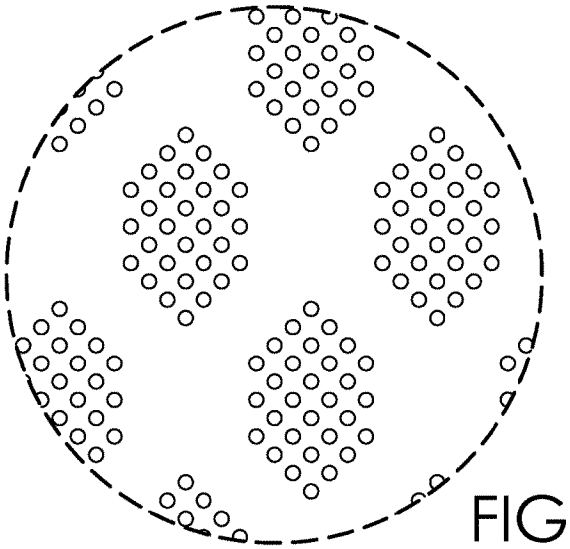
FIG. 34B is a close-up view of the knit panel of FIG. 34A in accordance with aspects herein.

A close-up view of the Jacquard knit pattern 3414 is shown in FIG. 34B. The pattern 3414 may comprise shapes such as diamonds that are knit to have a more open knit structure as compared to other portions of the pattern. As explained, the open knit structure facilitates breathability. Although diamond shapes are shown, it is contemplated herein that the Jacquard knit pattern 3414 may comprise other geometric or organic shapes integrally formed in the knit structure.

Returning to FIG. 33, the backer fabric 3312 is configured to be an inner-facing surface of the apparel item 100 when the composite fabric 3300 is incorporated into the apparel item 100. In exemplary aspects, the backer fabric 3312 may comprise a knit or woven fabric. Moreover, it is contemplated herein that both the face fabric 3310 and the backer fabric 3312 may comprise a knit fabric. Having such a configuration may increase the overall permeability characteristics of the composite fabric 3300 due to the generally looser knit structure versus woven structure. It is further contemplated herein that the face fabric 3310 may comprise a knit fabric while the backer fabric 3312 may comprise a woven fabric, or the face fabric 3310 may comprise a woven fabric while the backer fabric 3312 may comprise a knit fabric. As well, it is contemplated herein that both the face fabric 3310 and the backer fabric 3312 may comprise a woven fabric. Any and all aspects, and any variation thereof, are contemplated was being within the scope herein.

The air-permeable membrane 3314, in exemplary aspects, may comprise a material that is substantially impervious to liquid water but permits water vapor and/or air to pass through. This property helps to make the composite fabric 3300 useful for outdoor activities where a wearer may generate large amounts of body heat and/or perspiration while potentially being exposed to rain and/or snow. The membrane 3314 would help to prevent the precipitation from reaching the skin of the wearer while still allowing body heat and/or moisture vapor to escape the fabric 3300.

In one exemplary aspect, the membrane 3314 may comprise a nanofiber material that is spun in a fine web by a process such as electrospinning. Further, in exemplary aspects, the nanofiber material may comprise a liquid polymer such as polyurethane (PU) or thermoplastic polyurethane (TPU) although other liquid polymer materials are contemplated as being within the scope herein.

The density of the electrospun fibers in the membrane 3314 may be variable, where the density is measured in grams/weight of electrospun film per linear yard. The density of the electrospun fibers may be changed by, for instance, slowing down the electrospinning process so that more fibers are deposited per square inch. When the density of the electrospun fibers is greater (such as, for example, greater than or equal to 9 grams/weight), this corresponds to more layers of electrospun fibers. More layers of electrospun fibers, in turn, generally cause the membrane 3314 to exhibit greater waterproof characteristics but to be less permeable to air and/or moisture vapor. Conversely, when the density of the electrospun fibers is less (such as, for example, less than or equal to 3 grams/weight), this corresponds to fewer layers of electrospun fibers. Fewer layers of electrospun fibers, in turn, generally cause the membrane 3314 to exhibit less waterproof characteristics but to be more permeable to air and/or moisture vapor.

The density of the membrane 3314 may be selected in conjunction with the properties of the face fabric 3310 and the backer fabric 3312 to achieve an overall level of air and/or moisture vapor permeability for the composite fabric 3300. For example, the tightness of the weave or knit of the face fabric 3310 and/or the backer fabric 3312 may be increased to reduce permeability characteristics associated with the fabrics 3310 and 3312, but the density of the membrane 3314 may be decreased to increase permeability so that a total overall permeability of the composite fabric 3300 is within a predetermined range. Conversely, the tightness of the weave or knit of the face fabric 3310 and/or the backer fabric 3312 may be decreased to increase permeability characteristics associated with the fabrics 3310 and 3312, but the density of the membrane 3314 may be increased to decrease permeability of the membrane 3314 to achieve a total overall permeability of the composite fabric 3300 that is within the predetermined range. Any and all aspects, and any variation thereof, are contemplated as being within the scope herein.

Moreover, panels of the composite fabric 3300 having different permeability characteristics may be used on different portions of the apparel item 100 to target areas of the wearer that produce more or less moisture vapor. For instance, panels of the composite fabric 3300 used to form the front and back of the apparel item 100 may be configured to be more permeable as compared to panels of the composite fabric 3300 used to form the sleeve portions or hood portions of the apparel item 100 since these portions typically overlie areas of the wearer that produce less moisture vapor as compared to the front and back torso areas of the wearer.

As shown and described, the material used to form the apparel item 100 may provide warmth and protection from the elements through, for example, use of the DWR finish on the face fabric, and minimal distractions through use of, for instance, a knit fabric as the face fabric. Further, use of the nanofiber membrane and the Jacquard knit pattern may help to increase the breathability characteristics of the apparel item 100.

Pocket Systems

As previously described, the apparel item 100 may further comprise the pocket systems 124, where the pocket systems 124 are configured to secure items commonly stowed in pockets such that the items are restrained from movement during wearer activities. In one exemplary aspect, and as shown in FIG. 1, the pocket systems 124 may comprise a pocket located on an inner-facing surface of the apparel item 100, where the pocket is sized to hold a mobile phone. In an additional exemplary aspect, the pocket systems 124 may comprise features configured, for instance, to secure items such as keys and credit/debit cards during wearer activity.

Figure 35:
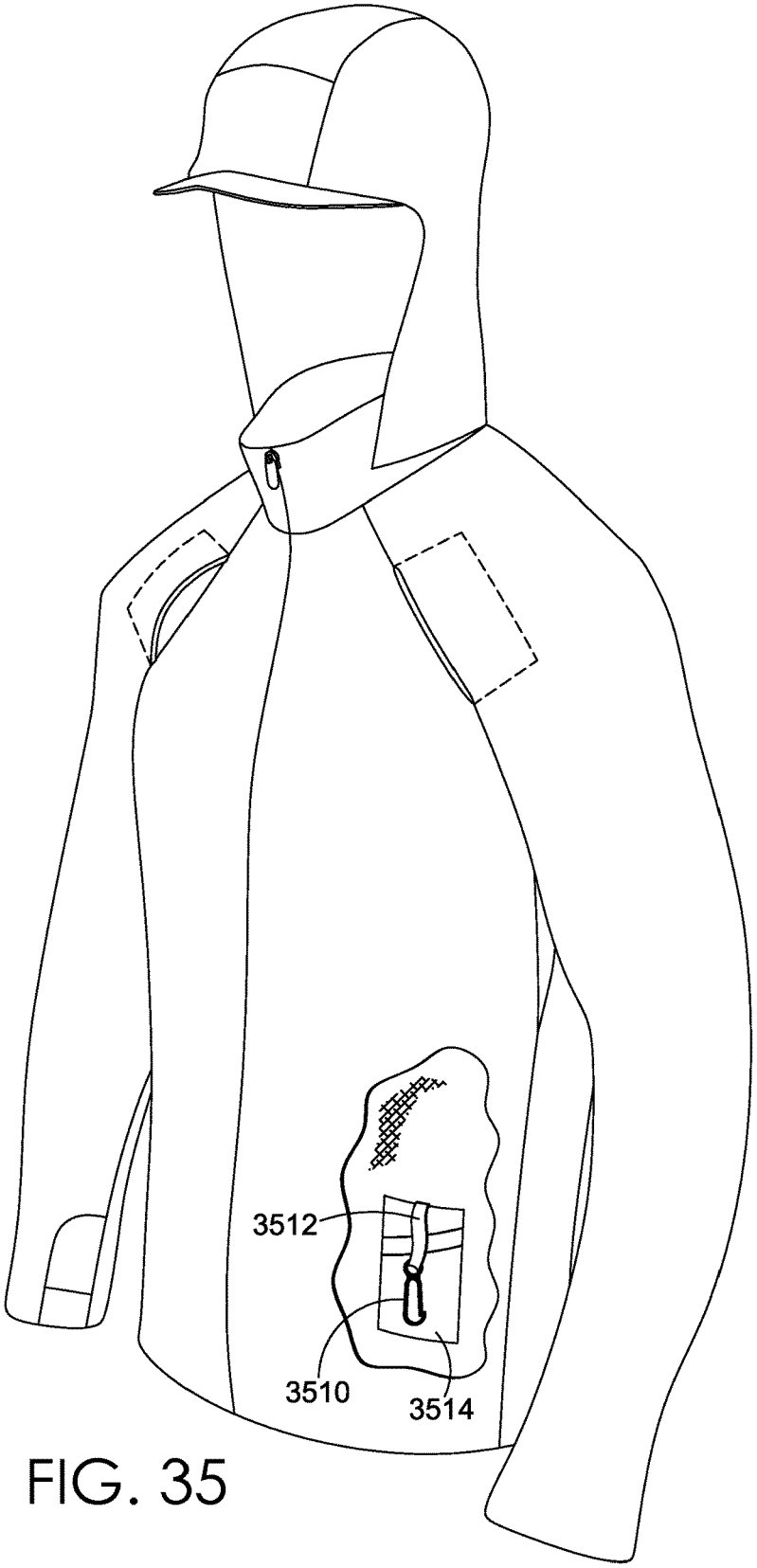
FIG. 35 depicts a cut-away view of an exemplary pocket system in accordance with aspects herein.

A cut-away view of such a pocket system 124 for the pocket 442 is shown in FIG. 35. In exemplary aspects, the pocket system 124 may comprise a hook 3510, such as a bolt snap hook or a spring hook, that is affixed to the liner 444 via a tether cord 3512. The hook 3510 may be configured to secure, for instance, a key ring. The pocket system 124 may further comprise a layered pocket insert 3514 comprising one or more pockets useable for storing items such as credit/debit cards, driver licenses, and the like. The pocket insert 3514 may be affixed to the liner 444 of the pocket 442. The components of the pocket system 124 are exemplary only, and it is contemplated herein that the pocket system 124 may comprise additional features configured to secure and restrain items typically stowed in pockets. Further, although the pocket system 124 is shown as being located within the pocket 142, it is contemplated herein that the pocket system 124 may also be located within the pocket 140 and/or that a pocket system 124 may be located in both the pocket 140 and the pocket 142. Any and all aspects, and any variation thereof, are contemplated as being within the scope herein. The pocket system 124 as shown and described helps to secure items during wearer activities, which, in turn, helps to reduce distractions associated with these items.

The Apparel Item

As shown and described above, the apparel item 100 comprises a number of different features that individually contribute to the functional benefits of the apparel item 100, namely providing warmth and protection from the elements, minimizing distractions, and promoting breathability. Besides individually contributing to these benefits, the features described herein work together to achieve these benefits as will be described below.

Figure 36:
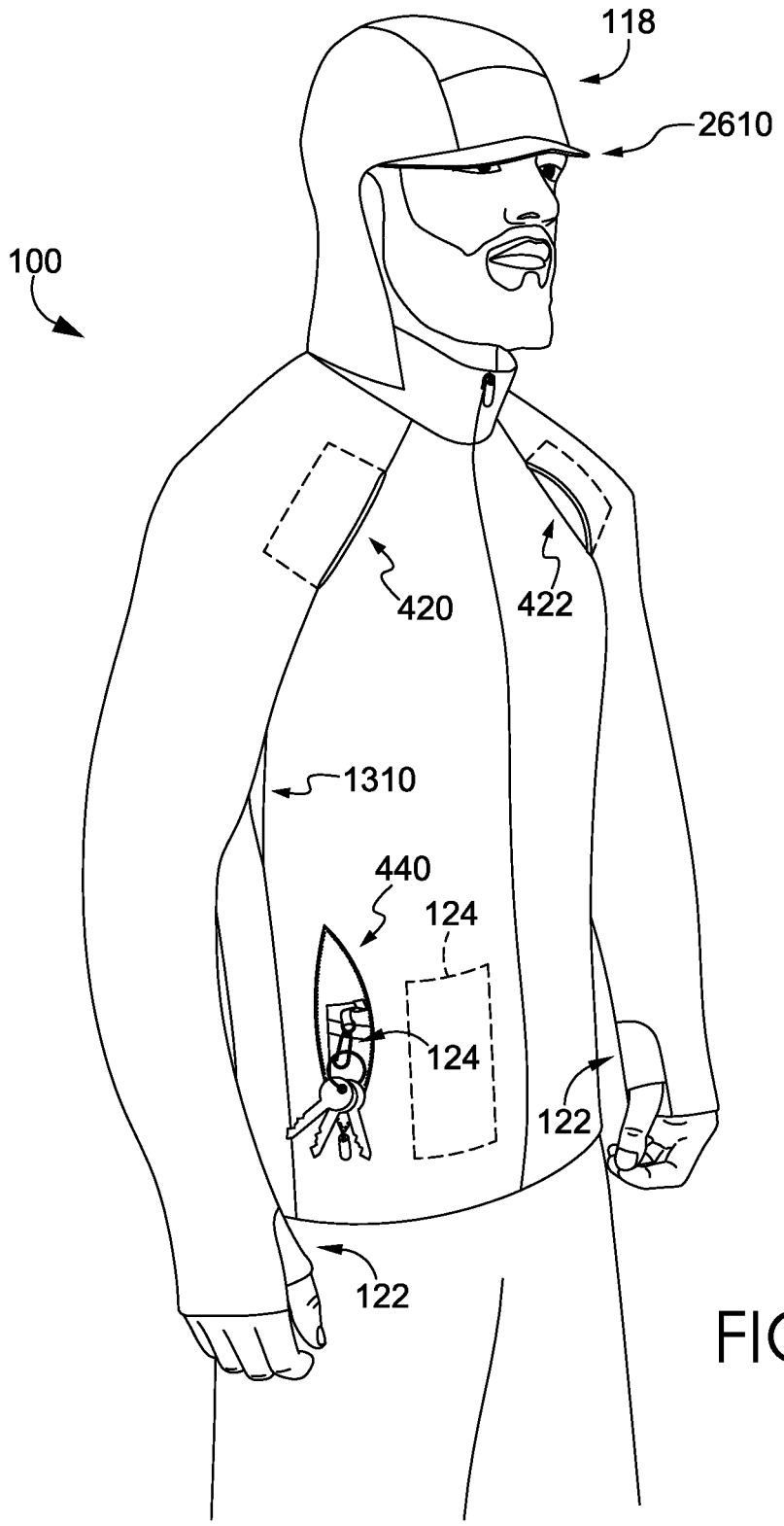
FIG. 36 depicts a front perspective view of the exemplary apparel item described herein in an as-worn configuration in accordance with aspects herein.
Figure 37:
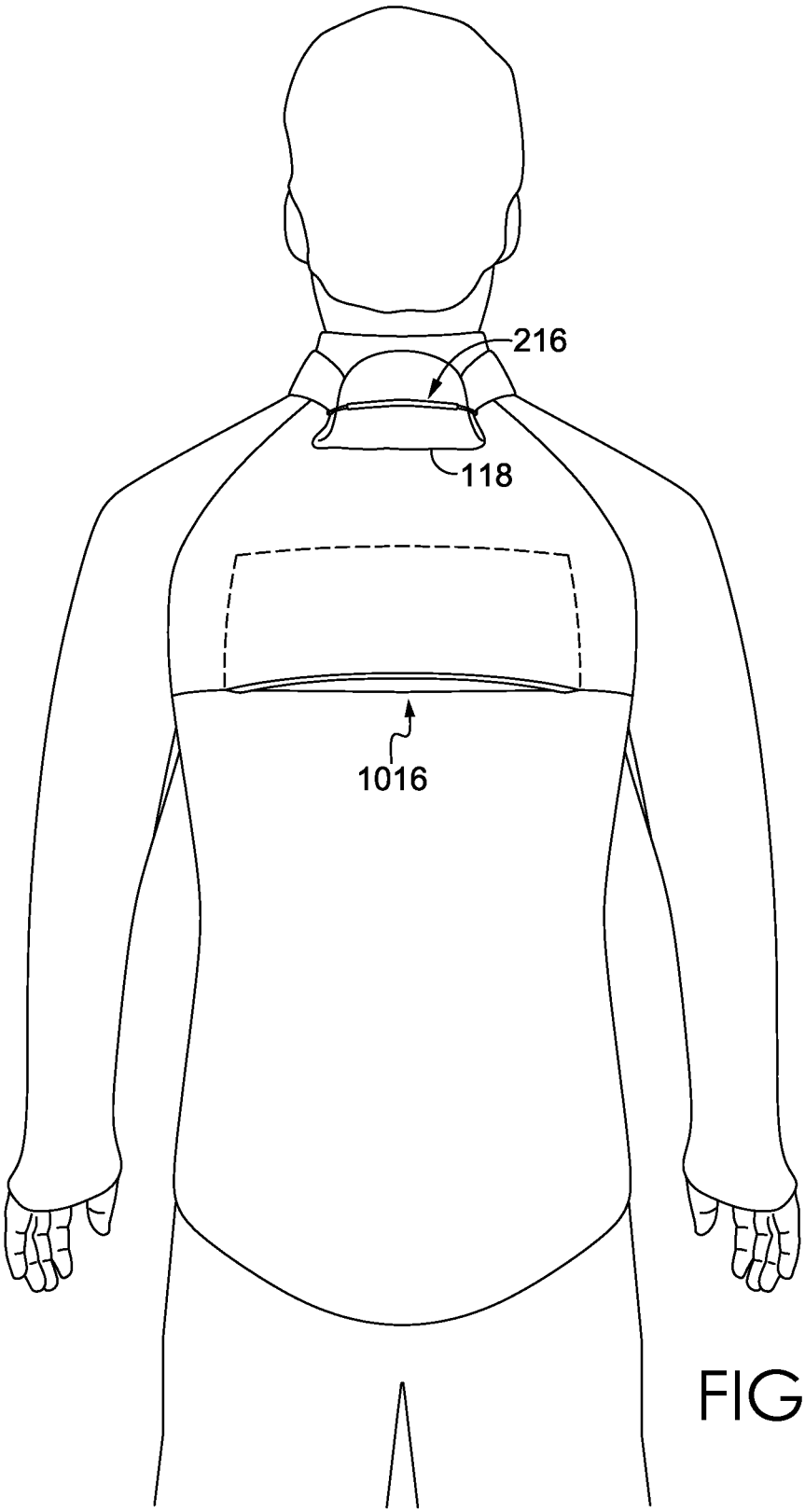
FIG. 37 is a back view of the exemplary apparel item of FIG. 36 in accordance with aspects herein.

FIGS. 36 and 37 depict front perspective and back views respectively of the apparel item 100 in an as-worn configuration in accordance with aspects herein. The figures are provided to give an illustration of how the features described herein work together to achieve the functional benefits associated with the apparel item 100.

As a first example, the integrated duct system 120 as exemplified by, for instance, the first and second inflow air ducts 420 and 422, the re-sealable pockets 440 and 442, the perforated inserts 1310, and the outflow air duct 1016, work together with the hood 118, the hood lock cord system 216, the layered thumbhole assembly 122, the composite fabric 3300, and the pocket systems 124 to reduce or minimize the number of distractions associated with the apparel item 100. As an example, the moldable bill 2610 and the ruching 2710 of the hood 118 along with the layered thumbhole assembly 122 limit the amount of air entering the apparel item 100 at the hood portion and sleeve portions of the apparel item 100 respectively when the hood 118 is in an as-worn position. By limiting air flow in these locations, the noise associated with the air flow is reduced (especially noticeable at the hood portion of the apparel item 100), as well as the distractions caused by cold air entering the apparel item 100 at unwanted locations.

Continuing, the hood 118 and the hood lock cord system 216 work together to reduce distractions. When not being used by the wearer, the hood 118 can be stored underneath the cord 2810 of the hood lock cord system 216 as shown in FIG. 37 thereby preventing the hood 118 from moving during wearer activities and distracting the wearer.

Further, as explained above, forming the face fabric 3310 of the composite fabric 3300 from a knit material lessens the amount of noise produced by the composite fabric 3300 during wearer movement thereby reducing distractions. As well, the pocket systems 124 help to secure items during wearer activities, which also contribute to lessening distractions during wearer movement. Additionally, use of integrated duct system as described herein, promotes breathability of the apparel item 100 and reduces the need for the wearer to continually adjust the apparel item 100 during wear in an attempt to obtain an optimal level of ventilation versus warmth. By reducing the need for the wearer to continually adjust the apparel item 100 during wearer activities, distractions are reduced for the wearer.

The features described herein also work together to provide warmth and protection from the elements. For instance, forming the hood 118 and other portions of the apparel item 100 from the composite fabric 3300 help to protect the wearer from rain and/or snow due to the face fabric 3310 being treated with a DWR finish and the membrane 3314 being substantially impervious to water. Moreover, the moldable bill 2610 and the ruching 2710 associated with the hood 118 along with the use of the overlapping panels of the layered thumbhole assembly 122 help to prevent undesirable air and/or precipitation from entering the apparel item 100 which helps to provide warmth and protect the wearer from environmental conditions.

In yet another example, the layered thumbhole assembly 122, the hood 118, and the integrated duct system 120 work together to help to promote breathability of the apparel item 100. For instance, use of the moldable bill 2610 and the ruching 2710 for the hood 118 and the use of the layered thumbhole assembly 122 help to prevent air from flowing into the apparel item 100 at the sleeves and hood portions of the apparel item 100. Instead, air is funneled into the apparel item 100 at the inflow air ducts 420 and 422 and/or the re-sealable pockets 440 and 442, and exits the apparel item 100 at the outflow air duct 1016. By limiting the number of ingress and egress points for air to enter and leave the apparel item 100, an effective air flow pattern can be achieved around the torso area of the wearer. Since this is often a high heat-producing area, this air flow pattern is effective to cool the wearer and to remove excess heat and/or moisture vapor.

The breathability characteristics of the apparel item 100 are enhanced by use of the membrane 3314 of the composite fabric 3300. As explained, the membrane 3314 is permeable to air and moisture vapor and further helps to dissipate excess heat and/or moisture vapor produced by the wearer during activities. Moreover, in some exemplary aspects, a Jacquard knit pattern such as the Jacquard knit pattern 3414 shown in FIG. 34A provides additional breathability characteristics to portions of the apparel item 100 where the pattern 3414 is integrated. The membrane 3314 along with the Jacquard knit pattern 3414 (when used) provide breathability without creating a defined egress point for air to leave the apparel item 100 which would potentially impact the air flow pattern achieved through use of the inflow air ducts 420 and 422 and the outflow air duct 1016.

Method of Manufacture

Figure 38:
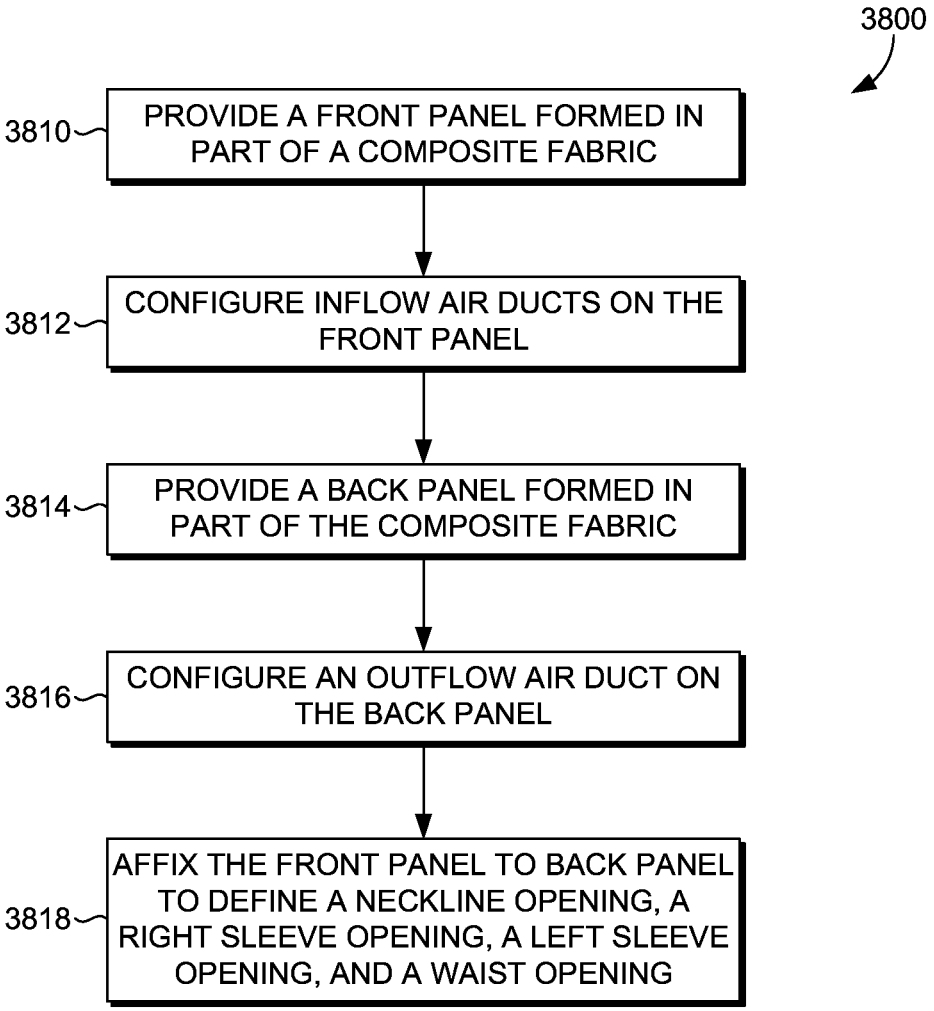
FIG. 38 is a flow diagram of an exemplary method of manufacturing the apparel item described herein in accordance with aspects herein.

Turning now to FIG. 38, a flow diagram of an exemplary method 3800 of manufacturing the apparel item described herein is provided. The exemplary apparel item may comprise the apparel item 100, 700, 800, or 900. At a step 3810, a front panel is provided. The front panel may comprise one or more sub-panels such as those shown and described with respect to FIGS. 1 and 8. The front panel may be formed in whole or in part from a composite fabric such as the composite fabric 3300.

At a step 3812, one or more inflow air ducts may be formed on the front panel such as the inflow air ducts 420, 422, 440, 442, 720, 722, 822, 824, 918, and/or 920. In one exemplary aspect, an inflow air duct may be formed by permanently and discontinuously affixing panel edges together, where the inflow air duct is formed in the areas that are discontinuously affixed. Further, in exemplary aspects, an upper edge of the inflow air duct may be reinforced with a reinforcement strip having a pre-formed shape that causes the upper edge of the inflow air duct to extend away from the outer-facing surface of the apparel item such that the inflow air duct is permanently maintained in an open position. The reinforcement strip may comprise, for instance, the reinforcement strip 1400, 1420, or 1440 of FIGS. 14A-14C.

In another exemplary aspect, an inflow air duct may be formed by permanently and discontinuously affixing panel edges together and releasably securing the discontinuously affixed areas with a re-sealable closure mechanism such as a zipper. In yet another exemplary aspect, an inflow air duct may be formed by incising one or more of the front panels and releasably securing the incised edges together with a re-sealable closure mechanism such as a zipper. Any and all aspects, and any variation thereof, are contemplated as being within the scope herein.

At a step 3814, a back panel is provided that may be formed in whole or in part from the composite fabric 3300. In exemplary aspects, the back panel may comprise an upper back panel and a lower back panel. At a step 3816, an outflow air duct is configured on the back panel. In one example, the outflow air duct is formed by permanently and discontinuously affixing a lower edge of the upper back panel to an upper edge of the lower back panel. The lower edge of the upper back panel may, in exemplary aspects, be reinforced with a reinforcement strip, such as the reinforcement strip 1400, 1420, or 1440 that causes the lower edge of the upper back panel to extend a predetermined distance away from the lower back panel. At a step 3818, the front panel is affixed to the back panel to define at least a neckline opening, a right sleeve opening, a left sleeve opening, and a waist opening.

The method 3800 may further comprise providing a hood having a moldable bill and ruching on the back portion of the hood, and affixing the hood to the apparel item at the neckline opening. Moreover, a hood lock cord system, such as the hood lock cord system 216, may be formed by affixing a first end of a cord to a first lateral side of the upper back panel adjacent to the neckline opening, and affixing a second end of the cord to a second lateral side of the upper back panel adjacent to the neckline opening such that an intervening portion of the cord extends across the midline of the upper back panel.

The method 3800 may further comprise affixing a right sleeve panel to the right sleeve opening and affixing a left sleeve panel to the left sleeve opening. Additionally, a perforated insert, such as the perforated insert 1310 may be affixed to the apparel item at the junction of the right and left sleeve panels, and the front and back panels.

As well, a layered thumbhole assembly, such as the layered thumbhole assembly 122 may be formed by providing a distal strap having a trailing edge and one or more leading edges and affixing the distal strap to the respective sleeve panel at a cutout area such that the distal strap spans at least a portion of the cutout. An anterior patch is further provided where the anterior patch has a leading edge and at least one trailing edge. The anterior patch is affixed to the respective sleeve panel at the at least one trailing edge such that the anterior patch spans at least a portion of the cutout in the sleeve panel and such that the distal strap trailing edge overlaps at least a portion of the anterior patch to form an aperture for receiving a wearer's thumb.

The method 3800 may further comprise forming one or more pocket systems, such as the pocket systems 124 on the apparel item. In one example, a pocket may be created on an inner-facing surface of the apparel item where the pocket is sized to hold a mobile phone. In another example, a hook may be affixed to a pocket liner of a pocket via a tether, and a layered-pocket insert may be affixed to the pocket liner.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A cold-weather apparel item comprising:

a plurality of front panels including at least a right front panel and a left front panel, the right front panel and the left front panel adapted to cover a front torso area of a wearer when the cold-weather apparel item is in an as-worn configuration, each of the plurality of front panels having a perimeter shape defined by at least one edge;

a back panel adapted to cover a back torso area of the wearer when the cold-weather apparel item is in the as-worn configuration, the back panel coupled to the plurality of front panels to define at least a neckline opening, a right sleeve opening, a left sleeve opening, and a waist opening, the back panel comprising an upper back panel portion having at least a first lower edge and a lower back panel portion having at least a second upper edge, the first lower edge of the upper back panel portion permanently and discontinuously affixed to the second upper edge of the lower back panel portion to form at least a first outflow air duct that extends in a generally horizontal orientation across a midline of the back panel;

a right sleeve panel extending from the right sleeve opening and adapted to cover a first arm of the wearer; and a left sleeve panel extending from the left sleeve opening and adapted to cover a second arm of the wearer, wherein:

a front edge of the right sleeve panel is permanently and discontinuously affixed to an upper edge of the right front panel to form a first inflow air duct, a front edge of the left sleeve panel is permanently and discontinuously affixed to an upper edge of the left front panel to form a second inflow air duct, at areas where the respective edges of the panels are discontinuously affixed together, at least one of the panel edges is reinforced with a reinforcement strip that extends along a length of the at least one of the panel edges, wherein the reinforcement strip is configured such that the first outflow air duct, the first inflow air duct, and the second inflow air duct are permanently maintained in an open state, an opening of the first inflow air duct is skewed in a positive direction with respect to a hypothetical vertical axis that bisects the first inflow air duct, and an opening of the second inflow air duct is skewed in a negative direction with respect to a hypothetical vertical axis that bisects the second inflow air duct.

2. The cold-weather apparel item of claim 1, further comprising:

a first perforated insert located at a right underarm portion of the cold-weather apparel item; and a second perforated insert located at a left underarm portion of the cold-weather apparel item.

3. The cold-weather apparel item of claim 1, wherein the reinforcement strip of the first outflow air duct is affixed to the first lower edge of the upper back panel portion, and wherein the reinforcement strip of the first outflow air duct comprises a pre-formed arched shape.

4. The cold-weather apparel item of claim 1, wherein at least one of the plurality of front panels, the upper back panel portion, or the lower back panel portion is formed from a composite fabric comprising:

a face fabric adapted to be an outer-facing surface of the cold-weather apparel item;

a backer fabric adapted to be an inner-facing surface of the cold-weather apparel item; and a nanofiber membrane interposed between the face fabric and the backer fabric.

5. The cold-weather apparel item of claim 4, wherein the face fabric comprises one of a knit fabric or a woven fabric that is treated with a durable water repellent finish.

6. The cold-weather apparel item of claim 5, wherein the backer fabric comprises one of a knit fabric or a woven fabric.

7. The cold-weather apparel item of claim 6, wherein the nanofiber membrane is substantially impervious to liquid water but is permeable to moisture vapor and air.

8. A cold-weather apparel item configured to minimize distractions, provide warmth and protection from the elements, and promote breathability, the cold-weather apparel item comprising:

one or more front panels adapted to cover a front torso area of a wearer when the cold-weather apparel item is in an as-worn configuration, the one or more front panels having one or more inflow air ducts;

a back panel adapted to cover a back torso area of the wearer when the cold-weather apparel item is in the as-worn configuration, the back panel coupled to the one or more front panels to define at least a neckline opening, a right sleeve opening, a left sleeve opening, and a waist opening, the back panel having at least one outflow air duct;

a right sleeve extending from the right sleeve opening;

a left sleeve extending from the left sleeve opening;

a hood affixed to the neckline opening; and a hood lock cord system comprising:

a cord having a first end, a second end, and an intervening portion between the first end and the second end, the first end of the cord secured to a first seam formed between the right sleeve and a first lateral side of an outer-facing surface of the back panel proximate to the neckline opening and the second end of the cord secured to a second seam formed between the left sleeve and a second lateral side of the outer-facing surface of the back panel proximate to the neckline opening such that the intervening portion of the cord extends across a midline of the back panel, the cord useable to secure the hood when the hood is not being used.

9. The cold-weather apparel item of claim 8, wherein the back panel comprises an upper back panel portion and a lower back panel portion.

10. The cold-weather apparel item of claim 9, wherein the at least one outflow air duct comprises:

a first edge formed from a lower edge of the upper back panel portion;

a semi-rigid reinforcement strip affixed along the first edge of the at least one outflow air duct such that the at least one outflow air duct is maintained in a permanently open position; and a second edge formed from an upper edge of the lower back panel portion, wherein the at least one outflow air duct has a generally horizontal orientation and extends across the midline of the back panel.

11. The cold-weather apparel item of claim 8, wherein the hood comprises a moldable bill.

12. The cold-weather apparel item of claim 11, wherein the hood further comprises ruching on a back portion of the hood.

13. The cold-weather apparel item of claim 8, where the right sleeve and the left sleeve each comprise a cuff, the cuff comprising:

a distal strap having a distal strap trailing edge and one or more distal strap leading edges, at least one of the one or more distal strap leading edges being affixed to a respective sleeve at a distal end of the sleeve such that the distal strap spans at least a portion of a cutout in the distal end of the sleeve;

an anterior patch having an anterior patch leading edge and at least one anterior patch trailing edge, the at least one anterior patch trailing edge being affixed to the sleeve, and the anterior patch spanning at least a portion of the cutout in the sleeve; and an aperture formed by the distal strap trailing edge overlapping at least a portion of the anterior patch, the aperture having a perimeter and extending through the cuff to the cutout, the perimeter of the aperture comprising at least a portion of the distal strap trailing edge and at least a portion of the anterior patch leading edge.

14. A method of manufacturing a cold-weather apparel item configured to minimize distractions, provide warmth, and promote breathability, the method of manufacturing comprising:

providing a right front panel formed at least in part of a composite fabric, the right front panel having a perimeter shape defined by at least an upper edge;

providing a left front panel formed at least in part of the composite fabric, the left front panel having a perimeter shape defined by at least an upper edge;

providing a back panel formed at least in part of the composite fabric, the back panel comprising an upper back panel portion having at least a first lower edge and a lower back panel portion having at least a second upper edge, the first lower edge of the upper back panel portion permanently and discontinuously affixed to the second upper edge of the lower back panel portion to form at least a first outflow air duct that extends in a generally horizontal orientation across a midline of the back panel, wherein at least one of the first lower edge or the second upper edge is reinforced with a reinforcement strip that extends along a length of the at least one of the first lower edge or the second upper edge to maintain the first outflow air duct in a permanently open state;

affixing the right front panel and the left front panel to the back panel to define at least a neckline opening, a right sleeve opening, a left sleeve opening, and a waist opening;

affixing a right sleeve panel to the right sleeve opening, wherein a front edge of the right sleeve panel is permanently and discontinuously affixed to the upper edge of the right front panel to form a first inflow air duct, wherein at least one of the front edge of the right sleeve panel or the upper edge of the right front panel is reinforced with a reinforcement strip that extends along a length of the at least one of the front edge of the right sleeve panel or the upper edge of the right front panel to maintain the first inflow air duct in a permanently open state, and wherein an opening of the first inflow air duct is skewed in a positive direction with respect to a hypothetical vertical axis that bisects the first inflow air duct;

affixing a left sleeve panel to the left sleeve opening, wherein a front edge of the left sleeve panel is permanently and discontinuously affixed to the upper edge of the left front panel to form a second inflow air duct, wherein at least one of the front edge of the left sleeve panel or the upper edge of the left front panel is reinforced with a reinforcement strip that extends along a length of the at least one of the front edge of the left sleeve panel or the upper edge of the left front panel to maintain the second inflow air duct in a permanently open state, and wherein an opening of the second inflow air duct is skewed in a positive direction with respect to a hypothetical vertical axis that bisects the second inflow air duct;

providing a hood having a moldable bill and ruching on a back portion of the hood; and affixing the hood to the neckline opening.

15. The method of manufacturing of claim 14, further comprising:

positioning a cord having a first end, a second end, and an intervening portion proximate to the neckline opening on an outer-facing surface of the back panel such that the first end is positioned on a first lateral side of the back panel proximate the neckline opening and is secured in a seam affixing the right sleeve panel to the right sleeve opening, the second end is positioned on a second lateral side of the back panel proximate the neckline opening and is secured in a seam affixing the left sleeve panel to the left sleeve opening, and the intervening portion of the cord extends across the midline of the back panel.

16. The method of manufacturing of claim 14, wherein the composite fabric comprises:

a face fabric adapted to be an outer-facing surface of the cold-weather apparel item;

a backer fabric adapted to be an inner-facing surface of the cold-weather apparel item; and a nanofiber membrane interposed between the face fabric and the backer fabric.

* * * * *